US009775481B2

(12) United States Patent
Conrad

(10) Patent No.: US 9,775,481 B2
(45) Date of Patent: Oct. 3, 2017

(54) ALL IN THE HEAD SURFACE CLEANING APPARATUS

(71) Applicant: Omachron Intellectual Property Inc., Hampton (CA)

(72) Inventor: Wayne Ernest Conrad, Hampton (CA)

(73) Assignee: Omachron Intellectual Property Inc., Hampton, Ontario (CA)

( * ) Notice: Subject to any disclaimer, the term of this patent is extended or adjusted under 35 U.S.C. 154(b) by 352 days.

(21) Appl. No.: 14/573,155

(22) Filed: Dec. 17, 2014

(65) Prior Publication Data

US 2016/0174800 A1 Jun. 23, 2016

(51) Int. Cl.

| | |
|---|---|
| ***A47L 9/16*** | (2006.01) |
| ***A47L 5/30*** | (2006.01) |
| ***A47L 9/19*** | (2006.01) |

(52) U.S. Cl.

CPC ..... *A47L 9/1608* (2013.01); *A47L 5/30* (2013.01); *A47L 9/1666* (2013.01); *A47L 9/1691* (2013.01); *A47L 9/19* (2013.01)

(58) Field of Classification Search

CPC ..... A47L 9/1608; A47L 9/1683; A47L 9/16; A47L 5/32; A47L 5/30; A47L 9/106; A47L 9/325; A47L 9/1691; A47L 5/12; A47L 9/0466; A47L 9/04

See application file for complete search history.

(56) References Cited

U.S. PATENT DOCUMENTS

| | | | |
|---|---|---|---|
| 5,500,979 | A | 3/1996 | Worwag |
| 5,671,499 | A | 9/1997 | Melito et al. |
| 5,699,586 | A | 12/1997 | Melito et al. |
| 5,765,258 | A | 6/1998 | Melito et al. |
| 5,909,755 | A | 6/1999 | Leal |
| 6,012,200 | A | 1/2000 | Murphy et al. |

(Continued)

FOREIGN PATENT DOCUMENTS

| | | |
|---|---|---|
| CA | 2192906 | 7/1997 |
| CA | 2192909 | 7/1997 |

(Continued)

OTHER PUBLICATIONS

International Search Report and Written Opinion, International Application No. PCT/CA2015/051331, dated Mar. 3, 2016.

*Primary Examiner* — Robert Scruggs

(74) *Attorney, Agent, or Firm* — Philip C. Mendes da Costa; Bereskin & Parr LLP/S.E.N.C.R.L., s.r.l.

(57) ABSTRACT

An all in the head surface cleaning apparatus can include a surface cleaning head having an air flow path extending from a dirty air inlet to a clean air outlet. The surface cleaning head can include a cyclone assembly comprising a cyclone chamber and a dirt collection chamber. The cyclone chamber may have a longitudinal cyclone axis, a cyclone air inlet and a cyclone air outlet. The dirt collection chamber may be moveable between an in use position and an emptying position. The surface cleaning head may include a pre-motor filter chamber and a suction motor. At least one of the pre-motor filter and a pre-motor filter chamber may be visible when the dirt collection chamber is in the emptying position. An upper portion may be mounted to the surface cleaning head between a storage position and a floor cleaning position, and may include a drive handle.

17 Claims, 61 Drawing Sheets

(56) References Cited

U.S. PATENT DOCUMENTS

| | | | |
|---|---|---|---|
| 6,221,134 | B1 | 4/2001 | Conrad |
| 6,317,920 | B1 | 11/2001 | Brickner et al. |
| 6,345,411 | B1 | 2/2002 | Kato |
| 6,363,571 | B1 | 4/2002 | Block et al. |
| 6,442,792 | B1 | 9/2002 | Sudou et al. |
| 6,817,059 | B2 | 11/2004 | Tsuchiya |
| D507,387 | S | 7/2005 | Jacobs |
| 7,013,528 | B2 | 3/2006 | Parker et al. |
| 7,222,393 | B2 | 5/2007 | Kaffenberger |
| 7,251,854 | B2 | 8/2007 | Gerth et al. |
| 7,329,294 | B2 | 2/2008 | Conrad |
| 7,996,957 | B2 | 8/2011 | Kah, Jr. |
| 8,020,251 | B2 | 9/2011 | Luebbering et al. |
| 8,268,029 | B2 | 9/2012 | Yoo |
| 9,119,511 | B2 | 9/2015 | Kah |
| 9,295,363 | B1 | 3/2016 | Conrad |
| 2002/0194700 | A1 | 12/2002 | Shaver et al. |
| 2004/0134026 | A1 | 7/2004 | Brinkhoff et al. |
| 2005/0115409 | A1 | 6/2005 | Conrad |
| 2005/0273971 | A1 | 12/2005 | Cho et al. |
| 2006/0156509 | A1 | 7/2006 | Luebbering et al. |
| 2006/0196004 | A1 | 9/2006 | Conrad |
| 2006/0288520 | A1 | 12/2006 | Oh |
| 2008/0178420 | A1 | 7/2008 | Conrad |
| 2008/0263813 | A1 | 10/2008 | Han et al. |
| 2009/0056060 | A1* | 3/2009 | Han ..... A47L 5/12 15/349 |
| 2009/0300873 | A1 | 12/2009 | Grey |
| 2010/0229337 | A1 | 9/2010 | Conrad |
| 2010/0236014 | A1* | 9/2010 | Fester ..... A47L 5/28 15/347 |
| 2011/0296648 | A1 | 12/2011 | Kah, Jr. |
| 2013/0291333 | A1 | 11/2013 | Grey |
| 2014/0013537 | A1* | 1/2014 | Kasper ..... A47L 9/16 15/353 |
| 2014/0165313 | A1 | 6/2014 | Hicke |
| 2014/0237753 | A1 | 8/2014 | Conrad |
| 2014/0245564 | A1 | 9/2014 | Conrad |
| 2015/0135474 | A1 | 5/2015 | Gidwell |

FOREIGN PATENT DOCUMENTS

| | | |
|---|---|---|
| CA | 2192883 | 12/1997 |
| CA | 2276796 | 1/2000 |
| CA | 2374961 | 11/2001 |
| CA | 2391177 | 12/2002 |
| CA | 2391180 | 12/2002 |
| CA | 2603508 | 10/2006 |
| CA | 2706562 | 5/2009 |
| CA | 2806339 | 2/2012 |
| CA | 2821234 | 6/2012 |

* cited by examiner

ALL IN THE HEAD SURFACE CLEANING APPARATUS

FIELD

The present subject matter of the teachings described herein relates generally to an all in the head type surface cleaning apparatus.

BACKGROUND

Various types of surface cleaning apparatus are known. These include upright surface cleaning apparatus, canister surface cleaning apparatus, stick surface cleaning apparatus and central vacuum systems. Typically, a surface cleaning apparatus has a surface cleaning head with an inlet. For example, an upright surface cleaning apparatus typically comprises an upright section containing at least an air treatment member that is pivotally mounted to a surface cleaning head. A canister surface cleaning apparatus typically comprises a canister body containing at least an air treatment member and a suction motor that is connected to a surface cleaning head by a flexible hose and a handle. Such designs are advantageous as they permit some of the operating components, and optionally all of the operating components (i.e., the suction motor and the air treatment members) to be placed at a location other than the surface cleaning head. This enables the surface cleaning head to be lighter and smaller. Reducing the weight of the surface cleaning head may increase its maneuverability. Also, reducing the height of the surface cleaning head enables the surface cleaning head to clean under furniture having a lower ground clearance.

Another type of surface cleaning apparatus is the all in the head surface cleaning apparatus. An all in the head surface cleaning apparatus typically has the suction motor and the air treatment members (e.g., one or more cyclones) to be positioned in the surface cleaning head. However, for various reasons, the all in the head vacuum cleaner has not been widely accepted by consumers.

U.S. Pat. Nos. 5,699,586; 6,012,200; 6,442,792; 7,013,528; US 2004/0134026; US 2006/0156509; and, US 2009/0056060 disclose an all in the head vacuum cleaner wherein the surface cleaning head is wedge shaped (i.e., the height of the surface cleaning head increases from the front end to the rear end). Accordingly, the height at the rear end limits the extent to which the surface cleaning head may travel under furniture. If the height is too tall, then only the front portion of the surface cleaning head may be able to be placed under furniture, thereby limiting the ability of the surface cleaning apparatus to clean under furniture.

U.S. Pat. No. 5,909,755 discloses an all in the head vacuum cleaner. However, this design has limited filtration ability. As set out in the abstract, the design uses a suction motor to draw in air having entrained particulate matter through a filter to thereby treat the air. Accordingly, while the design is not wedge shaped, it relies upon a filter to treat the air.

SUMMARY

This summary is intended to introduce the reader to the more detailed description that follows and not to limit or define any claimed or as yet unclaimed invention. One or more inventions may reside in any combination or subcombination of the elements or process steps disclosed in any part of this document including its claims and figures.

In accordance with one aspect of this disclosure, an all in the head surface cleaning apparatus is provided with wherein at least one of a pre-motor filter and a pre-motor filter chamber is visible when a dirt collection chamber is in the emptying position. For example, the pre-motor filter chamber may be provided as part of a cyclone bin assembly. Accordingly, when the cyclone bin assembly is removed from the all in the head surface cleaning apparatus, the pre-motor filter and/or the pre-motor filter chamber may be visible. Alternately, or in addition, a pre-motor filter and/or a pre-motor filter chamber may be visible in the all in the head surface cleaning apparatus when the cyclone bin assembly is removed for emptying. Accordingly the all in the head surface cleaning apparatus does not require a separate access cover to enable a user to remove a pre-motor filter for cleaning or replacement. This is advantageous in an all in the head surface cleaning apparatus which has a small footprint to enable the all in the head surface cleaning apparatus to clean under furniture having a low ground clearance.

In accordance with this aspect of the teachings described herein, that can be used in combination with any other aspect, there is provided an all in the head surface cleaning apparatus comprising a surface cleaning head having a front end, a rear end, first and second laterally opposed sidewalls and an air flow path extending from a dirty air inlet to a clean air outlet. The surface cleaning head can include a cyclone assembly comprising a cyclone chamber and a dirt collection chamber. The cyclone chamber may have a longitudinal cyclone axis, a cyclone air inlet and a cyclone air outlet. The dirt collection chamber may be moveable between an in use position and an emptying position. The surface cleaning head may include a pre-motor filter chamber and a suction motor. At least one of the pre-motor filter and a pre-motor filter chamber may be visible when the dirt collection chamber is in the emptying position. An upper portion may be mounted to the surface cleaning head between a storage position and a floor cleaning position, and may include a drive handle.

The at least one of the pre-motor filter and the pre-motor filter chamber may be revealed when the dirt collection chamber is moved to the emptying position.

The pre-motor filter may be positioned in the pre-motor filter chamber and the pre-motor filter chamber may be moveable with the dirt collection chamber.

The pre-motor filter may be moveable as a closed chamber.

The cyclone assembly may be removable as a closed unit other than air inlet and air outlet ports and the dirt collection chamber is removed with the cyclone assembly.

The pre-motor filter chamber may be integrally formed as part of the cyclone assembly.

The pre-motor filter chamber may be located at an air outlet end of the cyclone assembly.

The pre-motor filter chamber may have an air inlet and an air outlet. The pre-motor filter may have an upstream face, a downstream face and a pre-motor filter axis that is generally parallel to the upstream and/or downstream face and is generally transverse to the cyclone axis.

The pre-motor filter chamber may have an air inlet and an air outlet. The suction motor may have an air inlet end wherein a direction of flow through the pre-motor filter chamber air outlet is generally parallel with the suction motor housing air inlet when the dirt collection chamber is in the in use position.

The pre-motor filter chamber may have an air inlet and an air outlet. The suction motor may be provided in a suction motor housing having an air inlet and the pre-motor filter chamber air outlet may abut the suction motor housing air inlet when the dirt collection chamber is in the in use position and may be spaced therefrom when the dirt collection chamber is in the emptying position.

The apparatus may include a brush motor drivingly connected to a moveable brushing member.

The dirt collection chamber may include a portion of the cyclone chamber.

The dirt collection chamber may be exterior to the cyclone chamber.

The pre-motor filter may be positioned in the pre-motor filter chamber and may have an air inlet and an air outlet. The pre-motor chamber air outlet may face an air inlet of the suction motor.

The suction motor may have a suction motor axis that is generally parallel to the cyclone axis and an upstream face of the pre-motor filter may be generally transverse to the cyclone axis.

The pre-motor filter may be positioned in the pre-motor filter chamber and the pre-motor filter chamber may have an air inlet and an air outlet. The pre-motor chamber air inlet may face an air outlet of the cyclone chamber. The pre-motor filter chamber air inlet may abuts the cyclone chamber air outlet when the dirt collection chamber is in the in use position and may be spaced therefrom when the dirt collection chamber is in the emptying position.

The upper portion may include a first end coupled to the surface cleaning head and a second end spaced apart from the first end and wherein the drive handle is disposed toward the second end.

The apparatus may include a mounting hub extending from the rear side of the surface cleaning head. The upper portion may be moveably mounted to the mounting hub and may be rotatably connected to the mounting hub whereby the upper portion is rotatable about a rotation axis relative to the surface cleaning head.

In accordance with another aspect of this disclosure, an all in the head surface cleaning apparatus is provided which incorporates cyclonic air treatment in a compact format. Accordingly, the surface cleaning head may have a height which permits the entire surface cleaning head to extend under furniture. For example, the maximum height of the surface cleaning head may be less than 8 inches, less than 6 inches, less than 5 inches or less than 4.5 inches. At the same time, the surface cleaning head may employ cyclonic air treatment technology and achieve a degree of air treatment comparable to that of leading upright cyclonic vacuum cleaners. Further, the surface cleaning head may have a dirt storage capacity that enables the surface cleaning apparatus to be used to clean an entire residence without a dirt collection chamber having to be emptied. For example, the dirt collection chamber may have a dirt storage capacity of 20, 40, 60 or 80 $in^2$.

Optionally, if the portable surface cleaning unit includes a cyclone bin assembly, then the cyclone bin assembly may be removably mounted to the surface cleaning apparatus. An advantage of this design is that the user need not carry the surface cleaning apparatus to a garbage bin or the like to empty the cyclone bin assembly.

Optionally, the cyclone bin assembly may include a cyclone chamber, a dirt collection chamber external the cyclone chamber and a pre-motor filter chamber housing a pre-motor filter. An advantage of this design is that that pre-motor filter, and its surrounding chamber, can be removed from the surface cleaning apparatus with the cyclone chamber and dirt collection bin for emptying.

DRAWINGS

The drawings included herewith are for illustrating various examples of articles, methods, and apparatuses of the teaching of the present specification and are not intended to limit the scope of what is taught in any way.

Figure 46:
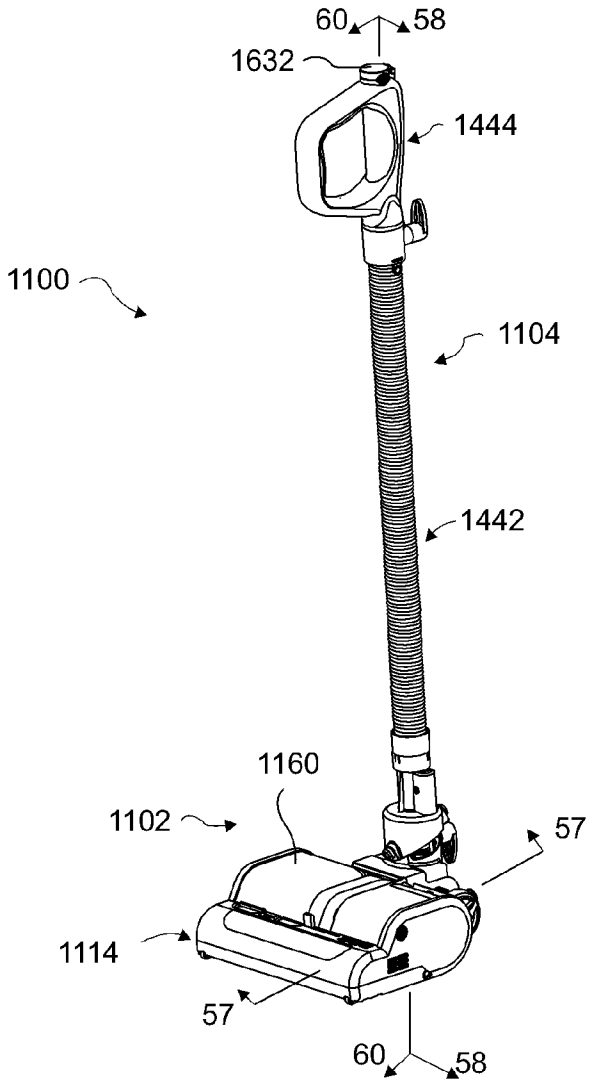
FIG. 46 is a front perspective view of another example of an all in the head type surface cleaning apparatus.
Figure 53:
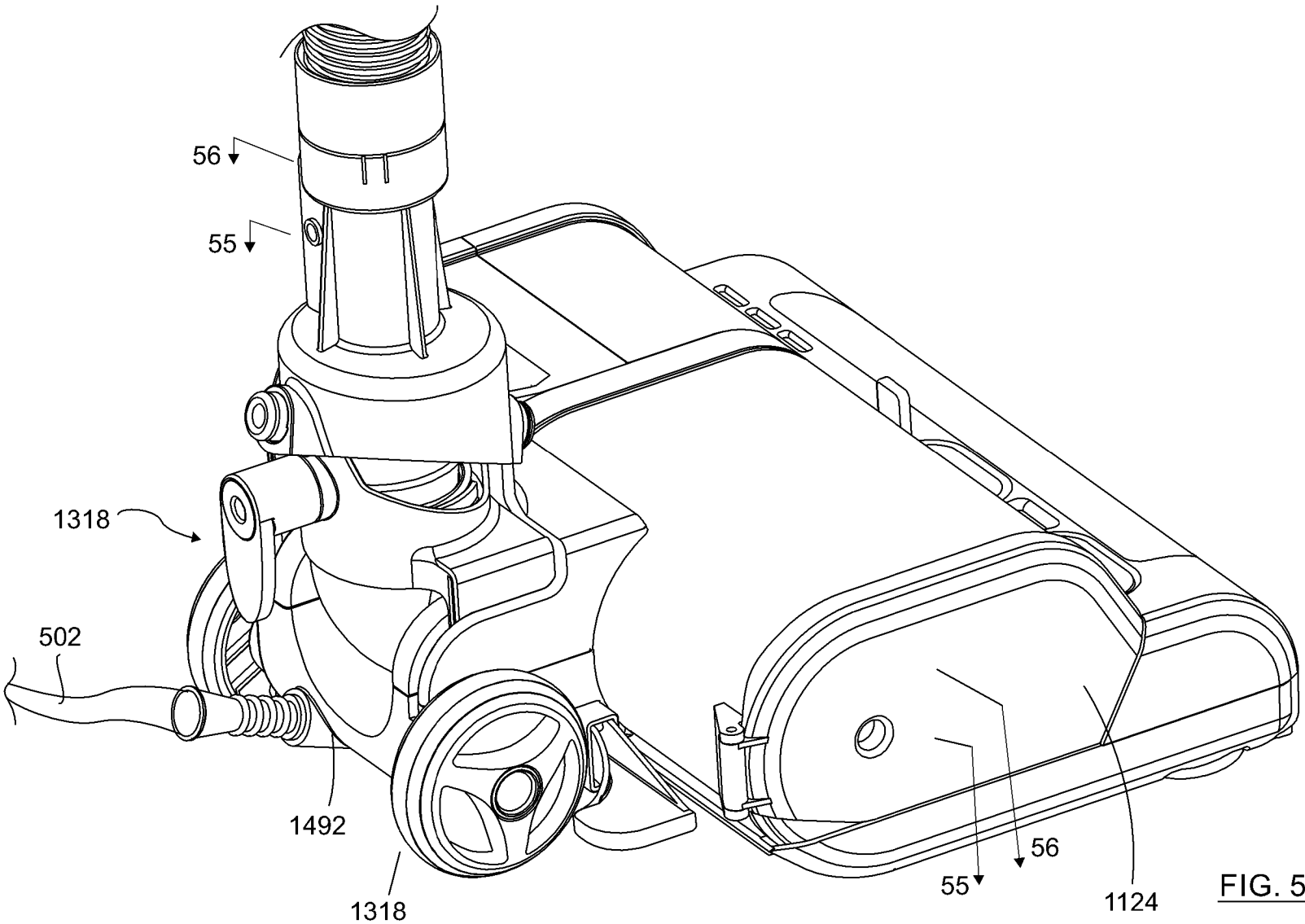
FIG. 53 is a side perspective view of the surface cleaning head of FIG. 46.
Figure 54A:
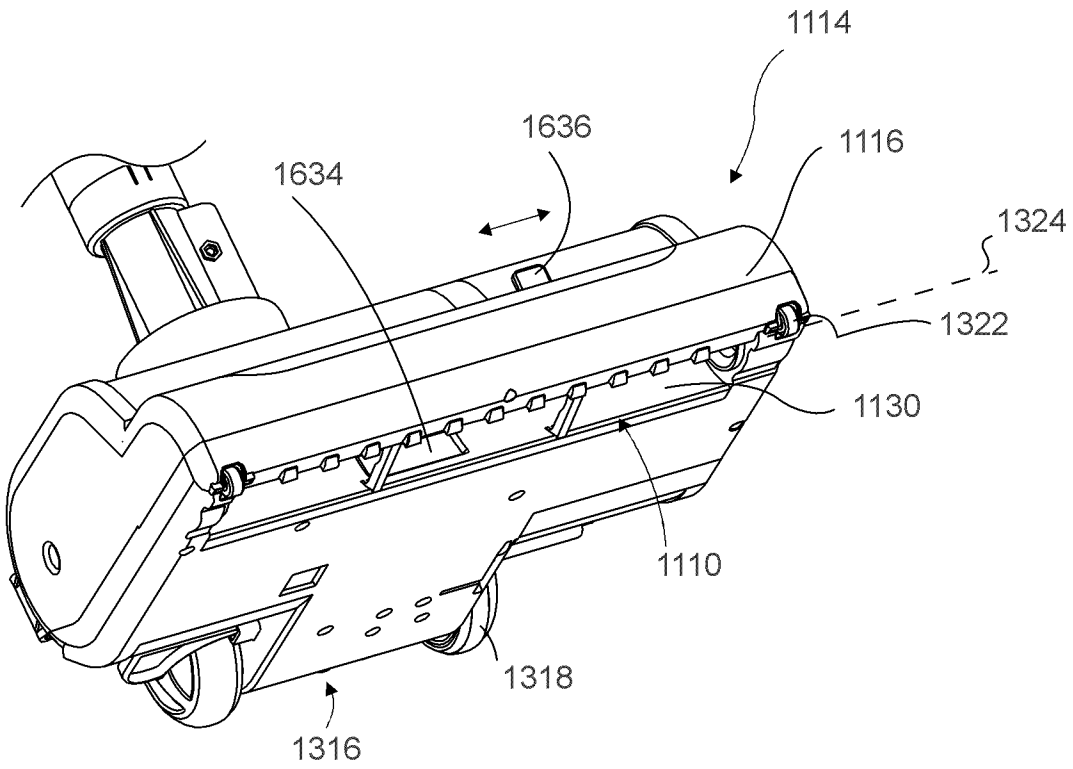
FIG. 54A is a bottom perspective view of the surface cleaning head of FIG. 46 with a blocker in a deployed position.
Figure 54B:
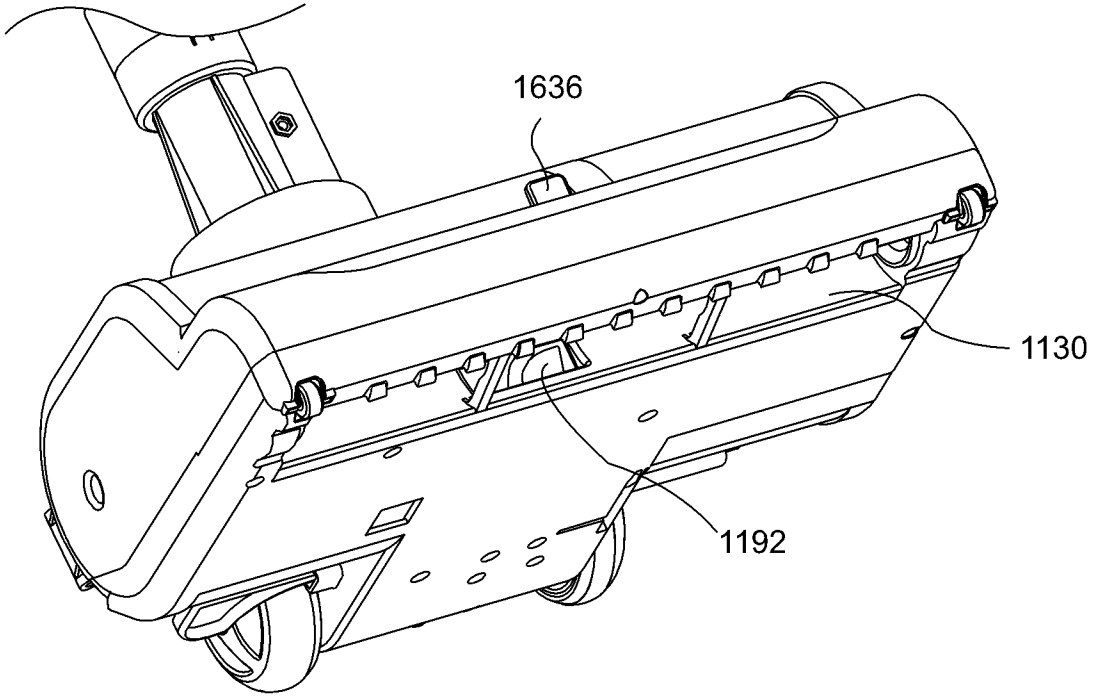
Figure 55:
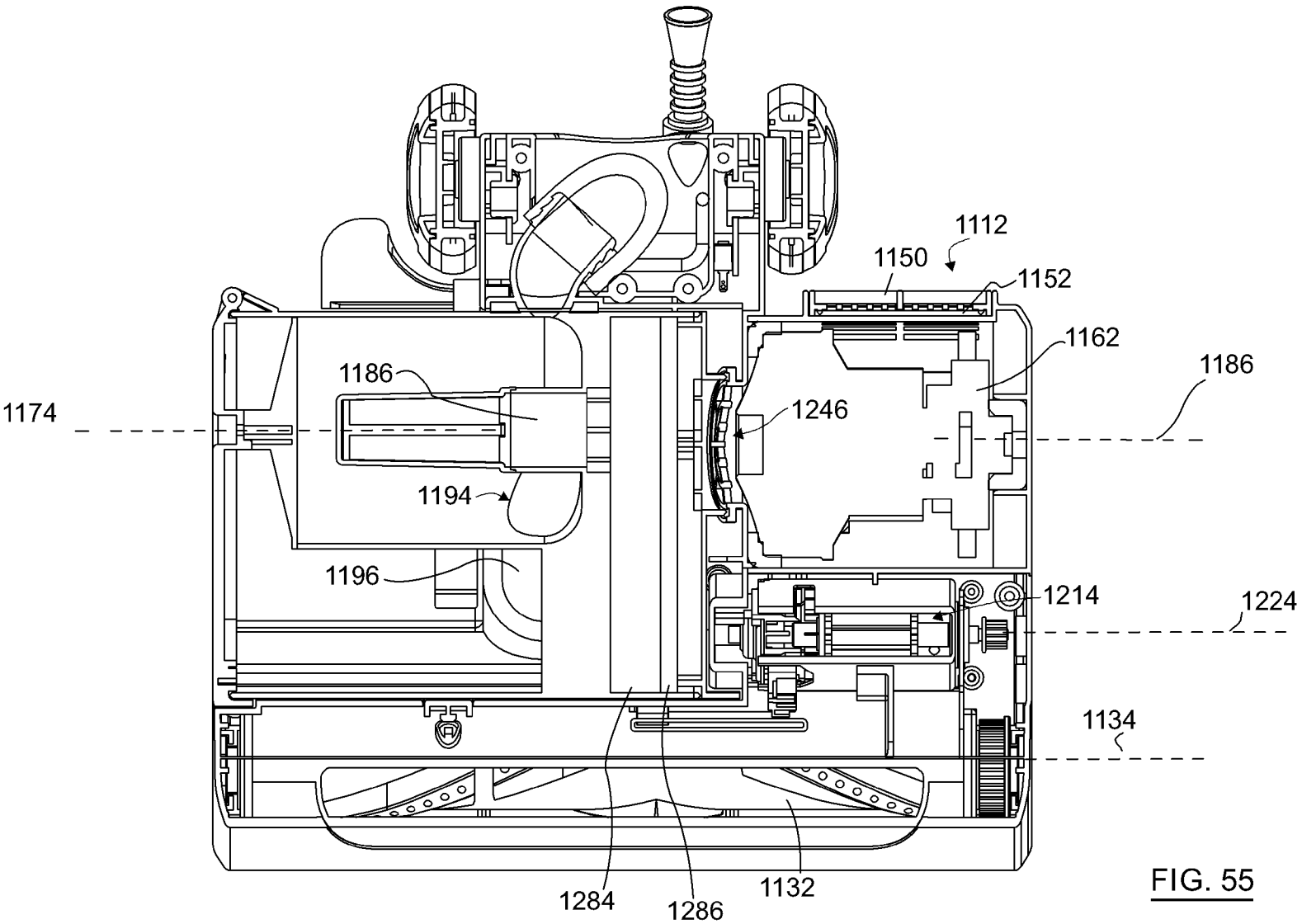
Figure 56:
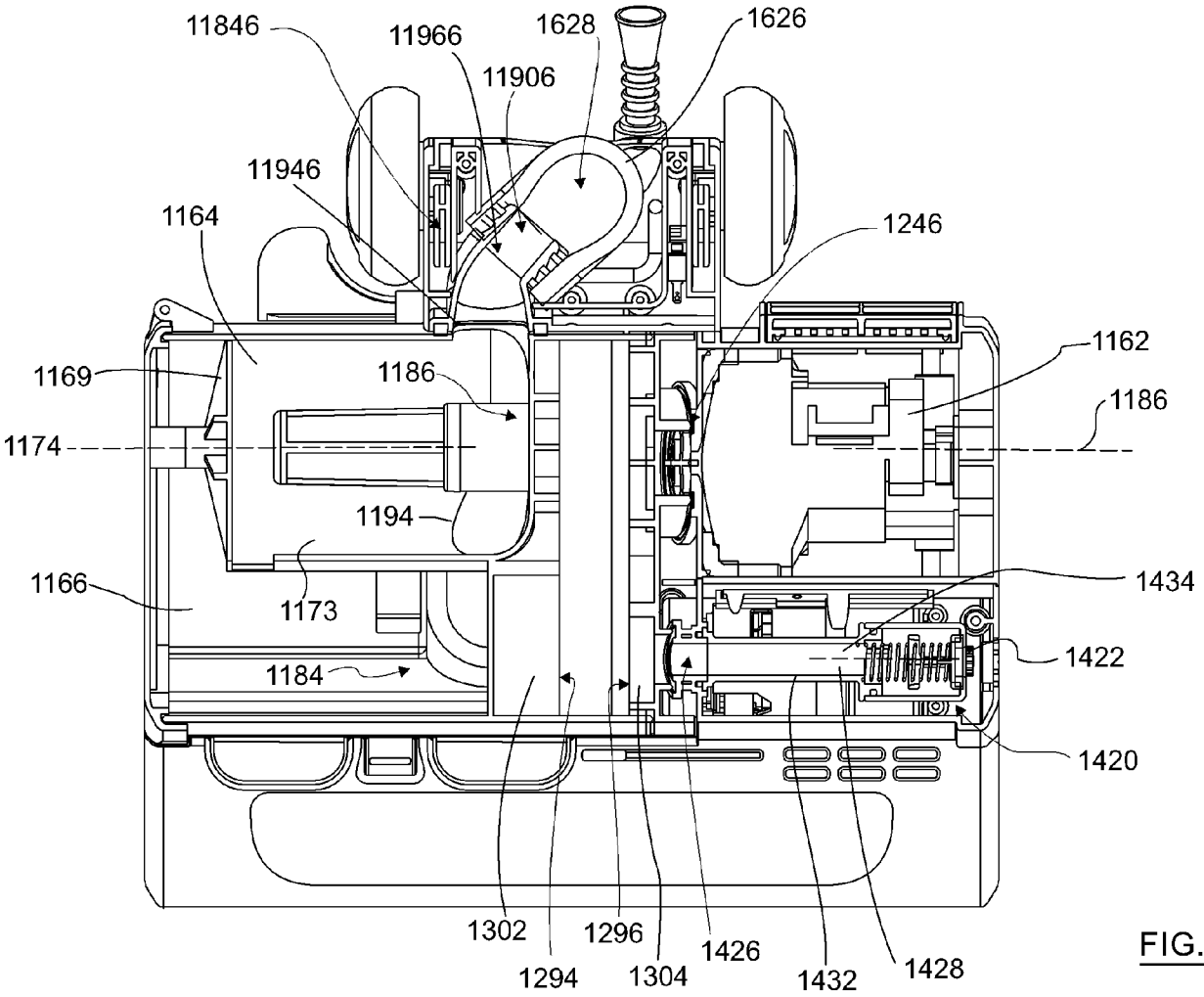
Figure 57:
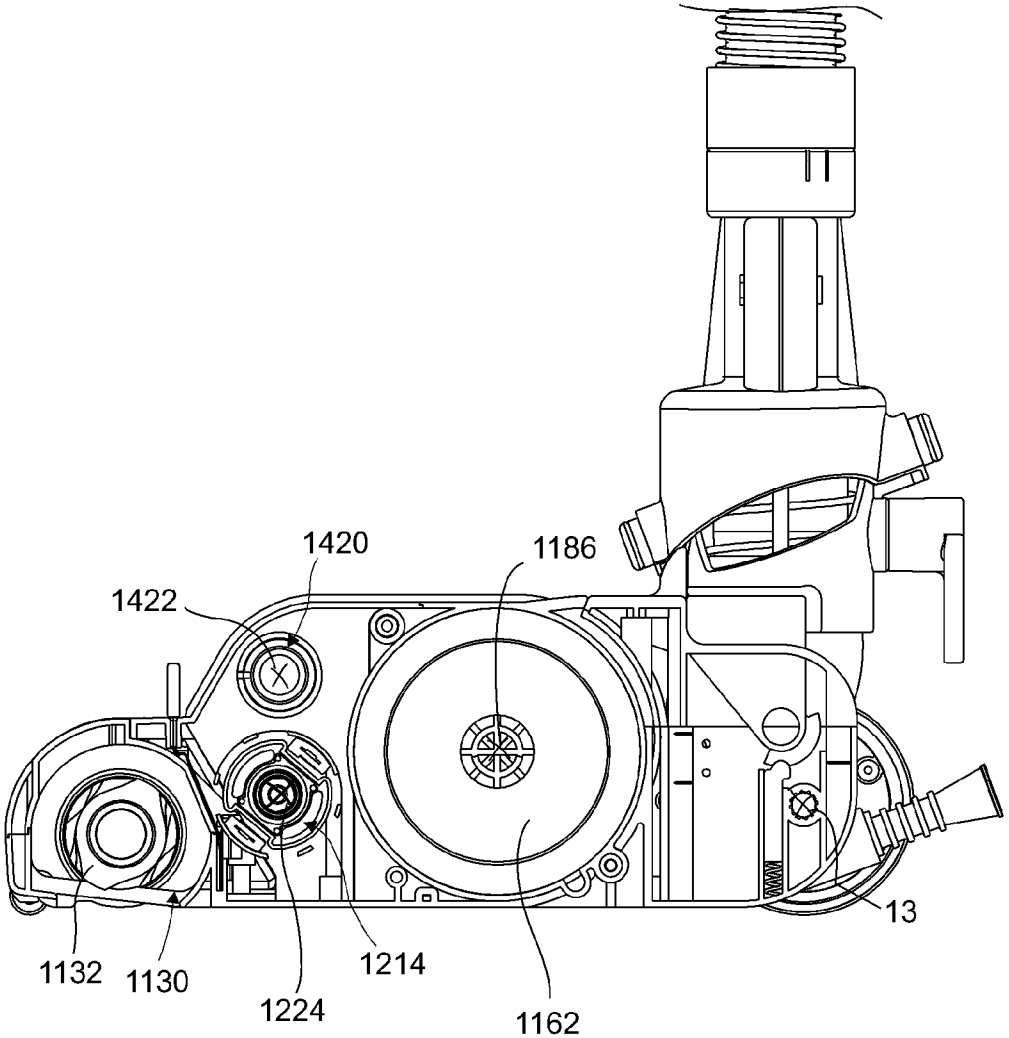
Figure 58:
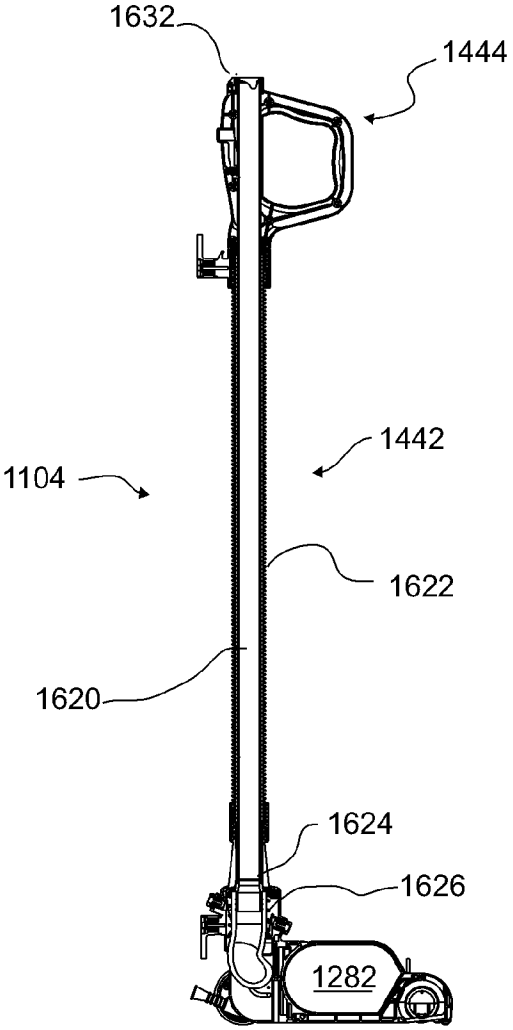
Figure 59:
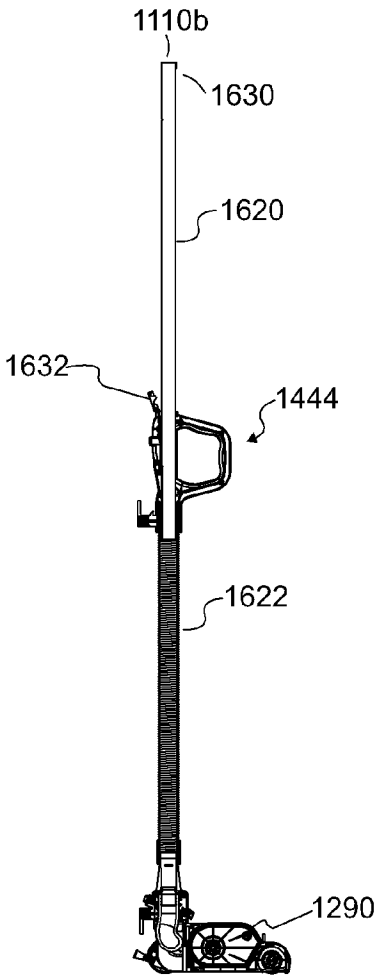
Figure 60:
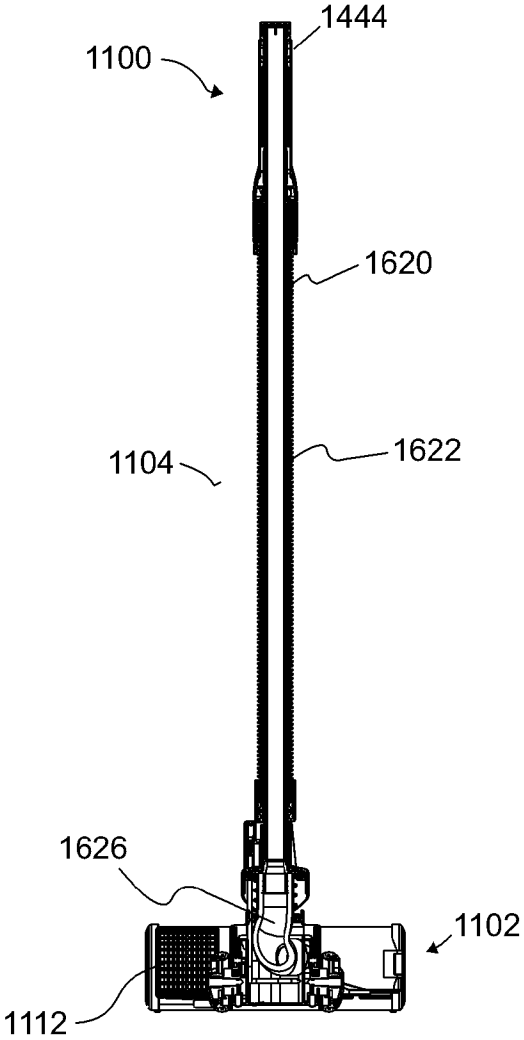

FIG. 54B the a bottom perspective view of the surface cleaning head of FIG. 54A with the blocker in a retracted position FIG. 55 is a cross-sectional view of the surface cleaning head of FIG. 46, taken along line 55-55, which is shown in FIG. 53;

FIG. 56 is a cross-sectional view of the surface cleaning head of FIG. 46, taken along line 56-56, which is shown in FIG. 53;

FIG. 57 is a cross-sectional view of the surface cleaning head of FIG. 46, taken along line 57-57, which is shown in FIG. 46;

FIG. 58 is a cross-sectional view of the surface cleaning apparatus of FIG. 46, taken along line 58-58, which is shown in FIG. 46;

FIG. 59 is the cross-sectional view of the surface cleaning apparatus of FIG. 58, with a wand extended and a pre-motor filter removed; and FIG. 60 is a cross-sectional view of the surface cleaning apparatus of FIG. 46, taken along line 60-60, which is shown in FIG. 46.

DETAILED DESCRIPTION

Various apparatuses or processes will be described below to provide an example of an embodiment of each claimed invention. No embodiment described below limits any claimed invention and any claimed invention may cover processes or apparatuses that differ from those described below. The claimed inventions are not limited to apparatuses or processes having all of the features of any one apparatus or process described below or to features common to multiple or all of the apparatuses described below. It is possible that an apparatus or process described below is not an embodiment of any claimed invention. Any invention disclosed in an apparatus or process described below that is not claimed in this document may be the subject matter of another protective instrument, for example, a continuing patent application, and the applicants, inventors or owners do not intend to abandon, disclaim or dedicate to the public any such invention by its disclosure in this document.

As exemplified herein, the surface cleaning apparatus is an all in the head vacuum cleaner. It will be appreciated that, in some embodiments, aspects disclosed herein may be used in other surface cleaning apparatus such as extractors or in surface cleaning heads of other vacuum cleaners, such as an upright vacuum cleaner or a canister vacuum cleaner.

General Description of an All in the Head Vacuum Cleaner

Referring to FIGS. 1-8, an embodiment of a surface cleaning apparatus is shown. The surface cleaning apparatus includes a surface cleaning head 102 and an upper portion 104 that is movably and drivingly connected to the surface cleaning head 102. The surface cleaning head 102 may be supported by any suitable support members, such as, for example wheels and/or rollers, to allow the surface cleaning head to be moved across the floor or other surface being cleaned. The support members (e.g., wheels) may be of any suitable configuration, and may be attached to any suitable part of the surface cleaning apparatus, including, for example, the surface cleaning head and upper portion.

The surface cleaning apparatus 100 preferably includes a dirty air inlet 110 (see FIG. 8), a clean air outlet 112 (see FIG. 7) and an air flow path or passage extending therebetween. Preferably, at least one suction motor and at least one air treatment member are provided in the air flow path. The air treatment member may be any suitable air treatment member, including, for example, one or more cyclones (arranged in series or in parallel with each other), filters, bags and other dirt separation devices. Preferably, the at least one air treatment member is provided upstream from the suction motor, but alternatively may be provided downstream from the suction motor or both upstream and downstream from the suction motor. In addition to the at least one air treatment member, the surface cleaning apparatus may also include one or more pre-motor filters (preferably positioned in the air flow path between the air treatment member and the suction motor) and/or one or more post-motor filters (positioned in the air flow path between the suction motor and the clean air outlet).

Upper portion 104 may be of any design known in the art that is drivingly connected to surface cleaning head 102 so as to permit a user to move surface cleaning head 102 across a surface to be cleaned (such as a floor). Upper portion 104 may be moveably (e.g., pivotally) connected to surface cleaning head for movement between an upright storage position as exemplified in FIG. 1 and an inclined in use position as exemplified in FIG. 3. If upper portion 104 is moveably connected to surface cleaning head 102 abut only one axis or rotation (e.g., a horizontal axis), then upper portion 104 may be used to move surface cleaning head 102 in a generally forward/backward direction of travel, indicated by arrow 106. A direction generally orthogonal to the direction of travel, indicated by arrow 108 defines a lateral or transverse direction. In some embodiments, upper portion 104 may be rotatable connected to surface cleaning head 102, such as by a swivel connection, so as to enable a user to steer the surface cleaning head using the upper section.

Upper section may comprise a hand grip portion 444 and a handle or drive shaft 442. Drive shaft 442 may be telescopic and/or it may be useable as an above floor cleaning wand and/or it may provide electrical cord storage and/or auxiliary cleaning tool storage and/or it may be used to hang the surface cleaning apparatus on a wall when not in use In the embodiment illustrated, the surface cleaning apparatus 100 is an all in the head type vacuum cleaner in which the functional or operational components for the transport and treatment of fluid (e.g., air) entering the dirty air inlet of the vacuum cleaner (such as, for example, the suction motor, air treatment member, filters, motors, etc.) are all contained within the surface cleaning head 102 portion of surface cleaning apparatus 100. Providing the functional air flow components within the surface cleaning head may help reduce the size and/or weight of the upper portion. Providing the functional components within the surface cleaning head may also help lower the centre of gravity of the surface cleaning apparatus. Accordingly, the hand weight experienced by a user operating surface cleaning apparatus 100 is reduced.

In some embodiments, the surface cleaning head may also be configured to accommodate functional components that do not form part of the air flow path, such as, for example, brush motors, brushes, on board energy storage systems, controllers and other components.

Alternatively, while being free from air flow components, the upper section may include some components, such as, for example, height adjustment mechanisms, electrical cord connections, electrical cord storage members, handle, actuators, steering components and other functional, on board energy storage systems, but non-airflow related components of the surface cleaning apparatus.

Figure 8:
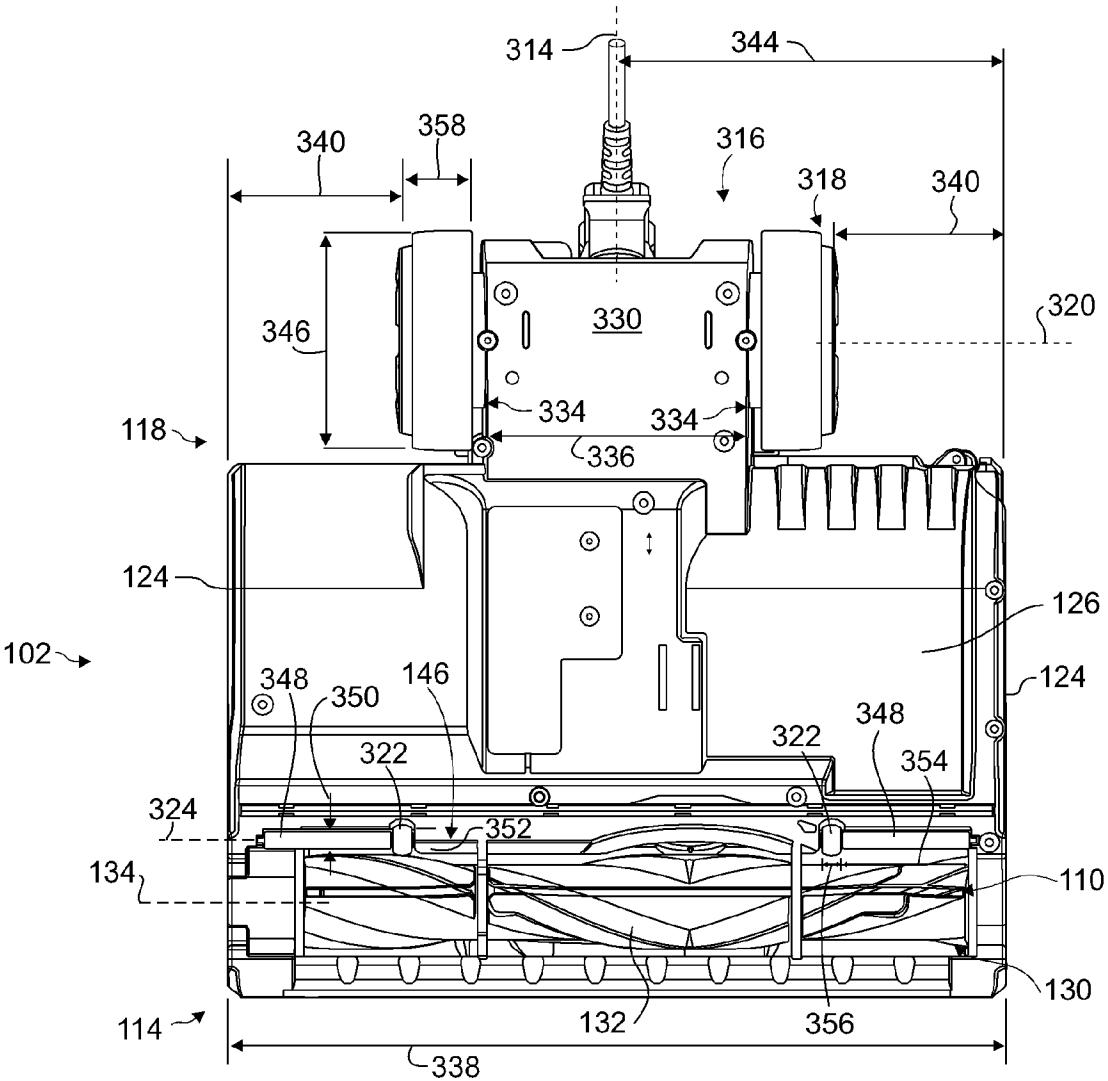
FIG. 8 is bottom view of the surface cleaning apparatus of FIG. 1.
Figure 9:
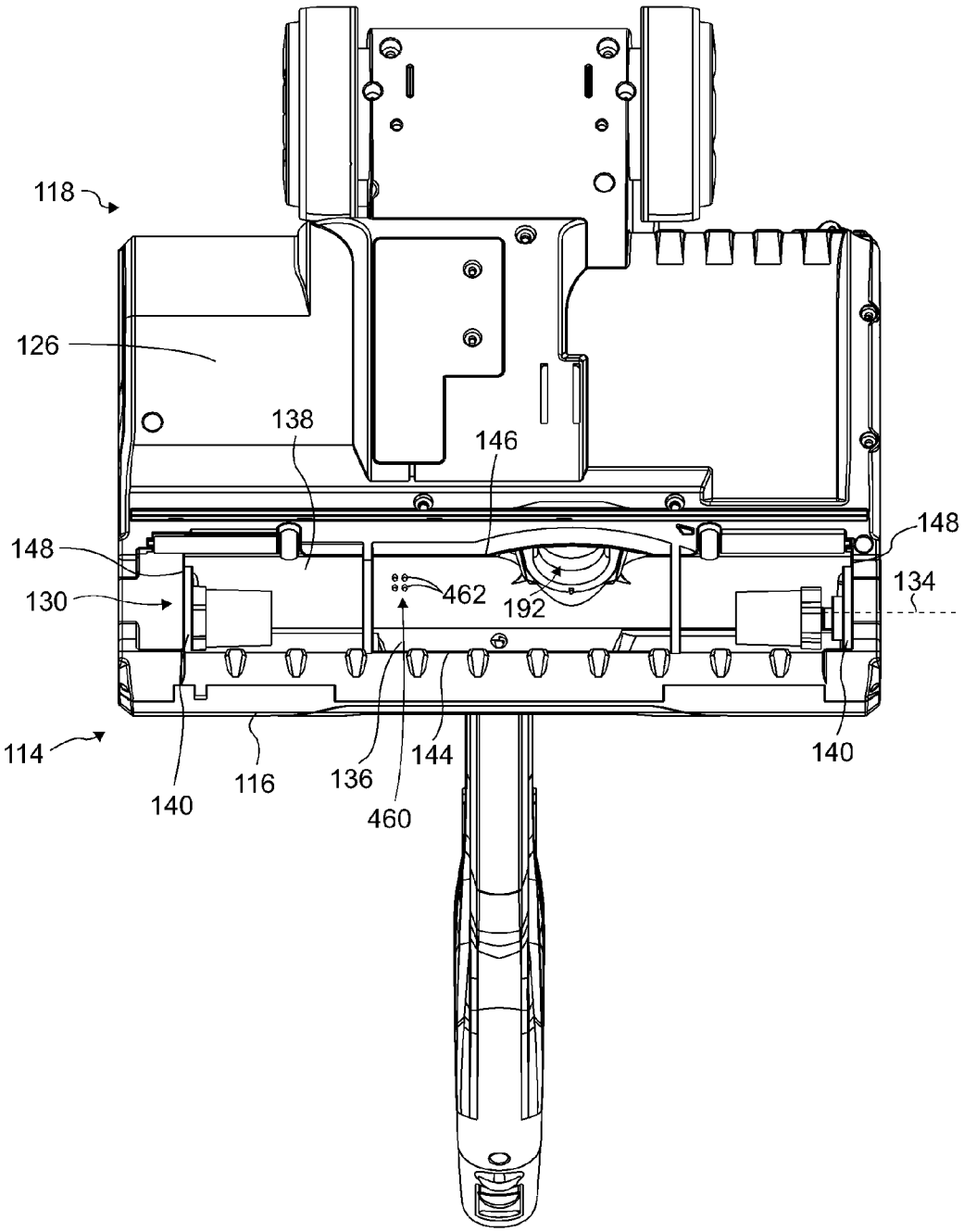
FIG. 9 is bottom view of the surface cleaning apparatus of FIG. 1 with a rotating brush removed.
Figure 10:
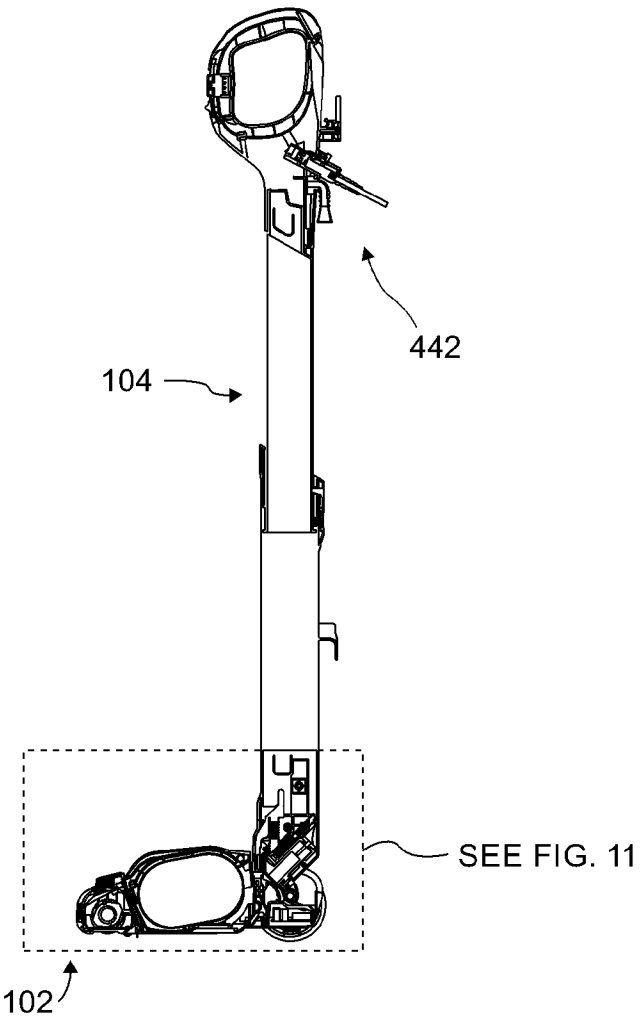
FIG. 10 is cross-sectional view of the surface cleaning apparatus of FIG. 1, taken along line 10-10.
Figure 13:
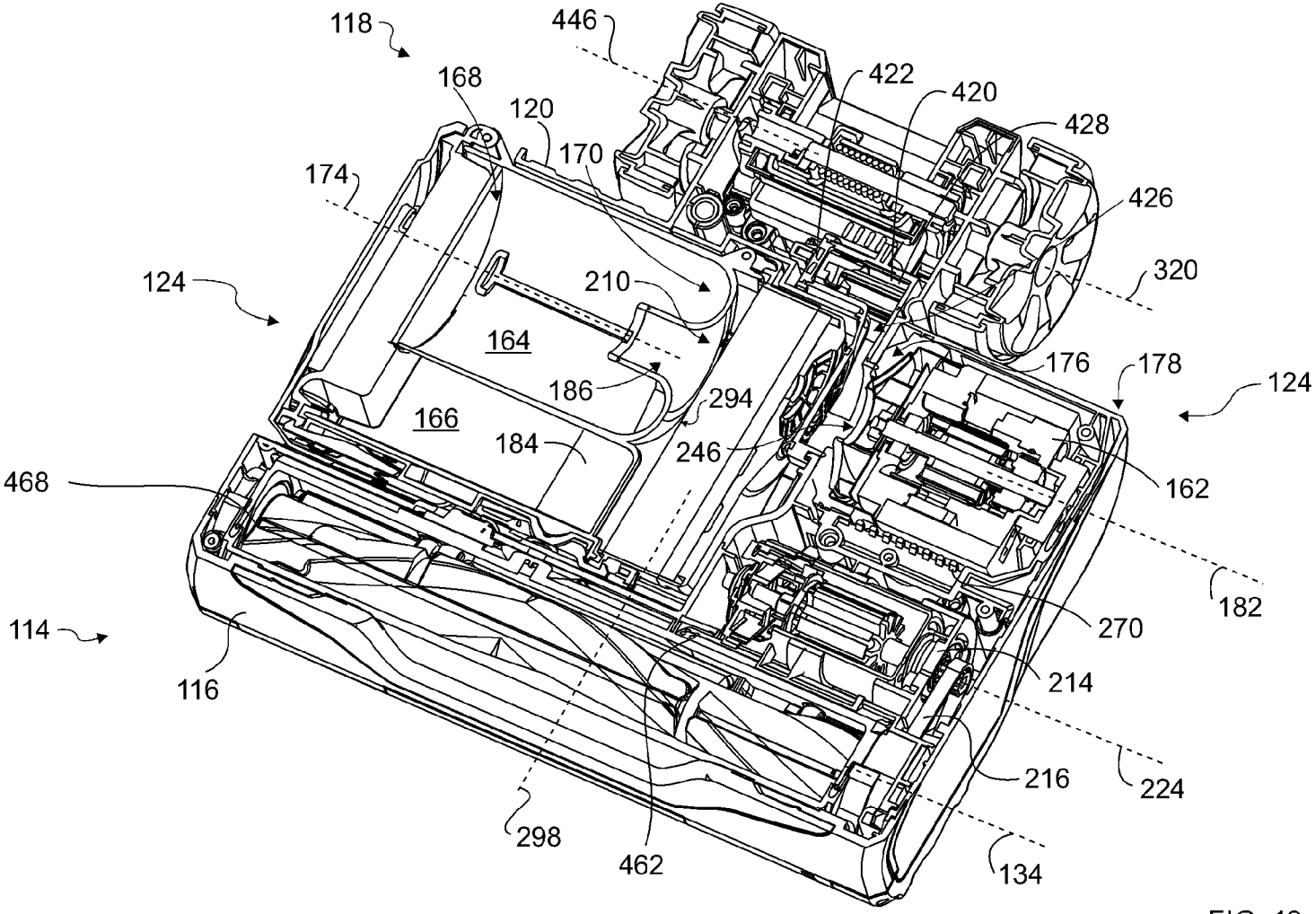
FIG. 13 is cross-sectional view of the surface cleaning apparatus of FIG. 1, taken along line 13-13, which is shown in FIG. 4.

Referring to FIG. 13, in the illustrated example, the surface cleaning head includes a front end 114 having a front face 116, a rear end 118 spaced rearwardly from the front end and having a rear face 120 and a pair of side faces 124 that are laterally spaced apart from each other and extend from the front face 116 to the rear face 120. Referring to FIGS. 8 and 9, the surface cleaning head 102 also has a bottom face 126 that is extends between the front end 114, rear end 118 and side faces 124. The bottom face 126 is positioned to face the surface being cleaned when the surface cleaning apparatus 100 is in use.

Figure 7:
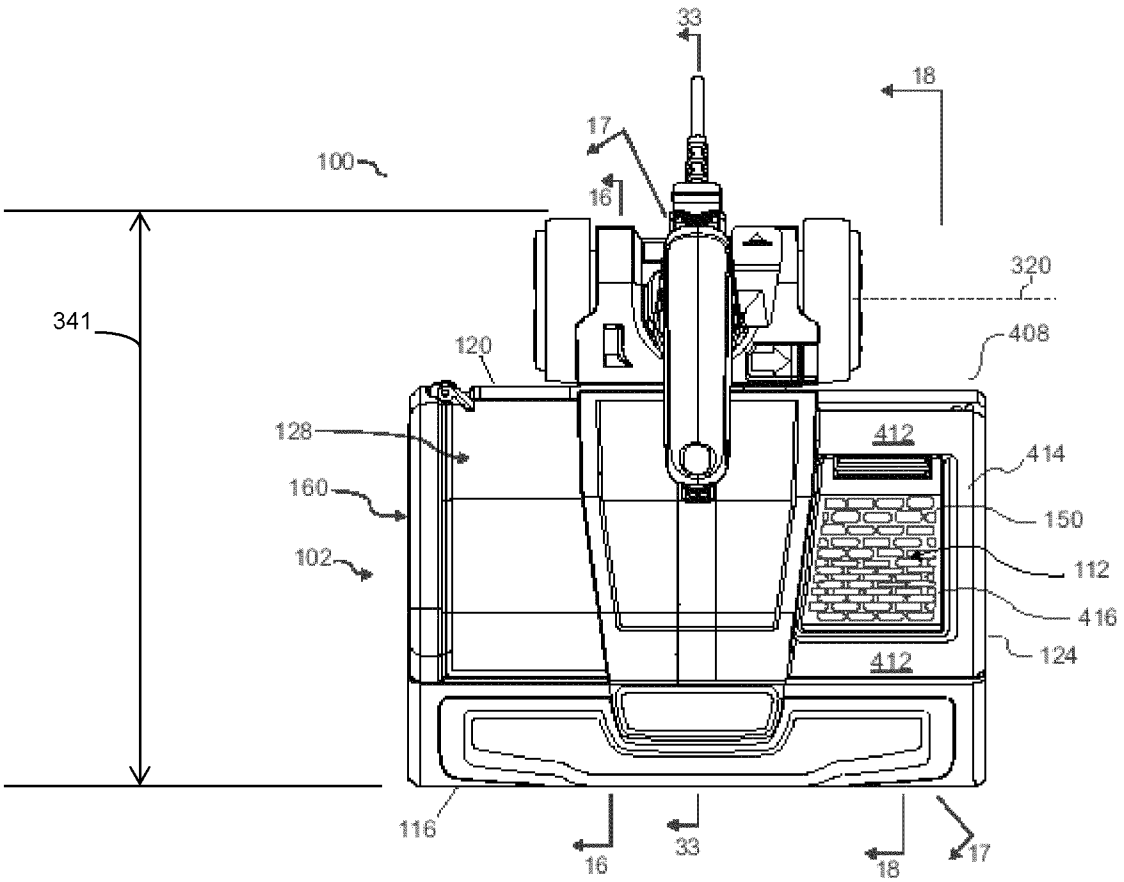
FIG. 7 is a top view of the surface cleaning apparatus of FIG. 1.

Referring to FIG. 7, a top face 128 generally is spaced apart from and overlies the bottom face 126 (FIG. 8). Together, the front face 116, rear face 120, side faces 124, bottom face 126 and top face 128 co-operate to bound an interior of the surface cleaning head 102, which, in the illustrated example, is configured to house the functional components of the air flow path of the surface cleaning apparatus. Preferably, in an all in the head type vacuum cleaner, the surface cleaning head includes the dirty air inlet 110 and the clean air outlet 112. The surface cleaning apparatus 100 has an overall depth 341, measured in the forward/backward direction. The overall depth 341 may be any suitable depth that is sufficient to accommodate the components of the surface cleaning apparatus, and may be less than about 20 inches, less than about 15 inches, less than about 10 inches, less than about 9 inches, less than about 8.5 inches, and optionally less than about 8 inches.

In the exemplified embodiment, surface cleaning head 102 has a generally rectangular footprint when viewed from above. It will be appreciated that front, rear and sides faces need not extend linearly and that surface cleaning head may be of various shapes.

As exemplified in FIGS. 8 and 9, the surface cleaning head 102 may include a brush chamber 130 that is configured to house a rotatable agitator brush 132. The brush 132 is shown within the brush chamber 130 in FIG. 8, and the brush chamber 130 is illustrated with the brush 132 removed in FIG. 9. The rotatable brush 132 may be rotatable about a brush axis 134 that may be generally orthogonal to the direction of travel 106 of the surface cleaning head 102. Alternately, or in addition, it will be appreciated that any other agitation or cleaning member known in the art may be used in place of, or in addition to, rotatable brush 132. Further, rotatable brush 132 may be any rotatable brush known in the art and may be driven by any drive means known in the art, such as a fan belt, direct drive, providing the brush motor internal of rotatable brush 132, an air driven turbine or the like.

Figure 17:
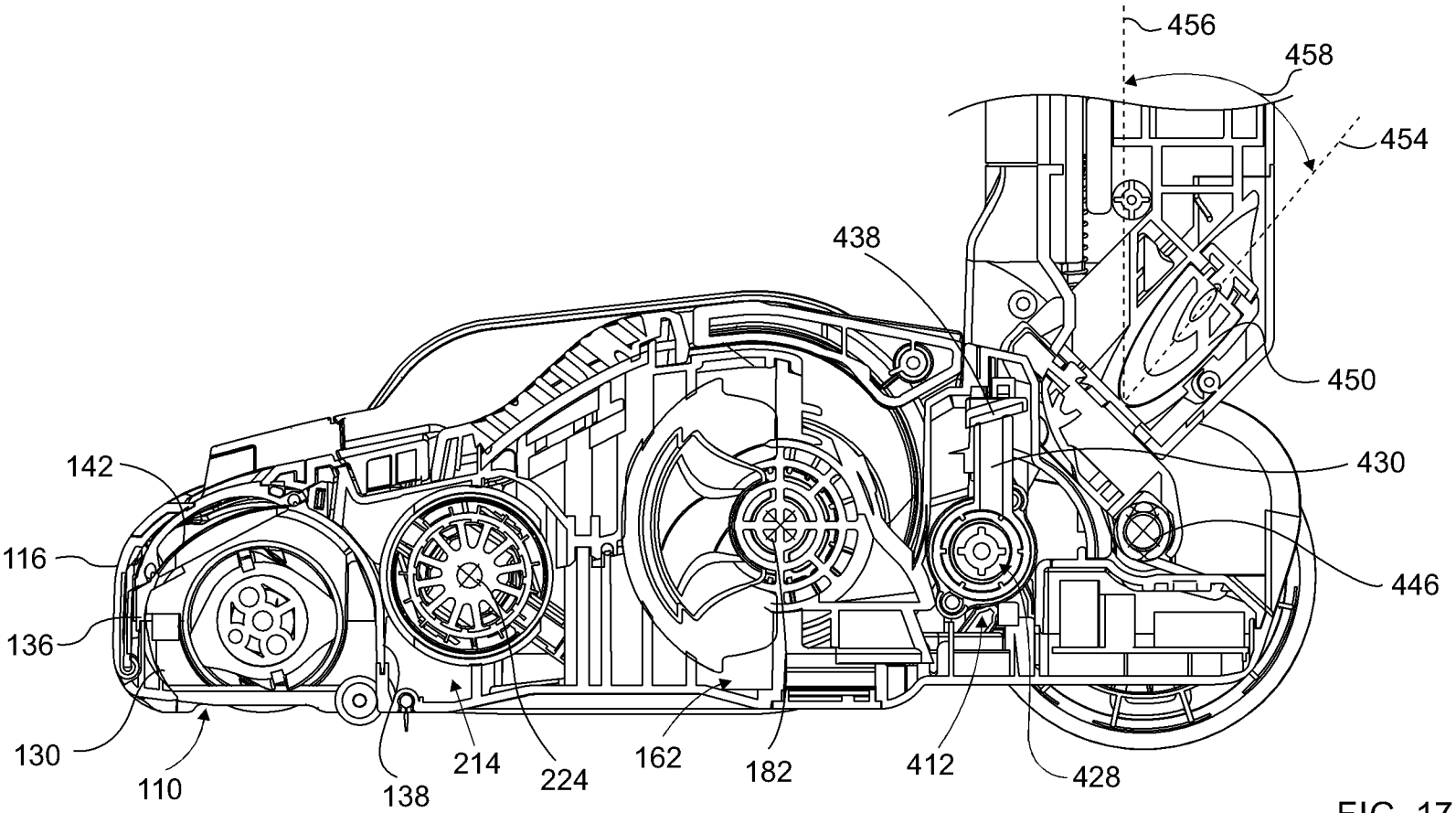
FIG. 17 is cross-sectional view of the surface cleaning apparatus of FIG. 1, taken along line 17-17, which is shown in FIG. 7.

As exemplified in the cross-sectional view of FIG. 17, the brush chamber 130 may include a front wall 136, a rear wall 138, two sidewalls 140 (FIG. 9) and a top wall 142. The brush chamber 130 may be located at the front 114 of the surface cleaning head 102, and, as in the illustrated embodiment, an outer surface of the front wall 136 of the brush chamber 130 may form at least a portion of the front face 116 of the surface cleaning head 102.

As exemplified, the bottom side of the brush chamber 130 is at least partially open and forms the dirty air inlet 110 of the surface cleaning apparatus 102. The open, bottom side of the brush chamber 130 is, in the example illustrated, bounded by a front edge 144, a rear edge 146 spaced behind the front edge 144, and a pair of side edges 148 extending therebetween. In the illustrated example the open bottom side of the brush chamber 130 is generally rectangular in shape, but alternatively could be configured in other shapes.

As exemplified, the brush chamber 130 may extend from the bottom face 126 to the top face 128 of the surface cleaning head 102, so that an outer surface of the top wall 142 of the brush chamber 130 forms part of the top face 128 of the surface cleaning head 102, and the open, bottom side of the brush chamber 130 forms part of the bottom face 126 of the surface cleaning head 102.

Figure 19:
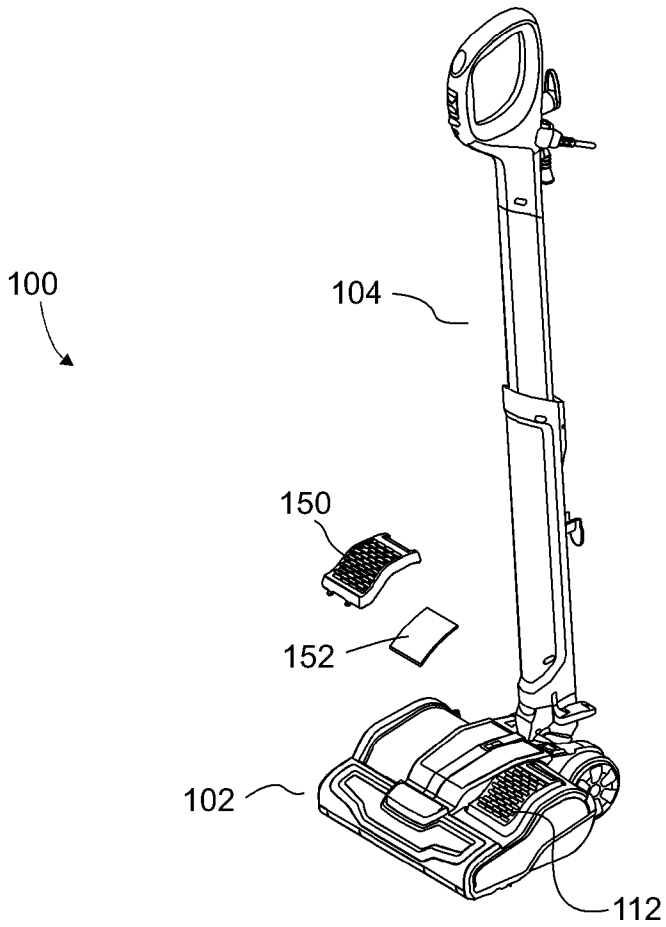
FIG. 19 is a partially exploded view of the surface cleaning apparatus of FIG. 1.

As exemplified in FIG. 7, the clean air outlet 112 may be provided on the upward facing, top face 128 of the surface cleaning head 102 and may be covered by a grill 150. Preferably, the grill 150 is removable (as shown in FIG. 19) to allow access to the clean air outlet 112. An advantage of this design is that treated air is directed away from the surface to be cleaned and away from a user (who is standing behind upper portion 104). Alternately clean air outlet 112 may direct treated air rearwardly.

Optionally a post-motor filter 152 may be provided upstream of the suction motor, such as at the clear air outlet 112, to filter air that has passed through the air treatment member and suction motor. As exemplified in FIG. 19, the filter 152 may be provided as a generally planar post-motor filter 152 made from foam and/or felt that is positioned beneath the grill 150. Removing the grill 150 provides access to the post-motor filter 152 for inspection and/or replacement. Optionally, instead of, or in addition to the felt filter 152, the post-motor filter may include one or more other filters or filtering media, including, for example, a HEPA filter, an electrostatic filter, a cyclonic post-motor filter or other suitable filter.

It will be appreciated that the forgoing is a general description of an all in the head vacuum cleaner. It will be appreciated that the actual size and shape of the surface cleaning head may depend upon which of the following aspects are included in the product design.

Removable Dirt Collection Chamber

The following is a description of a removable dirt collection chamber that may be used by itself in any surface cleaning apparatus or in any combination or sub-combination with any other feature or features disclosed herein. Optionally, the dirt collection chamber is removable as a sealed unit for emptying. An advantage of this design is that collected dirt will be contained within the dirt collection chamber as the dirt collection chamber is transported to a location, such as a garbage can, for emptying. Optionally, the dirt collection chamber may be part of a cyclone bin assembly and the cyclone bin assembly may be removable, preferably as a sealed unit.

Figure 12:
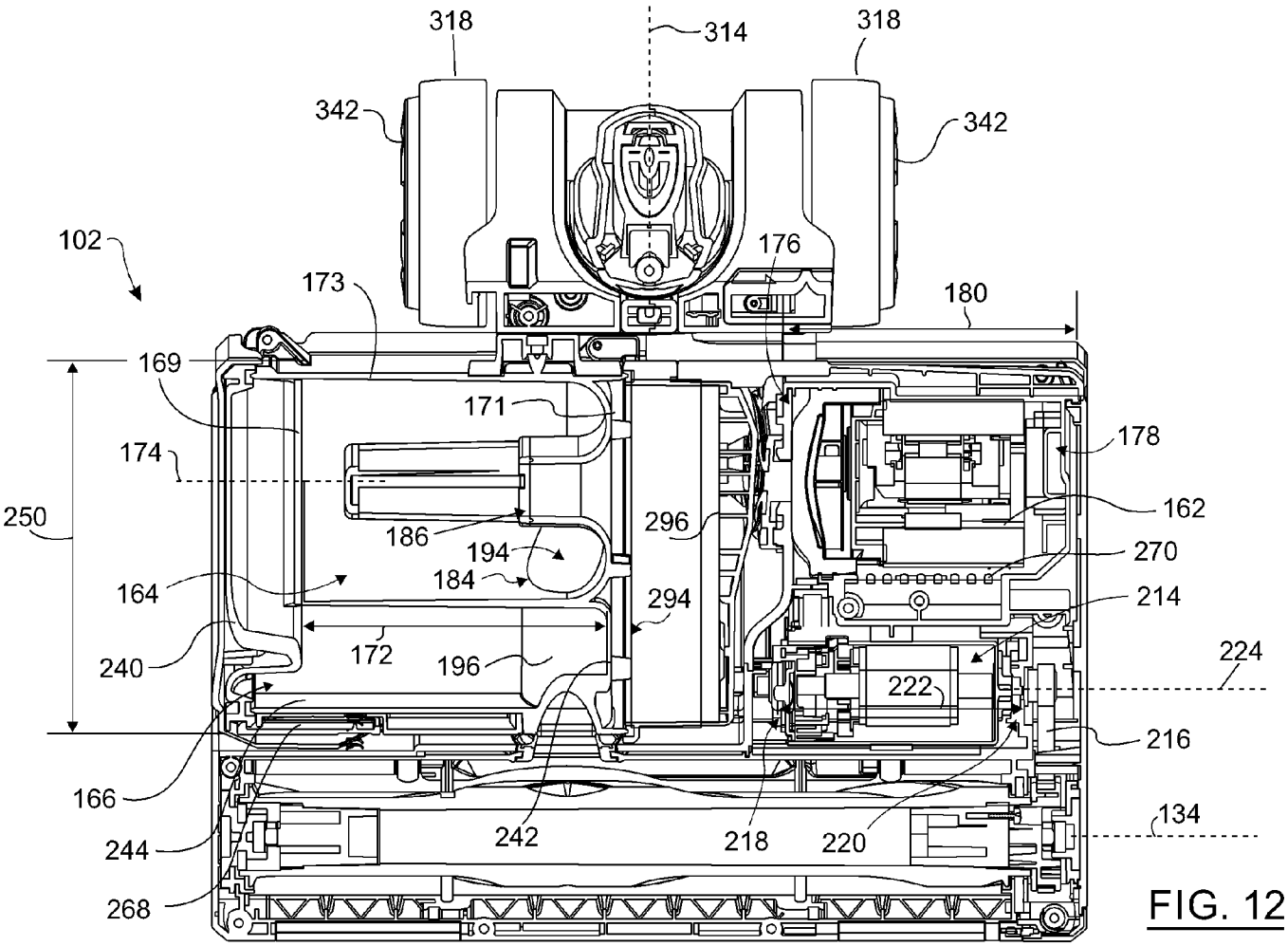
FIG. 12 is cross-sectional view of the surface cleaning apparatus of FIG. 1, taken along line 12-12, which is shown in FIG. 4.
Figure 20:
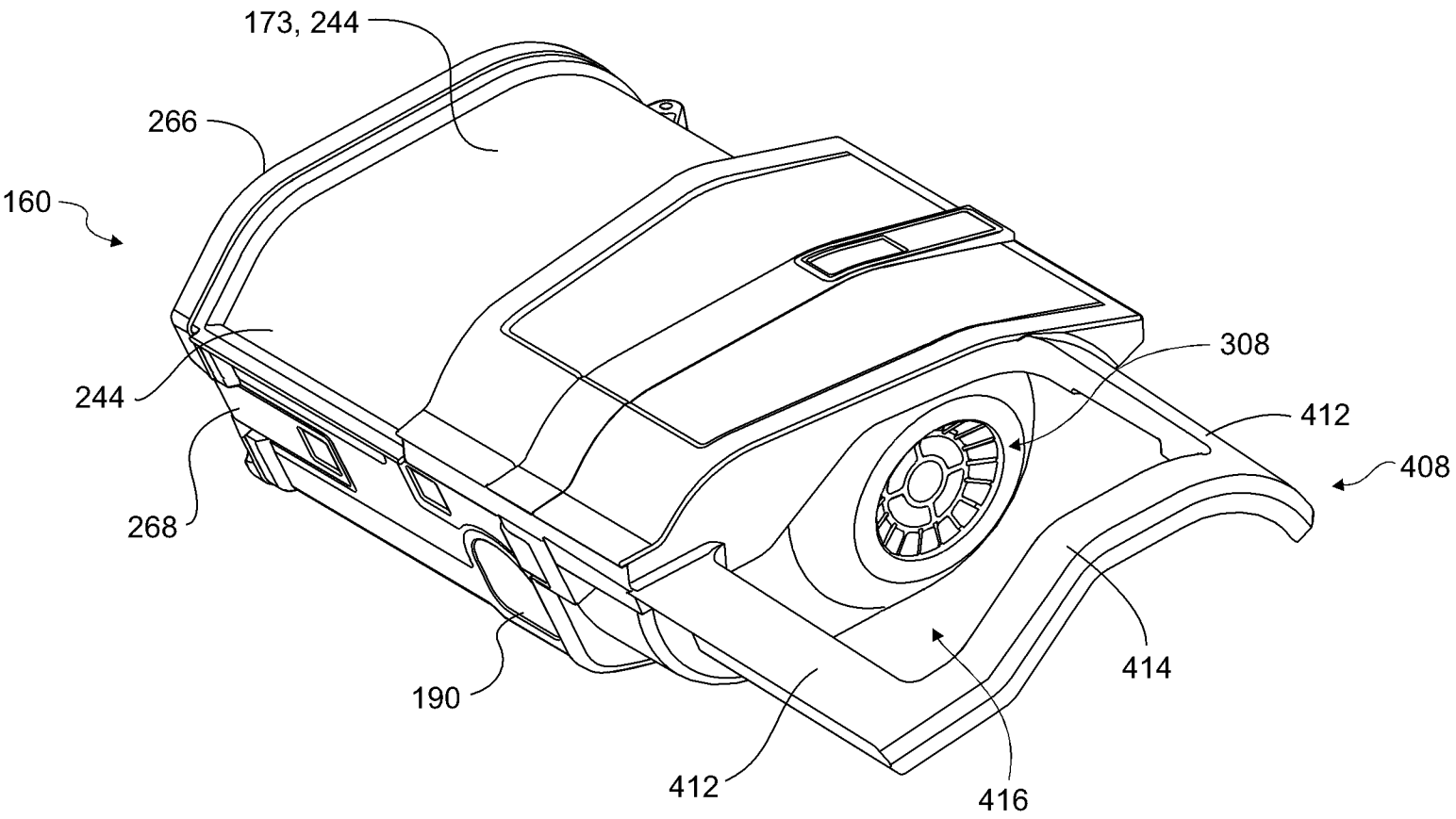
FIG. 20 is a perspective view of an example of a cyclone bin assembly useable with the surface cleaning apparatus of FIG. 1.
Figure 27:
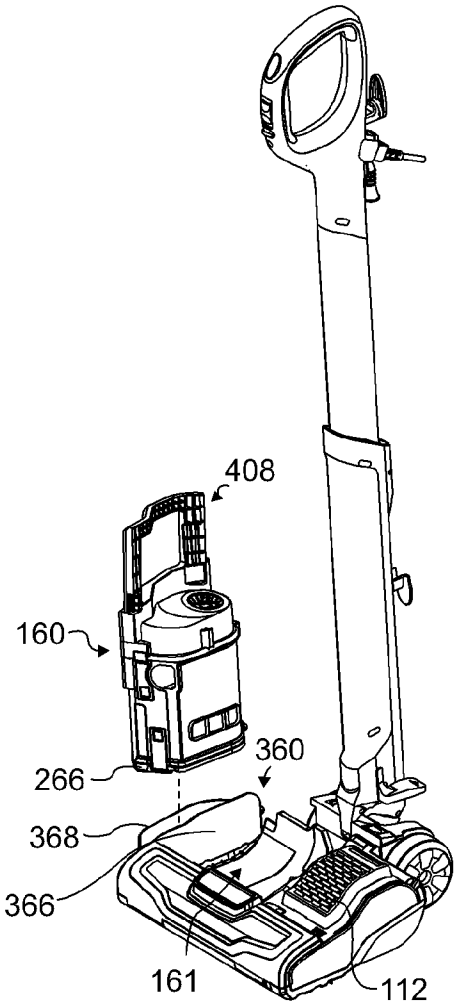
FIG. 27 is a front perspective view of the surface cleaning apparatus of FIG. 1 with the cyclone bin assembly detached.

Referring to FIGS. 12 and 13, which are cross-sectional views of the surface cleaning head 102, the surface cleaning head 102 includes an air treatment member in the form of a cyclone bin assembly 160 (see also FIGS. 1 and 20) positioned in the air flow path downstream from the dirty air inlet 110 and the brush chamber 130, and a suction motor 162 positioned downstream from the cyclone bin assembly 160. Preferably, the cyclone bin assembly 160 is detachable from the surface cleaning head 102. Referring to FIG. 20, the cyclone bin assembly 160 is illustrated in isolation, removed from the surface cleaning head 102. Referring to FIG. 27, the surface cleaning apparatus 100 is illustrated with the cyclone bin assembly 160 detached from the surface cleaning head 102. Providing a detachable cyclone bin assembly 160 may allow a user to carry the cyclone bin assembly 160 to a garbage can for emptying, without needing to carry or move the rest of the surface cleaning apparatus 100.

In the illustrated example, the surface cleaning head 102 includes a cavity 161 for releasably receiving the cyclone bin assembly 160. The cavity 161 is sized to receive at least a portion of the cyclone bin assembly 160 and, in the example illustrated, has a generally open top. This can allow portions of the cyclone bin assembly 160 to remain visible when the cyclone bin assembly 160 is mounted in the cavity 161. This can also allow a user to access the cyclone bin assembly 160 without having to open or remove a separate cover panel or lid. The absence of a cover panel may help reduce the overall weight of the surface cleaning apparatus 100, and may simplify the cyclone bin assembly 160 removal process. Optional cavity 161 designs and cyclone bin assembly removal processes are described in greater detail separately herein.

As exemplified in FIG. 7, when the cyclone bin assembly 160 is mounted to the surface cleaning head 102 a portion of the cyclone sidewall may form an upper surface of the cyclone bin assembly. Accordingly, the upper surface of the cyclone bin assembly remains exposed when attached to the surface cleaning head (there is no separate cover member, etc.) and the profile and curvature of the cyclone bin assembly defines the profile of a portion of the top face of the surface cleaning head. This profile may be selected so that it generally conforms to the shape of the suction motor housing, sidewalls and/or other portions of the surface cleaning head.

Figure 29:
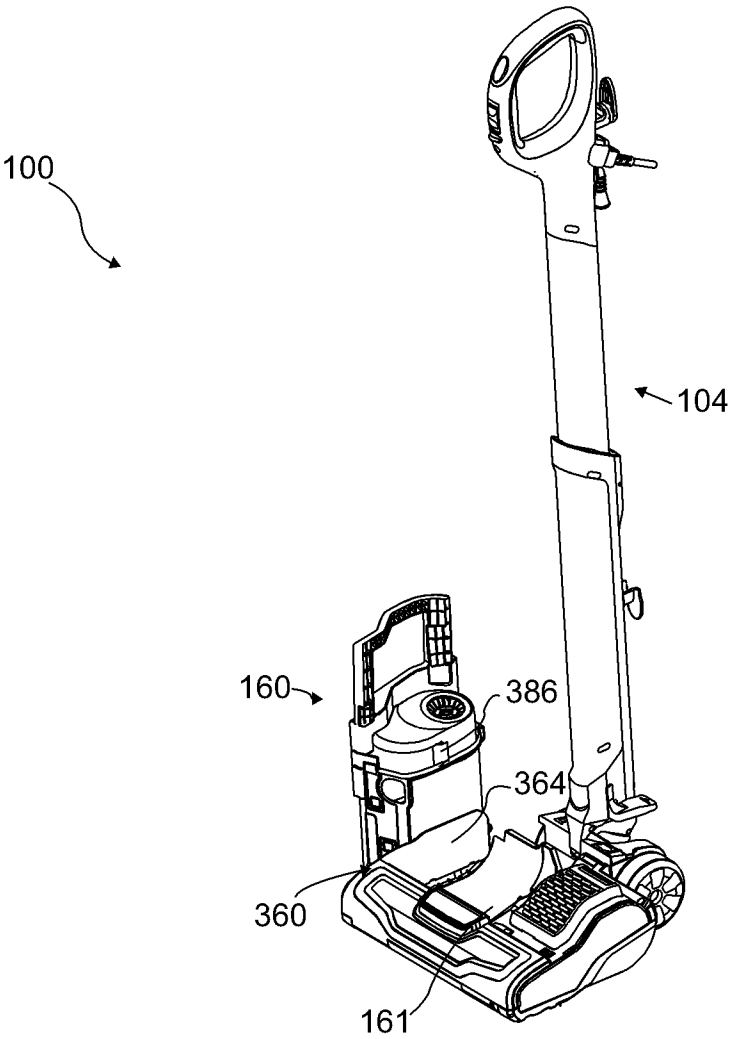
FIG. 29 is a front perspective view of the surface cleaning apparatus of FIG. 1 with the cyclone bin assembly in a removal position.
Figure 47:
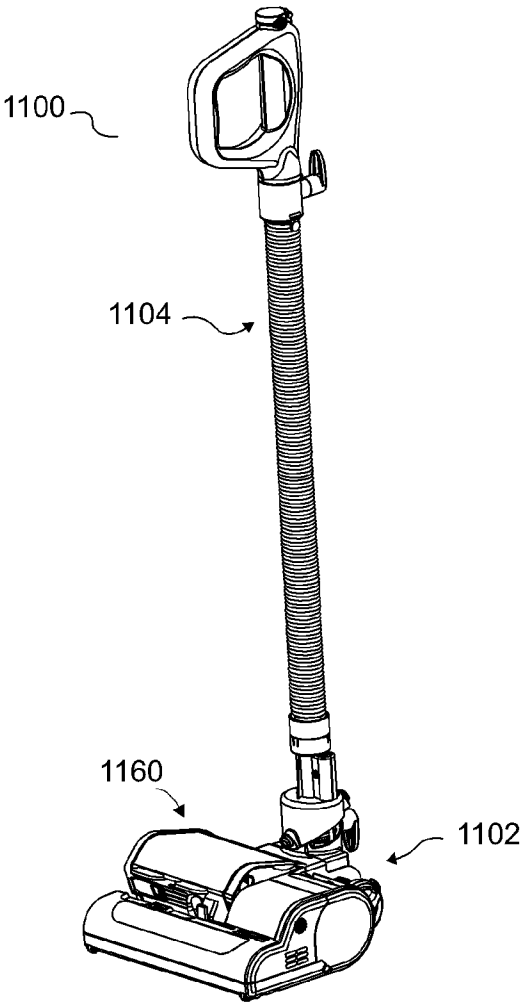
FIG. 47 is a front perspective view of the surface cleaning apparatus of FIG. 46, with the cyclone bin assembly in a removal position.
Figure 48:
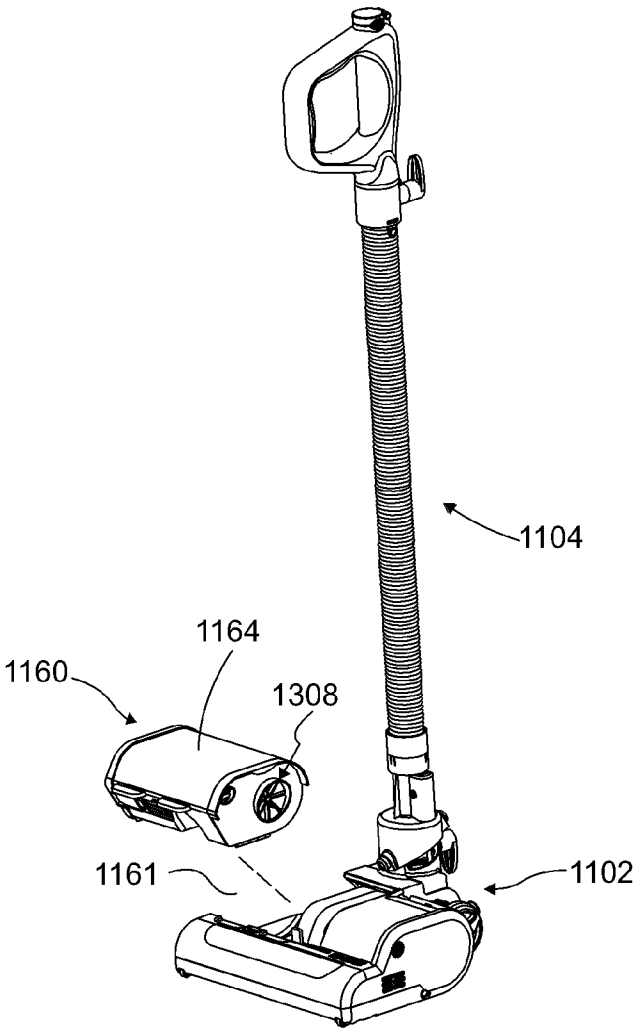
FIG. 48 is a front perspective view of the surface cleaning apparatus of FIG. 46, with the cyclone bin assembly removed.

The handle or handles that are used to carry the dirt collection chamber (e.g., the cyclone bin assembly handle) preferably does not extend beyond an outer wall of the surface cleaning head. Accordingly, the top surface of the surface cleaning head defines a maximum height of the surface cleaning head. If the handle were to extend upwardly, it could limit the extent to which the surface cleaning head could extend under furniture. As exemplified in FIGS. 1 and 46, the handle or handles for the cyclone bin assembly are received in a recess in the upper surface of the surface cleaning head such that the handles are mounted flush with the upper surface. It will be appreciated that the handles could be recessed inwardly when the cyclone bin assembly is in an in use position. Accordingly, the handle or handles may be useable once the cyclone bin assembly has been moved to a cyclone assembly removal position as exemplified in FIGS. 29 and 47.

It will be appreciated that some of the embodiments disclosed herein may not use any of the features of the dirt collection chamber disclosed herein and that, in those embodiments, the dirt collection chamber may be of various constructions and that in those embodiments any dirt collection chamber known in the art may be used.

Cyclone Bin Assembly

The following is a description of a cyclone bin assembly having various features, any or all of which may be used (individually or in any combination or sub-combination) in any surface cleaning apparatus or in any combination or sub-combination with any other feature or features disclosed herein.

Figure 25:
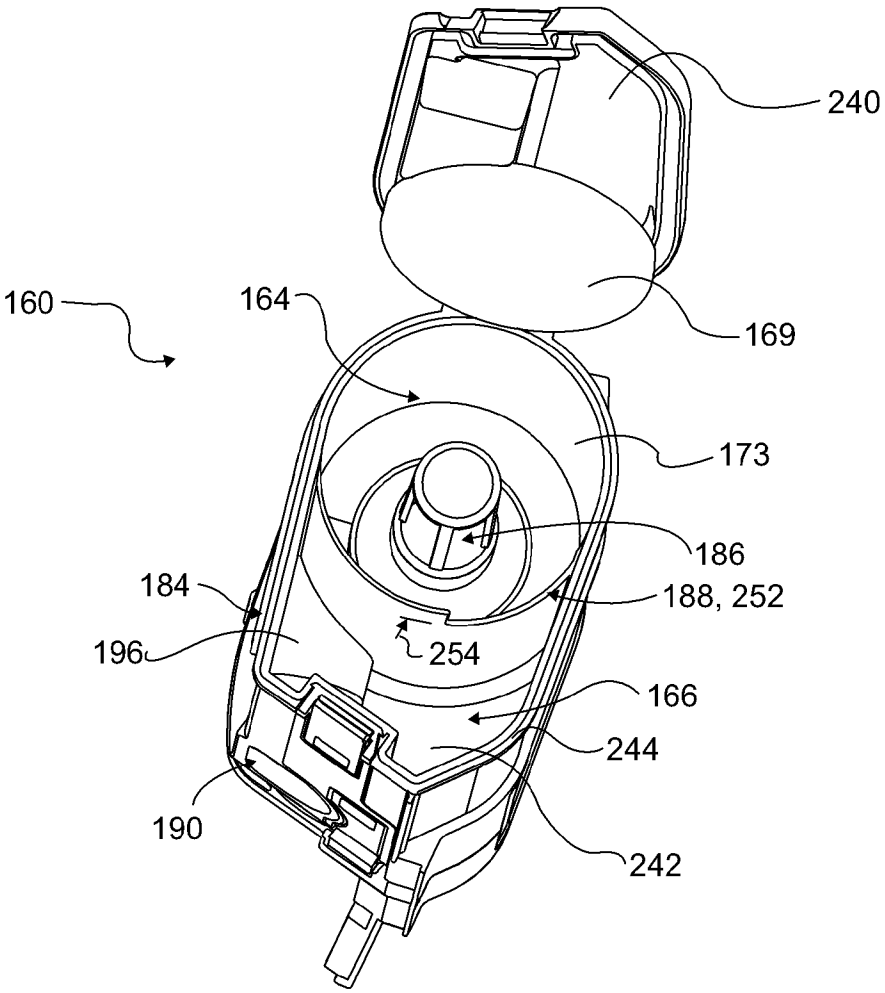
FIG. 25 is another perspective view of the cyclone bin assembly of FIG. 20 oriented with the cyclone chamber at the upper end, with the cyclone chamber door open.

Referring also to FIG. 25, in the illustrated example, the cyclone bin assembly 160 includes a cyclone chamber 164 and a dirt collection chamber 166. In the illustrated example, the dirt collection chamber 166 is external the cyclone chamber 164. In accordance with one feature of the cyclone bin assembly, dirt collection chamber 166 may be positioned forward and/or rearward of the cyclone chamber 164 and not on top of or below cyclone chamber 164. An advantage of this design is that by not positioning the dirt collection chamber above or below the cyclone chamber (or by reducing the height of the portion of the dirt collection chamber above or below the cyclone chamber) the height of the surface cleaning head 102 may be reduced without reducing the diameter of cyclone chamber 164 and/or the diameter of the cyclone chamber may be increased (thereby increasing the air flow rate through the vacuum cleaner) without increasing the height of the surface cleaning head.

Figure 14:
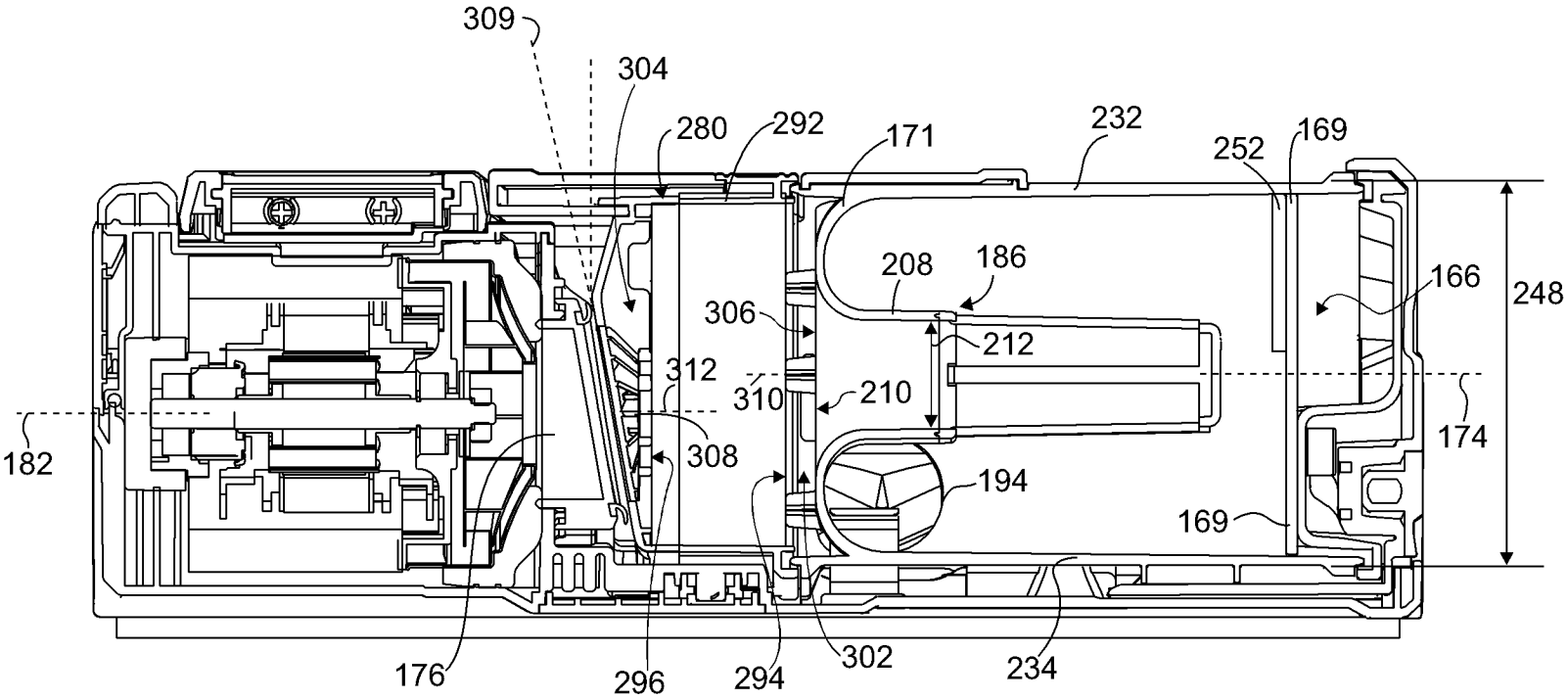
FIG. 14 is cross-sectional view of the surface cleaning apparatus of FIG. 1, taken along line 14-14, which is shown in FIG. 4.

In the illustrated example, the cyclone chamber 164 has a first cyclone end 168, with a first end wall 169, and a second cyclone end 170, with a second end wall 171. A generally cylindrical cyclone sidewall 173 extends between the first end wall 169 and the second end wall 171, spaced apart from each other by cyclone length 172 (FIG. 12) along a cyclone axis 174, about which air circulates. Referring also to FIG. 14, the cyclone chamber 164 also includes a cyclone air inlet 184, a cyclone air outlet 186 and a dirt outlet 188.

In accordance with another feature of the cyclone bin assembly, the air flow path from the brush chamber to the cyclone chamber may be constructed without any 90 degree bends. Reducing the number and degree of bends reduces the back pressure through the vacuum cleaner and thereby reduces the size of the suction motor (all other factors remaining the same) or increases the air flow rate through the vacuum cleaner if the size of the suction motor remains constant (all other factors remaining the same). For example, as exemplified in FIG. 16, the cyclone air inlet 184 may include an upstream or inlet end 190 that is connectable to a brush chamber air outlet 192 that may be provided in the rear wall 138 of the brush chamber 130. The cyclone air inlet 184 may also include a downstream end 194 that includes an opening formed in the cyclone sidewall 173, and a connecting portion 196 extending through the dirt collection chamber 166 between the upstream and downstream ends 190 and 194. The air flow connection between the brush chamber outlet 192 and the cyclone chamber 164 may form a first air flow path, which is a portion of the overall air flow path connecting the dirty air inlet 110 to the clean air outlet 112. Optionally, as exemplified, the first air flow path may be configured so that it is free from sharp corners and bends, so that the largest change of direction in the flow direction of the air flowing through the first air flow path is less than 90 degrees, and optionally may be less than about 70 degrees, less than about 60 degrees, less than about 45 degrees, less than 30 degrees and may be less than 15 degrees. In some embodiments, the largest change of direction in the flow direction of the air flowing through the first air flow path may be less than 5 degrees, and optionally, the first air flow path may be essentially linear.

Figure 16:
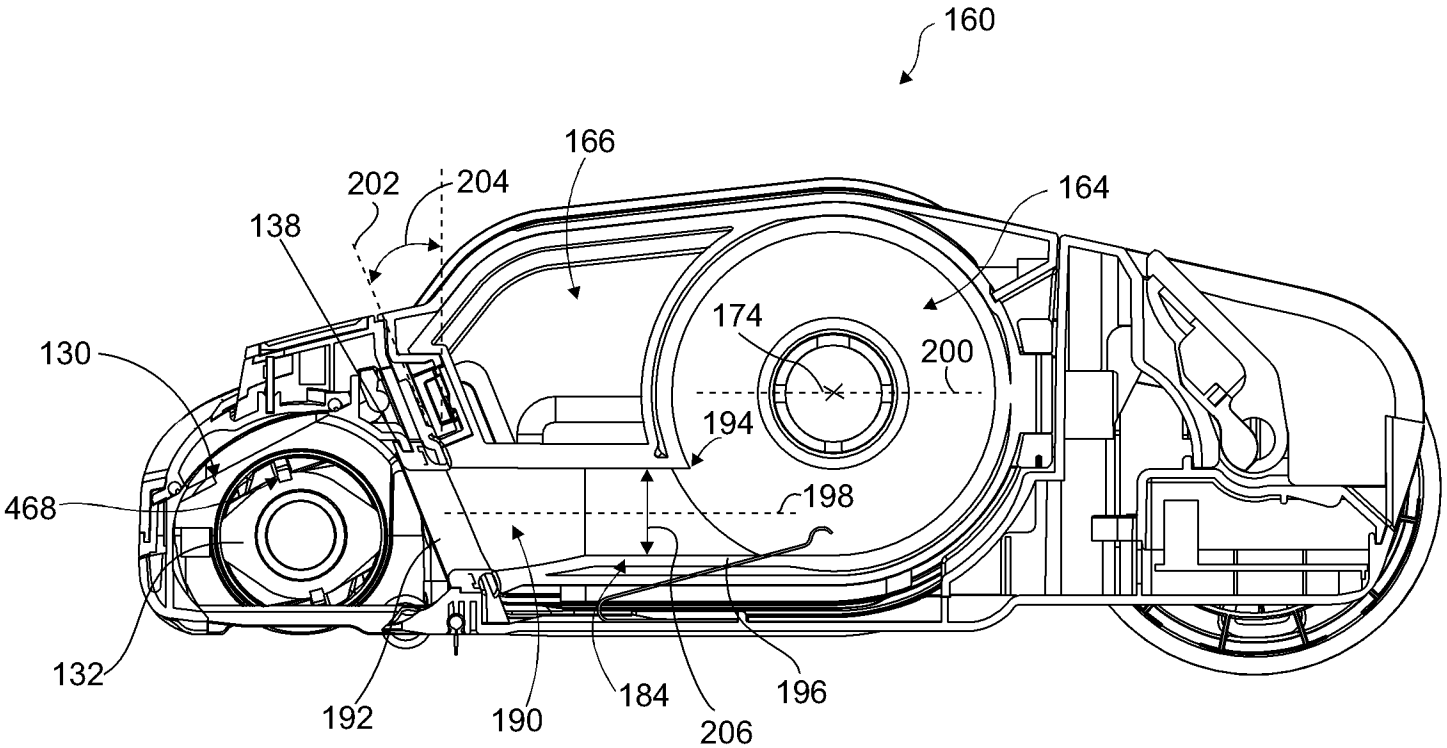
FIG. 16 is cross-sectional view of the surface cleaning apparatus of FIG. 1, taken along line 16-16, which is shown in FIG. 7.

Referring to FIG. 16, in the illustrated example, the connecting portion 196 extends along an inlet axis 198 which, in the example illustrated, is generally linear and extends generally in the forward/backward direction. In the illustrated example the first flow path is generally free from bends/corners and is essentially linear along its entire length (with the exception of minor variations in the wall diameter), from the opening 192 in the brush chamber rear wall 138 to the tangentially oriented opening 194 in the cyclone chamber sidewall 173. Providing a linear first air flow path may help reduce air flow losses as air flows through the first flow path. In addition, the first flow path is relatively short and provides a generally direct air flow path from the brush chamber 130 to the cyclone chamber 164. Providing a relatively short, direct air flow path may help reduce the likelihood of the air flow path becoming clogged by debris or otherwise blocked.

The cyclone air inlet 184 may be provided at any desired location on the cyclone chamber 164, and in the illustrated example is provided toward a bottom side of the cyclone chamber 164, below a horizontal plane 200 containing the cyclone axis 174. In this configuration, the inlet axis 198 intersects the cyclone chamber 164, the brush chamber 130 and the rotating brush 132.

In the illustrated example, the inlet end 190 of the cyclone air inlet 184 is integrally formed with the cyclone bin assembly 160. In this configuration, the inlet end 190 of the cyclone air inlet can be disconnected from the air outlet 192 of the brush chamber 130 and removed from the surface cleaning head with the cyclone bin assembly 160.

In accordance with another feature of the cyclone bin assembly, the inlet end 190 of the cyclone air inlet 184 and the air outlet 192 of the brush chamber 130 may be configured to meet each other in sealing plane 202 that is at an angle to the vertical. It will be appreciated that the surface cleaning apparatus 100 can be configured so that the sealing plane is vertical, horizontal or is at an angle relative to a vertical plane. In the illustrated example, the sealing plane 202 between the inlet end 190 of the cyclone air inlet 184 and the air outlet 192 of the brush chamber 130 is inclined forwardly and is aligned at an angle 204 relative to the vertical direction. This may help facilitate alignment and mating of the inlet end 190 of the cyclone air inlet 184 and the air outlet 192 of the brush chamber 130 when the cyclone bin assembly 160 is placed onto the surface cleaning head 102. It will be appreciated that one or both of the inlet end 190 and the air outlet 192 may be provided with a gasket, O-ring or the like.

A cross-sectional area of the air inlet 184 taken in a plane orthogonal to the inlet axis 198 can be referred to as the cross-sectional area or flow area of the air inlet 184. The cross-sectional shape of the air inlet 184 can be any suitable shape. In the illustrated example the air inlet 184 has a generally round or circular cross-sectional shape with a diameter 206. Optionally, the diameter 206 may be between about 0.25 inches and about 5 inches or more, preferably between about 1 inch and about 5 inches, more preferably is between about 0.75 and 2 inches or between about 1.5 inches and about 3 inches, and most preferably is about 2 to 2.5 inches or between about 1 to 1.5 inches. Alternatively, instead of being circular, the cross-sectional shape of the air inlet may be another shape, including, for example, oval, square and rectangle.

Referring to FIGS. 13 and 14, in the illustrated example, the cyclone air outlet 186 includes a vortex finder portion 208 in communication with an aperture 210 (see also FIG. 23) that is generally centrally located on the second end wall 172 of the cyclone chamber 164. A cross-sectional area of the aperture 210 taken in a plane orthogonal to the cyclone axis 174 can be referred to as a cross-sectional area or flow area of the cyclone air outlet 186. The perimeter of vortex finder portion 208 defines a cross-sectional shape of the air outlet. The cross-sectional shape of the air outlet can be any suitable shape. In the illustrated example the air outlet has a generally round or circular cross-sectional shape with a diameter 212. Optionally, the diameter 212 may be between about 0.25 inches and about 5 inches or more, preferably between about 1 inch and about 5 inches, more preferably is between about 0.75 and 2 inches or between about 1.5 inches and about 3 inches, and most preferably is about 2 to 2.5 inches or between about 1 to 1.5 inches. Alternatively, instead of being circular, the cross-sectional shape of the air inlet may be another shape, including, for example, oval, square and rectangle.

In accordance with another feature of the cyclone bin assembly, the cross sectional area of the cyclone air inlet 184 and the cyclone air outlet 186 may be selected to reduce back pressure through the vacuum cleaner. Accordingly, the cross-sectional or flow area of the cyclone air outlet 186 may be between about 50% and about 150% and between about 60%-120% and about 90%-110% of the cross-sectional area of the cyclone air inlet 184, and preferably is generally equal to the area of cyclone air inlet 184. In this configuration, the air outlet diameter 212 may be about the same as the air inlet diameter 206 (FIG. 16).

The dirt collection chamber may be of any suitable configuration. Preferably, as exemplified in FIG. 12, the dirt collection chamber 166 is exterior to cyclone chamber 164, and preferably includes a first end wall 240, a second end wall 242 and the sidewall 244 extending therebetween. Referring also to FIG. 25, in the illustrated example, the sidewall 244 partially laterally surrounds the cyclone chamber 164. At least partially positioning the dirt collection chamber 166 forward or rearward of the cyclone chamber 164 may help reduce the overall height of the surface cleaning head. As illustrated in the present example, the cyclone chamber sidewall 173 may be coincident with the sidewall 244 at one or more locations around its perimeter. Optionally, portions of the dirt chamber sidewall 244 can form portions of the outer or exposed surface of the surface cleaning apparatus 100 when the cyclone bin assembly 160 is mounted in the cavity 161.

In the illustrated example, a majority of the dirt collection chamber 166 is located in front of (i.e. forward of) the cyclone chamber 164 in the direction of travel of the surface cleaning head 102, between the cyclone chamber 164 and the brush chamber 130. In some configurations, the rear portions of the cyclone sidewall 173 and dirt collection chamber sidewall 244 may be coincident, and the front portion of the cyclone sidewall 173 may be spaced apart from the front portion of the dirt collection chamber sidewall 244. Locating the cyclone chamber 164 toward the back of the cyclone bin assembly 160 may help align the cyclone air outlet 186 with the air inlet 246 (FIGS. 13 and 30) of the suction motor 162. Locating the dirt collection chamber 166 forward of the cyclone chamber 164 may help make the dirt collection chamber 166 more easily viewable by a user (particularly if some or all of the dirt collection chamber sidewall 244 is transparent and there is no lid or the lid is transparent), which may allow a user to inspect the condition of the dirt collection chamber 166 without having to remove the cyclone bin assembly 160 from the cavity 161.

In the illustrated example, the dirt collection chamber 166 is located solely in front of the cyclone chamber 164 and does not extend above or below the cyclone chamber (as viewed when the cyclone bin assembly is mounted to the surface cleaning head in FIG. 16). It will be appreciated that small portions of the dirt collection chamber may be positioned above or below the cyclone chamber without significantly deviating from the advantage of this feature. In this configuration, the overall height 248 of the cyclone bin assembly 160 (measured in a vertical direction when the cyclone bin assembly is mounted to the surface cleaning head) is generally equal to the outer diameter of the cyclone chamber 164 (i.e. including the wall thicknesses), while the overall width 250 (FIG. 12) of the cyclone bin assembly 160 (measured in the front/back direction when the cyclone bin assembly is mounted to the surface cleaning head) is greater than the cyclone diameter. Providing the dirt collection chamber 166 only in front of the cyclone chamber 164 may help reduce the overall height 248 of the cyclone bin assembly 160 while still providing a dirt collection chamber 166 with a practical internal storage volume. Reducing the overall height 248 of the cyclone bin assembly 160 may help reduce the overall height 339 (FIG. 6) of the surface cleaning head 102 when the cyclone bin assembly 160 is in the cavity 161. Preferably, the overall height 339 of the surface cleaning head 102 is less than about 15 inches, and may be less than about 10 inches, less than about 8 inches, less than about 6 inches, less than about 5 inches, less than about 4.5 inches and optionally less than 4 inches. In the illustrated example, the overall height 339 is about 4.5 inches.

Alternatively, the cyclone bin assembly may be configured so that the dirt collection chamber is located entirely behind the cyclone chamber (i.e. between the cyclone chamber and the rear face of the surface cleaning head), or is located partially in front of and partially behind the cyclone chamber and so that the dirt collection chamber extends partially or entirely above and/or below the cyclone chamber.

Cyclone chamber 164 may be in communication with a dirt collection chamber 166 by any suitable cyclone dirt outlet known in the art. Preferably the cyclone chamber includes at least one dirt outlet in communication with the dirt chamber that is external the cyclone chamber. Referring to FIGS. 14 and 25, in accordance with another feature of the cyclone bin assembly, the cyclone dirt outlet 188 may be in the form of a slot 252 bounded by the cyclone side wall 173 and the cyclone end wall 169, and is located toward the first end 168 of the cyclone chamber 164. Alternatively, in other embodiments, the dirt outlet may be of any other suitable configuration, and may be provided at another location in the cyclone chamber, including, for example as an annular gap between the sidewall and an end wall of the cyclone chamber or an arrestor plate or other suitable member.

Figure 26:
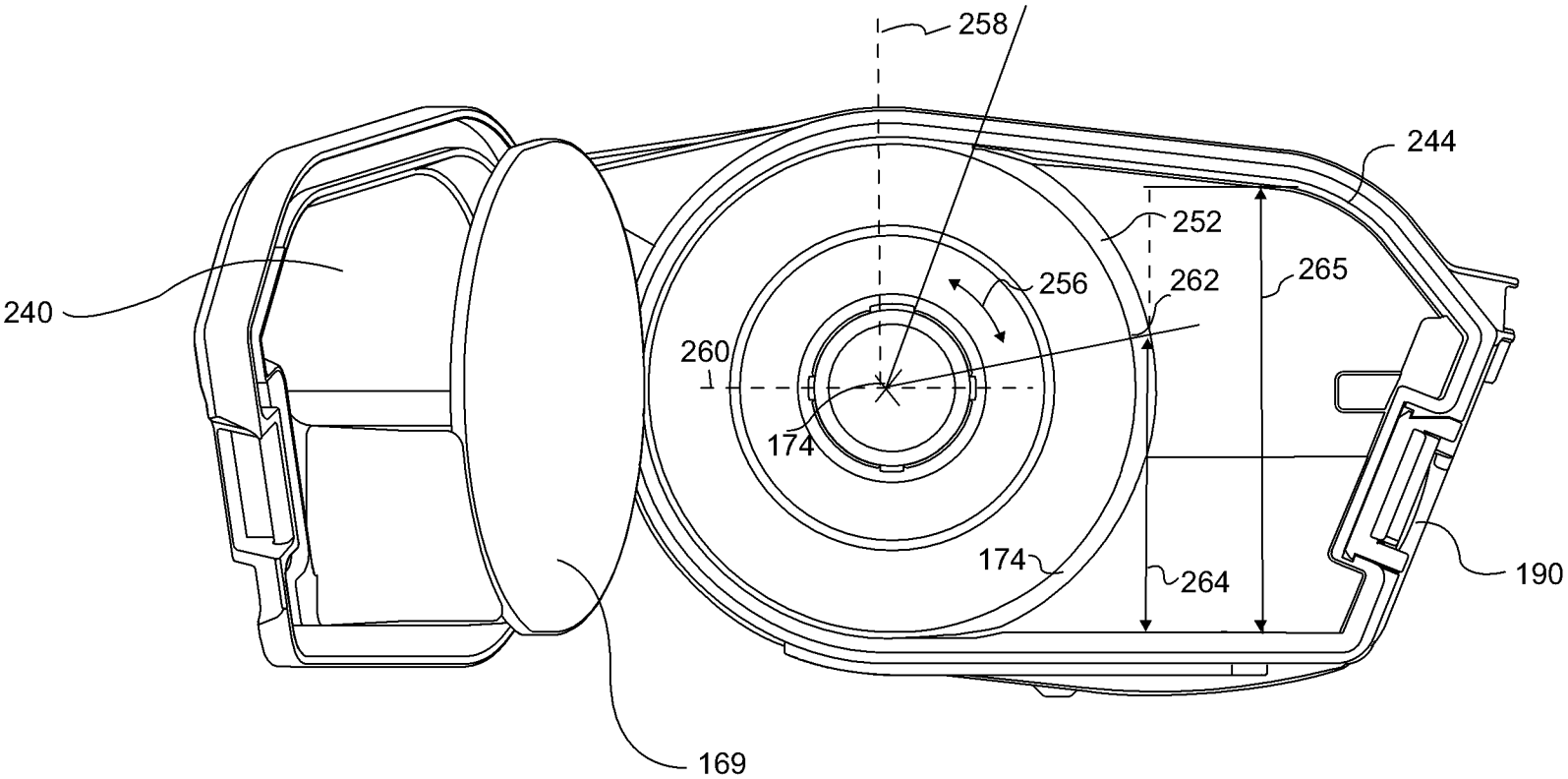
FIG. 26 is an end view of the cyclone bin assembly of FIG. 20 in the configuration of FIG. 25.

Referring to FIG. 25, the slot 252 may be of any suitable height 254 (measured in the direction of the cyclone axis) and may have any suitable angular extent 256 (FIG. 26). In the illustrated example, the height 254 may remain generally constant along the extent of the slot 252, and may be between about 0.25 cm and about 15 cm, and preferably is between about 0.75 cm and about 5 cm, and more preferably is about 1 cm. The cyclone chamber height 174 may be any suitable height, including between about 5 cm and about 20 cm, preferably between about 7 cm and about 15 cm and in the illustrated example is about 9 cm. Optionally, the height of the slot 252 may be selected so that it is between about 5% and about 20% of the cyclone height 174, and preferably is between about 7% and about 12% of the cyclone height.

Referring to FIG. 26, in the illustrated example, the slot 252 subtends an angle 256 of approximately 60 degrees, which is about 20% of the perimeter of the cyclone chamber sidewall 173. Alternatively, in other embodiments the slot may extend between about 10 degrees and about 350 degrees, and may occupy between about 2.75% and about 97.5% of the perimeter of the cyclone chamber.

The slot 252 may be provided at any desired location around the perimeter of the cyclone chamber 164. Referring to FIG. 26, in the illustrated example the slot 252 is provided toward the front of the cyclone chamber 164 (i.e. forward of a vertical plane 258 containing a centrally located cyclone axis 174) in a location that is in communication with the forward-located dirt chamber 166. The slot 252 is also positioned so that it is in the upper half of the cyclone chamber 164 (i.e. above a horizontal plane 260 that contains the centrally located cyclone axis 174—when the cyclone bin assembly is mounted to the surface cleaning head). In this configuration, the lower end 262 of the slot 252 is at least partially upward facing and is spaced apart from the underlying portion of the dirt chamber sidewall by an outlet height 264. In the illustrated example, the slot height is about 60% of the dirt collection chamber height 265 taken at the same location, and in other embodiments may be between about 35% and about 80% of the dirt collection chamber height 265. Spacing the lower end 262 of the slot 252 a suitable distance above the bottom of the dirt collection chamber 166 (when the cyclone bin assembly is in use) may help prevent the slot 252 from becoming blocked as debris accumulates within the dirt collection chamber 166.

Optionally, in accordance with another feature of the cyclone bin assembly, to help facilitate emptying the dirt collection chamber, at least one of or both of the end walls may be openable. Similarly, one or both of the cyclone chamber end walls and may be openable to allow a user to empty debris from the cyclone chamber.

Figure 21:
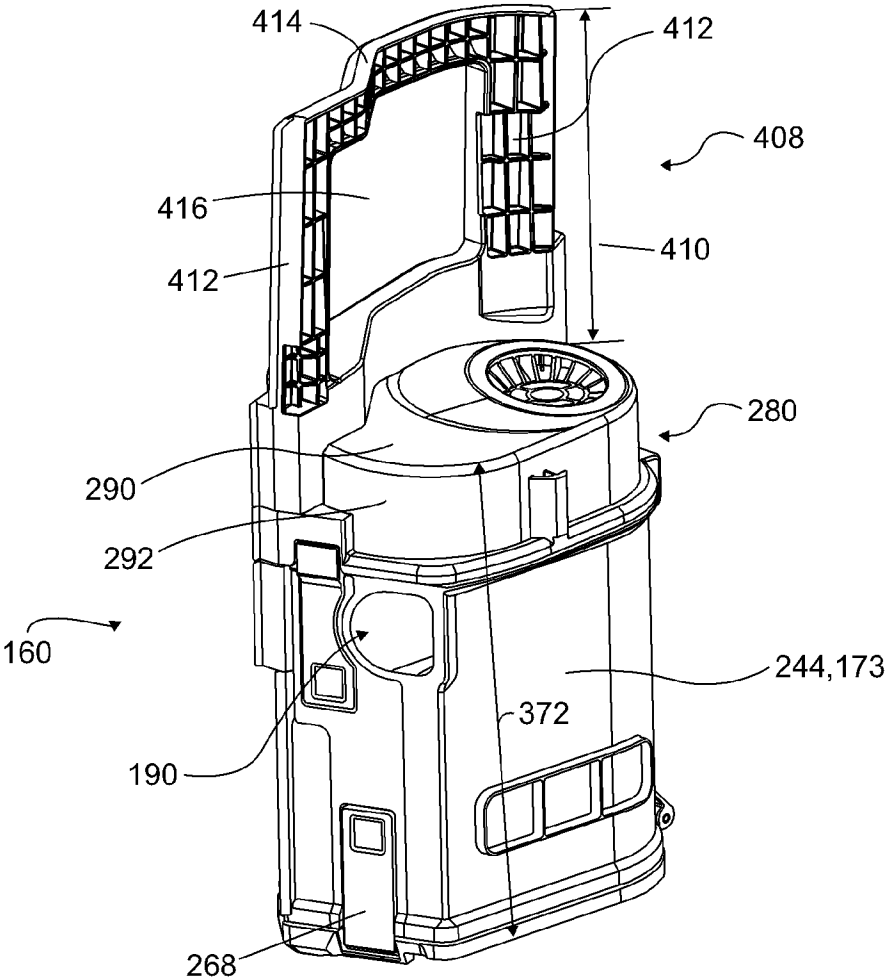
FIG. 21 is another perspective view of the cyclone bin assembly of FIG. 20 oriented with the filter chamber at the upper end.
Figure 22:
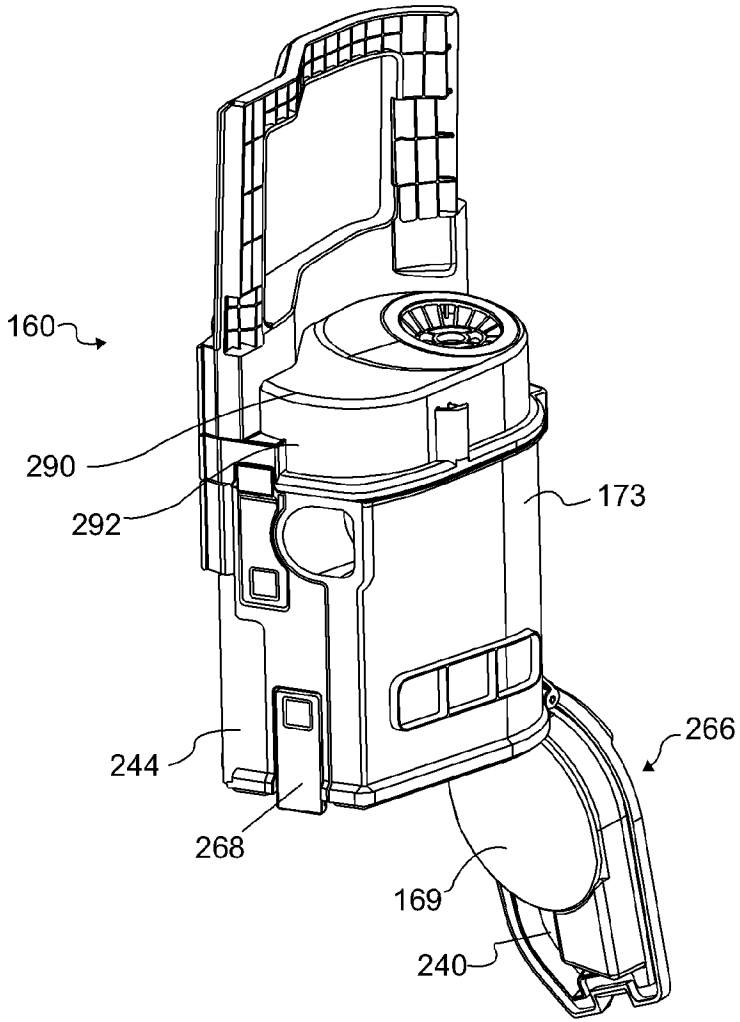
FIG. 22 is a perspective view of the cyclone bin assembly of FIG. 21 with a cyclone chamber door open.

Referring to FIG. 22, in the illustrated example, the dirt chamber end wall 240 is openable to empty the dirt collection chamber 166. The first cyclone end wall 169 is mounted to, and openable with, the cyclone chamber end wall 240 and together both form part of the openable door 266 of the cyclone bin assembly 160. The door 266 is moveable between a closed position (FIG. 21) and an open position (FIG. 22). When the door 266 is open, both the cyclone chamber 164 and the dirt collection chamber 166 can be emptied concurrently. Alternatively, the end walls of the dirt collection chamber and the cyclone chamber need not be connected with each other, and the dirt collection chamber may be openable independently of the cyclone chamber.

Preferably, the openable door 266 can be can be secured in its closed position until opened by a user. The door 266 may be held closed using any suitable latch or fastening mechanism, such as latch 268. Optionally, the latch can be provided in a location that is inaccessible when the cyclone bin assembly is mounted to the surface cleaning head. This may help prevent the door from being opened inadvertently. In the illustrated example, when the cyclone bin assembly 160 is mounted in the cavity 161 the latch 268 is disposed between the dirt chamber sidewall 244 and the brush chamber 230 (see FIG. 12) and is inaccessible to the user.

In the illustrated example, portions of the cyclone chamber sidewall 173 coincide with portions of the dirt chamber sidewall 244 and form portions of the outer, exposed surface of the cyclone bin assembly 160. Further, when the cyclone bin assembly 160 is attached to the surface cleaning head 102, portions of the outer surface of the cyclone bin assembly 160 provides portions of the top face 128 of the surface cleaning head 102.

It will be appreciated that some of the embodiments disclosed herein may not use any of the features of the cyclone bin assembly disclosed herein and that, in those embodiments, the cyclone bin assembly may be of various constructions and that in those embodiments any cyclone bin assembly known in the art may be used.

Accessing the Pre-Motor Filter Chamber

The following is a description of methods of accessing a pre-motor filter chamber that may be used by itself in any surface cleaning apparatus or in any combination or sub-combination with any other feature or features disclosed herein.

Figure 24:
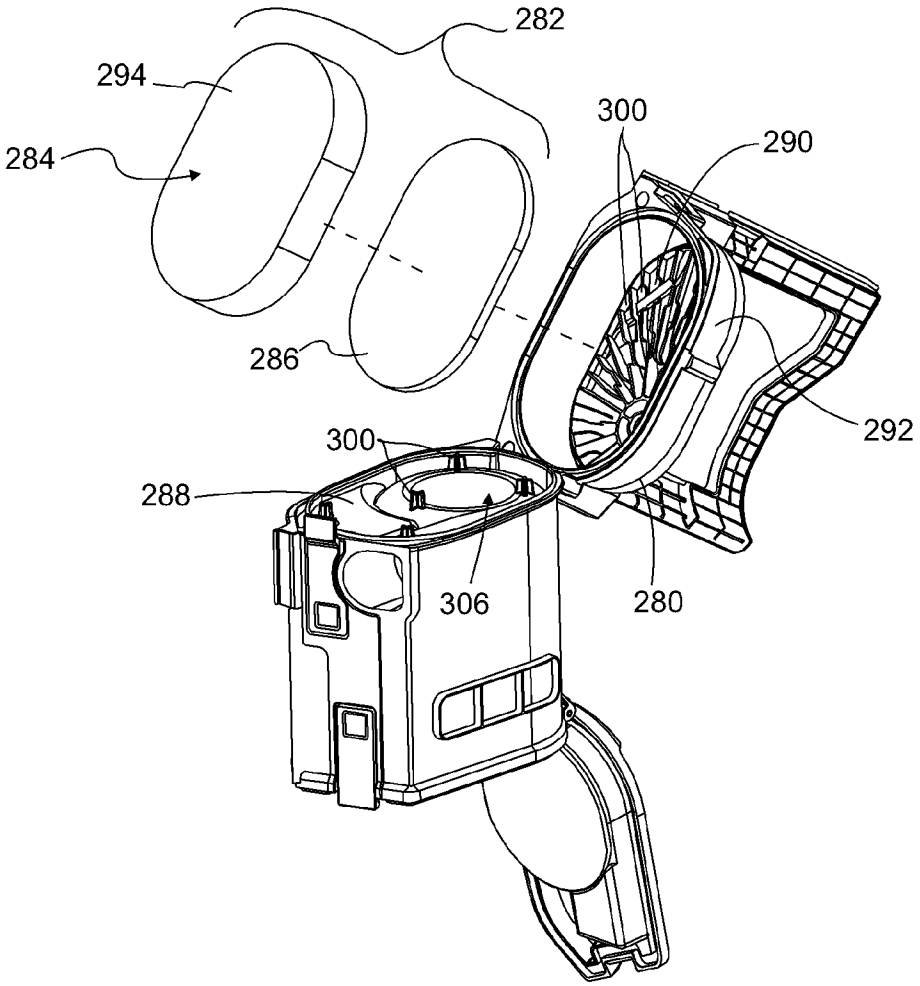
FIG. 24 is a partially exploded view of the cyclone bin assembly of FIG. 23.

In accordance with one method, the cyclone bin assembly 160 may also include a pre-motor filter chamber 280 that houses a pre-motor filter 282 (See FIGS. 14, 21 and 24). An advantage of this design is that the pre-motor filter chamber is removable with the cyclone bin assembly. Accordingly, when a user removes the cyclone bin assembly to empty the dirt collection chamber, the user may also check the condition of the pre-motor filter (e.g., by looking at the pre-motor filter if part or all of the pre-motor filter chamber is transparent) or by opening the pre-motor filter chamber and inspecting the pre-motor filter.

In an alternate constriction, the pre-motor filter chamber need not be part of the cyclone bin assembly. In such a case, the pre-motor filter chamber may be positioned so as to be visible when the cyclone bin assembly is removed. Accordingly, when a user removes the cyclone bin assembly to empty the dirt collection chamber, the user may also check the condition of the pre-motor filter (e.g., by looking at the pre-motor filter if part or all of the pre-motor filter chamber is transparent) or by opening the pre-motor filter chamber and inspecting the pre-motor filter.

In a further alternate embodiment, the pre-motor filter chamber may be opened when the cyclone bin assembly is removed. For example, the cyclone bin assembly may form part of the pre-motor filter chamber (e.g., an upstream wall of the pre-motor filter chamber).

It will be appreciated that some of the embodiments disclosed herein may not use any of the methods of accessing the pre-motor filter chamber disclosed herein and that, in those embodiments, the method of accessing the pre-motor filter chamber may be any of those known in the art.

Pre-Motor Filter Chamber

The following is a description of a pre-motor filter chamber, and a pre-motor filter suitable for positioning within the chamber, having various features, any or all of which may be used (individually or in any combination or sub-combination), that may be used by itself in any surface cleaning apparatus or in any combination or sub-combination with any other feature or features disclosed herein.

In accordance with one feature, the pre-motor filter chamber 280 may be positioned between the cyclone chamber air outlet and the suction motor air inlet. For example, the suction motor air inlet end may face the cyclone chamber air outlet end. In such an embodiment, the air exiting the cyclone chamber may travel in a generally linear direction to the suction motor while still passing through the pre-motor filter.

In accordance with a further feature, the pre-motor filter chamber may comprise the air flow part between the cyclone chamber and the suction motor. Accordingly, no additional air flow conduit may be required or, alternately, the length of any such additional air flow conduit may be reduced.

For example, as exemplified in FIG. 14, the pre-motor filter chamber 280 may be positioned adjacent the air outlet 186 of the cyclone chamber 164, such that when the cyclone bin assembly 160 is mounted on the surface cleaning head 102, the pre-motor filter chamber 280 is positioned, preferably transversely, between the cyclone chamber 164 and the suction motor 162.

The air flow path connecting the cyclone air outlet 186 to the suction motor air inlet 246 may define a second air flow path that forms a portion of the overall air flow path between the dirty air inlet 110 and the clean air outlet 112. The second air flow path may be separate from the first air flow path that connects the brush chamber 130 to the cyclone chamber 164. The second air flow path may include the cyclone air outlet 186 and the suction motor air inlet 246, as well as intervening structures, such as, for example, a pre-motor filter chamber 230.

Like the first air flow path, the second air flow path can optionally be configured so that it is free from sharp corners and bends, so that the largest change of direction in the flow direction of the air flowing through the first air flow path is less than 90 degrees, and optionally may be less than about 70 degrees, less than about 60 degrees, less than about 45 degrees, less than 30 degrees and may be less than 15 degrees. In some embodiments, the largest change of direction in the flow direction of the air flowing through the first air flow path may be less than 5 degrees, and optionally, the first air flow path may be essentially linear.

Referring to FIGS. 13 and 14, in the illustrated example the second air flow path is generally free from bends/corners and, while the pre-motor filter 282 has a relatively larger cross-sectional area than the cyclone air outlet 186 or motor air inlet 246, the second flow path is essentially linear along its entire length, from the cyclone air outlet 186 to the motor air inlet 246. In this configuration, the second air flow path extends in the transverse direction, and the direction of air flowing through the second air flow path is generally orthogonally to the direction of air flowing through the first air flow path. Providing a linear second air flow path may help reduce air flow losses as air flows through the second flow path.

Referring also to FIG. 24, in the illustrated example, the pre-motor filter chamber 280 includes a first end wall 288, a second end wall 290 axially spaced apart from the first end wall 288, and a sidewall 292 extending between the end walls 288 and 290, defines an interior that is configured to hold the pre-motor filter 282. In the illustrated example, the filter chamber end wall 288 is integrally formed with, and substantially coincident with, the cyclone chamber second end wall 171 and the dirt collection chamber end wall 242 (e.g., end walls 171 and 242 may be integrally formed with each other). This may help reduce the amount of plastic required to form the cyclone bin assembly 160, which may help reduce the overall volume and/or weight of the cyclone bin assembly. Alternatively, the pre-motor filter chamber, cyclone chamber and dirt collection chamber can be provided as separate members.

In accordance with a further feature, the pre-motor filter chamber 280 may be oriented such that the upstream face of the pre-motor filter is positioned generally orthogonal to the direction of air exiting the cyclone chamber and/or the cyclone bin assembly. Accordingly, for example, the pre-motor filter may overlie part or all of the cyclone chamber and the dirt collection chamber and may extend generally rearwardly from the brush chamber to the rear end of the surface cleaning head. An advantage of this design is that the upstream surface area of the pre-motor filter may be increased thereby extending the operating time of the surface cleaning apparatus prior to the pre-motor filter requiring cleaning. For example, having a large cross-sectional area in a direction orthogonal to the flow direction may help increase the interval of time that the surface cleaning apparatus 100 can be operated without having to clean the pre-motor filter and/or reduce air flow back pressure.

In the illustrated example, the pre-motor filter chamber 280 is sized so that the first and second end walls 288 and 290 cover substantially the entire cross-sectional area of the cyclone bin assembly 160. The pre-motor filter 282 is sized to fill substantially the entire cross-sectional area of the pre-motor filter chamber 280 (i.e. is a press fit/interference fit within the chamber sidewall 292) and, in the example illustrated, also covers substantially the entire cross-sectional area of the cyclone bin assembly 160. In this configuration, the pre-motor filter 282, and pre-motor filter chamber 280, each extend in the forward/backward direction and may extend from a front portion adjacent the brush chamber 130 and rotating brush 132, to a rear portion adjacent the rear end 118 of the surface cleaning head 102 (see FIG. 13). While the pre-motor filter need not extend all the way between the front and rear portions, the longer to upstream side of the filter, the longer the time may be between cleaning/replacing the filter.

In the illustrated example, the pre-motor filter 282 is generally planar and is arranged perpendicular to the cyclone axis 174. When the pre-motor filter 282 is positioned within the pre-motor filter chamber 280, an upstream face 294 of the filter 282 faces, and overlies, the end walls 171 and 242 of the cyclone chamber 164 the dirt collection chamber 166 respectively (FIG. 12). In this configuration, an opposed, downstream face 296 of the pre-motor filter 282 faces and overlies the suction motor 162. In this configuration, the cyclone axis 174 and the suction motor axis 182 each intersect the pre-motor filter chamber 280, and the pre-motor filter 282, when the cyclone bin assembly 160 is mounted to the surface cleaning head 102.

Referring to FIG. 13, in the illustrated example, a pre-motor filter axis 298 extends generally parallel to the upstream face 294, and it the example illustrated is parallel to the downstream face 296 as well. The pre-motor filter axis 298 is, in the example illustrated, parallel with forward direction of travel of the surface cleaning apparatus 102.

In the illustrated example, the pre-motor filter chamber sidewall 292 and end wall 290 are configured such that they form part of the outer surface of the cyclone bin assembly 160, and when the cyclone bin assembly 160 is mounted to the surface cleaning head 102 the sidewall 292 forms part of the exposed outer surface of the surface cleaning head 102.

In accordance with a further feature, the pre-motor filter chamber may be openable while attached to the cyclone bin assembly to allow a user to access the pre-motor filter 282. Further, the cyclone and dirt collection chambers may be openable, and preferably concurrently openable, while the pre-motor filter chamber is attached to the cyclone bin assembly. As exemplified, the pre-motor filter chamber is provided at one end of the cyclone bin assembly and the opposed end of the cyclone bin assembly may have a door which concurrently opens the cyclone chamber and the dirt collection chamber. Alternately or in addition, the pre-motor chamber end of the cyclone bin assembly may be openable—e.g., by removing the pre-motor filter chamber and/or by having the wall defining the upstream end of the pre-motor filter chamber open.

Figure 23:
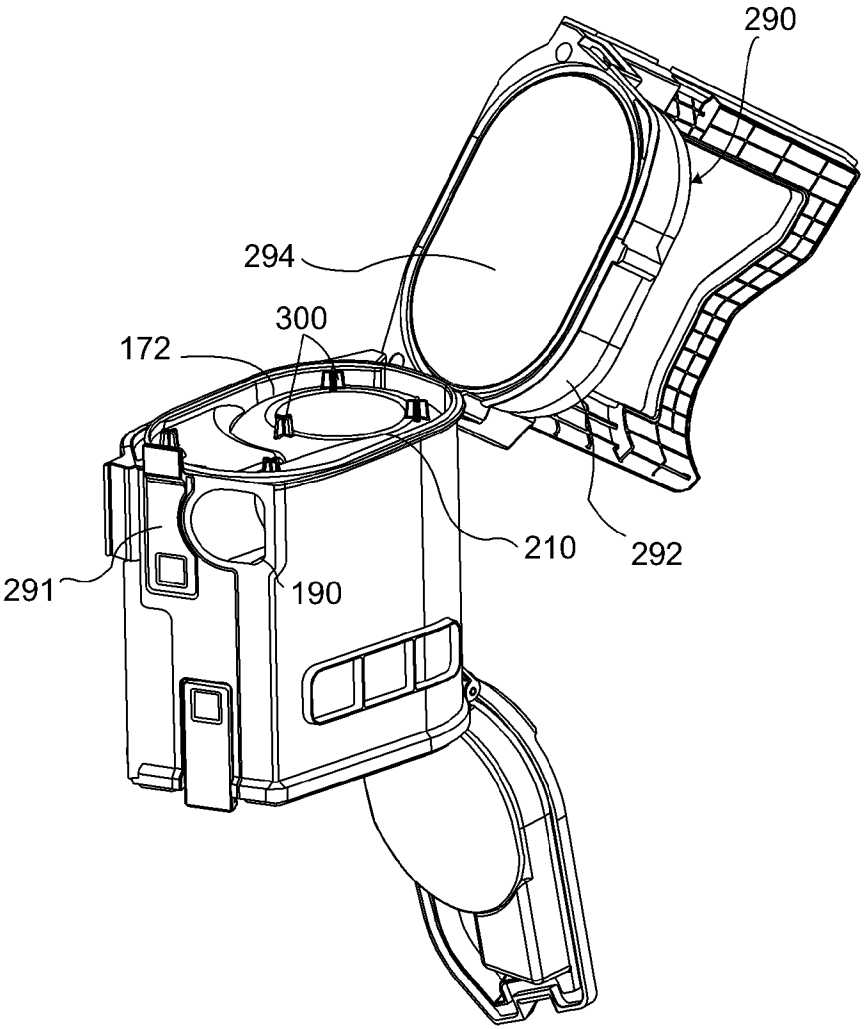
FIG. 23 is a perspective view of the cyclone bin assembly of FIG. 21 oriented with the filter chamber at the upper end, with a cyclone chamber door and a filter chamber open.

As exemplified in FIGS. 22 and 23, the sidewall 292 may be pivotally connected to the pre-motor filter chamber inner end wall 288 so that the end wall 290 and sidewall 292 can pivot together to open the pre-motor filter chamber 280. In this configuration, the sidewall 292 and end wall 290 may be sized to receive and retain the pre-motor filter 282 so that the pre-motor filter 282 is carried with the sidewall 292 and end wall 290 when the pre-motor filter chamber 280 is opened. Pivoting the pre-motor filter 282 in this manner can expose the upstream side 294 of the pre-motor filter to the user when the chamber 280 is opened. This may allow a user to inspect the upstream side 294 of the pre-motor filter 282 without having to touch or remove the pre-motor filter 282 from its housing 280. Alternatively, at least a portion of the sidewall 292 may fixedly connected to the end wall 288, and the end wall 290 may be movably connected to the sidewall 292. In this configuration, the end wall 290 can be opened to access the interior of the pre-motor filter chamber 280 while the sidewall 292 and pre-motor filter 282 can remain stationary.

The pre-motor filter chamber 280 is retained in the closed position by a releasable latch 291 as is known in the art (FIG. 23), which, like latch 268 is positioned so that it is inaccessible when the cyclone bin assembly 160 is mounted in the cavity 161.

In accordance with another feature, some or all of the pre-motor filter chamber sidewall 292, the pre-motor filter chamber outer end wall 290 and handle 408 may be a one piece assembly, such as by being manufactured separately and secured together or by being integrally formed together. An advantage of this feature is that the handle may be structurally connected to the cyclone bin assembly.

Optionally, the inner surfaces of the first and second end walls 288 and 290 of the pre-motor filter chamber 280 may be provided with support members, provided as a plurality ribs 300 in the example illustrated (FIG. 24) to help support the pre-motor filter 282 in a position where it is spaced apart from the inner surfaces of the end walls 288 and 290. Referring to FIG. 14, in this configuration, the pre-motor filter chamber 280 includes an upstream header 302 between the upstream side 294 of the pre-motor filter 282 and the end wall 288, and a downstream header 304 between the opposing downstream side 296 of the pre-motor filter 282 and the end wall 290. Air can travel from the upstream header 302 to the downstream header 304 by flowing through the pre-motor filter 282.

In accordance with another feature, the pre-motor filter chamber air outlet 308 and the suction motor air inlet 246 may be configured to meet each other in sealing plane 309 that is at an angle to the vertical. It will be appreciated that the surface cleaning apparatus 100 can be configured so that the sealing plane is vertical, horizontal or is at an angle relative to a vertical plane. In the illustrated example, the sealing plane 309 inclined relative to the vertical direction. This may help facilitate automatic re-connection of the air outlet 308 and the suction motor air inlet 246 when the cyclone bin assembly 160 is inserted generally vertically downwardly into the cavity 161. It will be appreciated that one or both of the inlet 246 and the air outlet 308 may be provided with a gasket, O-ring or the like.

In accordance with another feature, the pre-motor filter chamber may be configured to redirect the air from the cyclone chamber outlet to the suction motor inlet without the use of any conduit extending at an angle to the cyclone chamber and suction motor axis. Referring to FIG. 24, the pre-motor filter chamber 280 has a chamber air inlet 306 in communication with and aligned with the cyclone air outlet 186, and a chamber air outlet 308 (FIG. 20) that is connectable, and aligned with the air inlet 246 of the suction motor 162 (see also FIG. 14). Optionally, the chamber air inlet 306 and chamber air outlet 308 may be generally aligned with each other or alternatively, as exemplified, they may be offset from each other. Referring to FIG. 14, in the illustrated example, the centerline 310 of the pre-motor filter chamber air inlet 306 is aligned with the cyclone axis 174 and is offset from the centerline 312 of the pre-motor filter chamber air outlet 308, which is aligned with the suction motor axis 182. If the pre-motor filter chamber has an upstream and a downstream header, the air entering the upstream header may be spread out over the upstream surface of the pre-motor filter and travel through the pre-motor filter. The air will enter the downstream header and exit through the outlet 308. In this way, the air is aligned with the suction motor inlet without any curved or angled flow conduits.

The pre-motor filter may be any suitable type of filter. Referring also to FIG. 24, in the illustrated example the pre-motor filer 282 includes a foam filter 284 and a downstream felt layer 286 that are both positionable within the pre-motor filter chamber 280. In this configuration the foam filter 284 comprises the upstream side 294 of the pre-motor filter and the felt layer 286 provides the downstream side 296 of the pre-motor filter 282. Preferably, the foam filter 284 and felt layer 286 are removable to allow a user to clean and/or replace them when they are dirty. In alternate embodiments, any pre-motor filter or filters known in the art may be used.

In accordance with another feature, the cyclone bin assembly 160 may be removable from the surface cleaning head 102 as a closed module, where the only portions the cyclone bin assembly 160 that are open when the cyclone bin assembly 160 is removed from the cavity 161 are the inlet end 190 of cyclone air inlet 184 and pre-motor filter chamber air outlet 308 (see for example FIG. 20).

Alternately, or in addition, the cyclone bin assembly may be configured to inhibit dirt collected in the cyclone chamber and/or the dirt collection chamber from exiting the cyclone bin assembly as the cyclone bin assembly is conveyed to an emptying location. As exemplified in FIG. 12, the outlet end 194 of the cyclone air inlet 184 may be axially spaced from the dirt inlet to the dirt collection chamber 166 to help reduce the likelihood that debris from the dirt collection chamber 166 will escape via the cyclone air inlet 184 when the cyclone bin assembly 160 is detached. When the surface cleaning apparatus is in use, dust and fine debris flowing into the pre-motor filter chamber 280 may tend to be collected on the upstream side 294 of the pre-motor filter 282, which leaves the downstream side 296 of the pre-motor filter 282 as the relatively clean side. In the illustrated example, the pre-motor filter chamber air outlet 308 is in communication with the downstream side 296 of the pre-motor filter 282. As the downstream side 296 tends to be the cleaner side of the pre-motor filter 282, this configuration may help reduce the likelihood that dust and debris can escape the cyclone bin assembly 160 via the pre-motor filter chamber air outlet 308. Configuring the cyclone bin assembly 160 in this manner may help prevent dirt and debris from spilling out of the cyclone bin assembly 160 when it is transported to the garbage for emptying.

Figure 30:
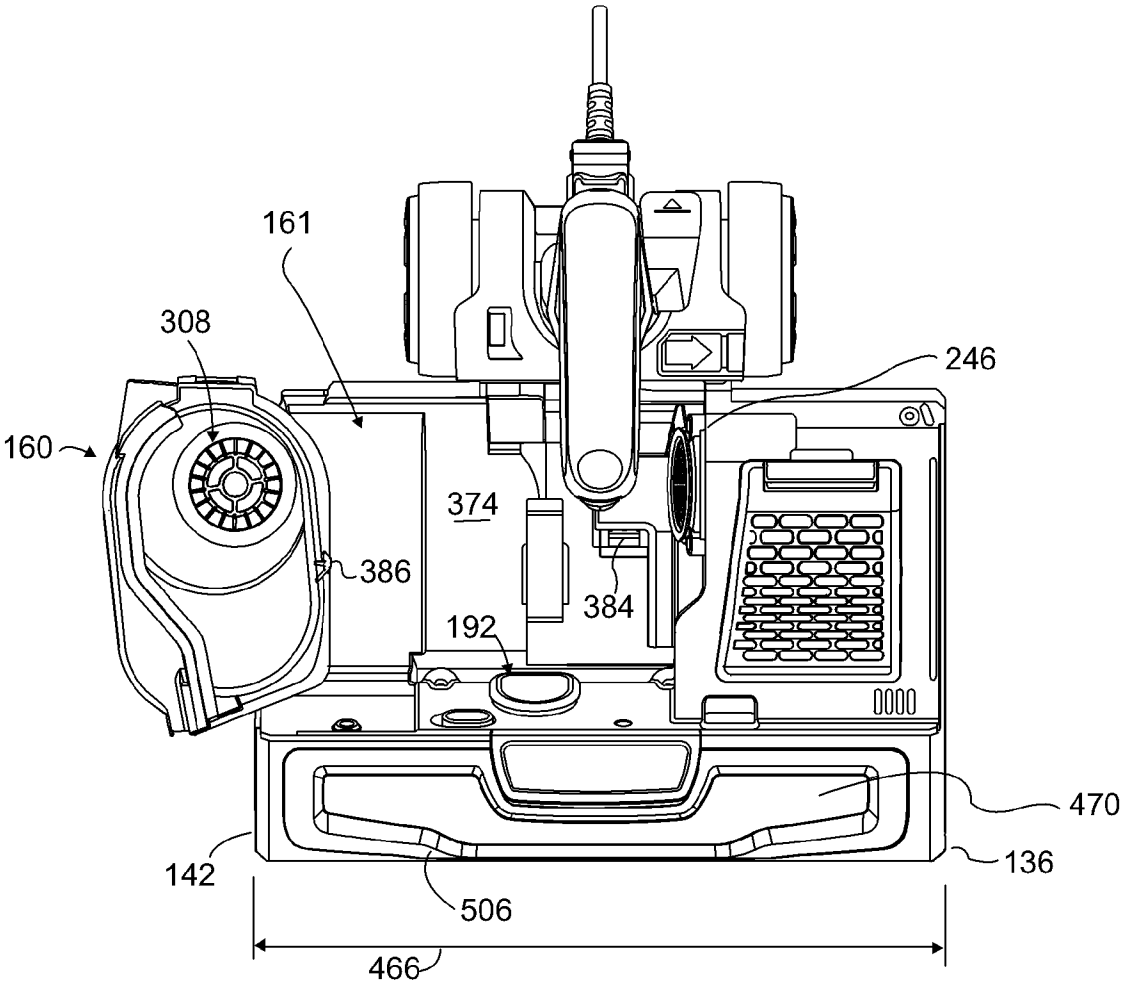
FIG. 30 is to top view of the surface cleaning apparatus of FIG. 1 with the cyclone bin assembly in a removal position and with the brush chamber open.

Referring to FIG. 30, in the illustrated example, removing the cyclone bin assembly 160 from the cavity 161 reveals the air inlet 246 of the suction motor 162 and the air outlet 192 of the brush chamber 130. Replacing the cyclone bin assembly 160 automatically re-establishes the respective connections between the pre-motor filter chamber air outlet 308 and the suction motor air inlet 246, and between the upstream end 190 of the cyclone air inlet 184 and the brush chamber air outlet 192.

Optionally, part or all of the sidewalls 292 of the pre-motor filter chamber can be at least partially transparent so that a user can visually inspect the condition of the pre-motor filter 282 without having to remove open the pre-motor filter chamber 280 or remove the cyclone bin assembly 160 from the cavity 161.

It will be appreciated that some of the embodiments disclosed herein may not use any of the features of the pre-motor filter chamber disclosed herein and that, in those embodiments, the pre-motor filter chamber may be of various constructions and that in those embodiments any pre-motor filter chamber known in the art may be used.

Suction Motor & Brush Motor

The following is a description of a configuration of a suction motor and a configuration of a brush motor in a surface cleaning head, wither or both of which may be used by themselves in any surface cleaning apparatus or in any combination or sub-combination with any other feature or features disclosed herein.

Referring to FIGS. 12 and 13, the suction motor 162 has a first end 176 and a second end 178 that are axially spaced apart from each other by a suction motor length 180, along a suction motor axis 182, about which the rotor of the suction motor 162 rotates. In accordance with one configuration, as exemplified in FIGS. 12 and 13, the cyclone axis 174 and suction motor axis 182 are parallel to each other and extend in the transverse direction, generally orthogonally to the forward direction of travel of the surface cleaning head. An advantage of this configuration is that are may travel generally linearly between the cyclone chamber and the suction motor.

In the illustrated example, the suction motor air inlet 246 is located at the first end 176 of the suction motor 162 and is in air flow communication with the cyclone air outlet 186. The suction motor also includes an air outlet 270 that is provided in a motor housing sidewall 272 and is in air flow communication with the clean air outlet 112 via an internal air flow conduit.

Referring to FIG. 13, in the illustrated example, the suction motor air inlet 246 is positioned so that air flowing into the air inlet 246 travels in the transverse direction. The suction motor air inlet 246 is also positioned so that when the cyclone bin assembly 160 is mounted on the surface cleaning head 102 the second end 170 of the cyclone chamber 164 is generally opposed to and faces the first end 176 of the suction motor 162, with the pre-motor filter chamber 280 positioned laterally therebetween. Further, in the illustrated example, the cyclone air outlet 186 faces and partially overlaps the air inlet 246 of the suction motor 162. However, the cyclone air outlet 186 may be slightly offset from the suction motor air inlet 246, and in the example illustrated the centerline of the cyclone air outlet 186 (which in the example illustrated coincides with the cyclone axis 174) is offset from the centerline of the suction motor air inlet 246 (which in the example illustrated coincides with the suction motor axis 182).

Referring also to FIG. 12, the surface cleaning head 102 also includes a brush motor 214 that is drivingly connected to the rotatable brush 132 by a drive linkage 216, which in the illustrated example includes a drive belt. The brush motor 214 has a first end 218 and a second end 220 that are spaced apart from each by a brush motor length 222 other, along a brush motor axis 224, about which the rotor of the brush motor 214 rotates. It will be appreciated that brush motor 214 may be of any design and may be drivingly connected to the brush 132 by any means known in the art such as a direct gear drive. In some embodiments, the brush motor may be incorporated into the brush 132 (e.g., it may be positioned internally or along the length of brush 132.

In accordance with another configuration, as exemplified in FIGS. 12 and 13, brush motor 214 may be positioned adjacent to and forward of the suction motor 162 in the direct of travel of the surface cleaning head 102. Alternatively, the brush motor may be located behind the suction motor. An advantage of this design is that the brush motor may overlie part or all of the dirt collection chamber. Further, part or all of the pre-motor filter chamber may be positioned between the brush motor and the dirt collection chamber enabling large upstream cross-sectional area of the pre-motor filter.

Optionally, at least a portion of the brush motor may be located transversely between the first and second ends of the suction motor. The amount of the brush motor that transversely overlaps (e.g., extends parallel to) the suction motor, in the direction parallel to suction motor axis, may be between about 10% and 100% of the length of the brush motor, and preferably between about 50% and 100% and more preferably between about 70% and about 100%. At least partially overlapping the brush motor and suction motor in this manner may help reduce the overall size of the surface cleaning head. Referring to FIG. 12, in the illustrated example the first end 218 of the brush motor 214 is generally aligned with the first end 176 of the suction motor 162 in the transverse direction, and the second end 220 of the brush motor 214 is disposed between the first and second ends 176, 178 of the suction motor 162 in the transverse direction. In this configuration, substantially the entire brush motor 214 is located between the first and second ends 176, 178 of the suction motor 162. This enables the dirt collection chamber to extend forwardly from the cyclone chamber and occupy a space transversely opposed to the brush motor.

Figure 18:
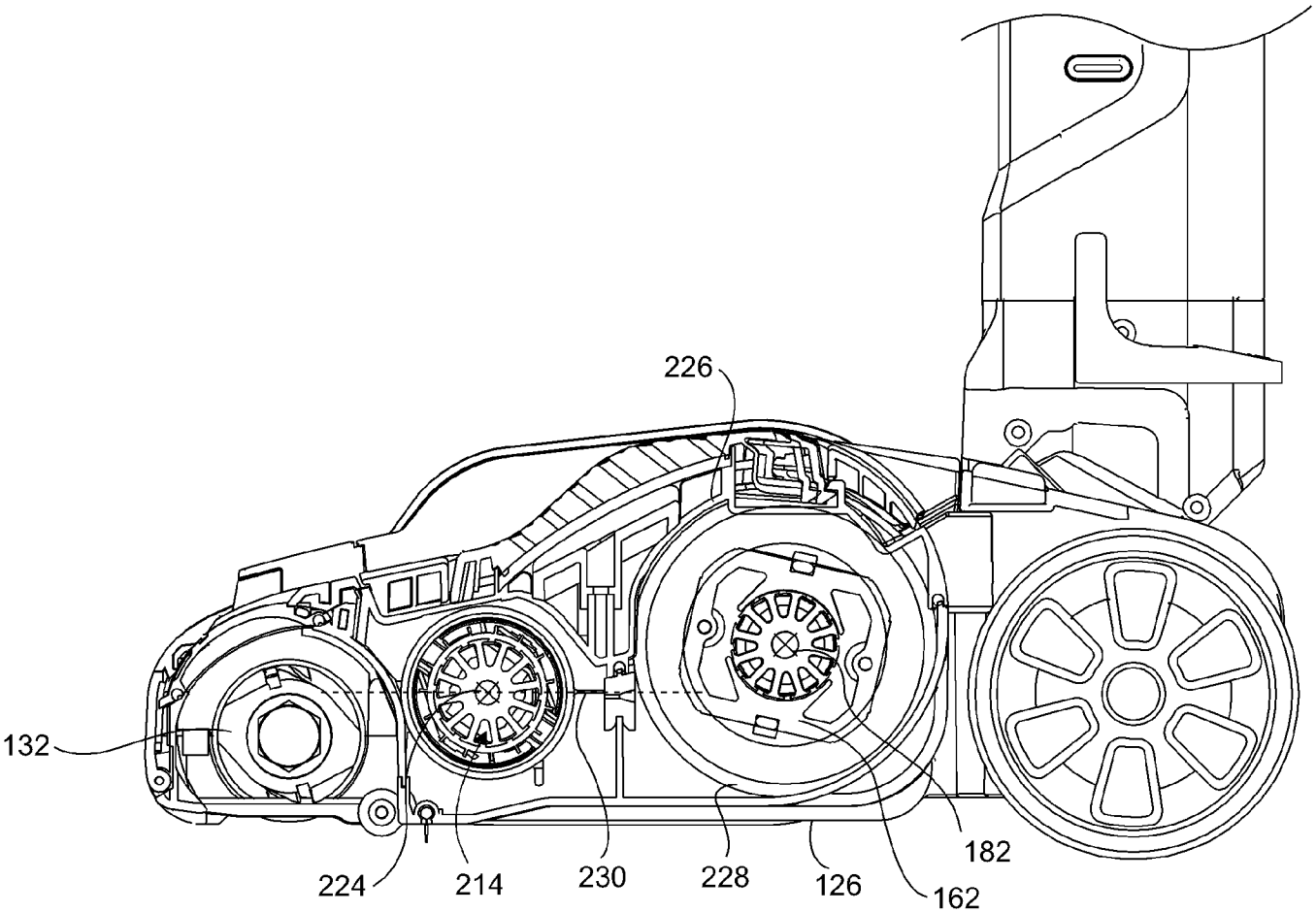
FIG. 18 is cross-sectional view of the surface cleaning apparatus of FIG. 1, taken along line 18-18, which is shown in FIG. 7.

In accordance with another configuration, as exemplified in FIG. 18, the brush motor may be vertically positioned with respect to the suction motor so as to not extend above or below the suction motor. An advantage of this configuration is that the brush motor does not affect the height of the surface cleaning head. As exemplified in FIG. 18, the suction motor 162 has an upper end 226, and an opposed lower end 228 located adjacent the bottom face 126 of the surface cleaning head 102. In the illustrated example, the brush motor 214 is positioned vertically within the surface cleaning head 102 so that the brush motor axis 224 is located vertically between the upper and lower ends 226 and 228 of the suction motor 162 such that a horizontal plane 230 containing the brush motor axis 224 intersects the suction motor 162.

Alternately, or in addition, as exemplified in FIG. 14, the brush motor is also located vertically between an upper end 232 and an opposed lower end 234 of the cyclone chamber 164 such that the horizontal plane 230 also intersects the cyclone chamber 164 and the dirt collection chamber 166. In the illustrated example, the upper end 232 and lower end 234 are portions of the cyclone chamber sidewall 173, and also form portions of the exposed, outer surface of the cyclone bin assembly 160.

In accordance with another configuration, as exemplified in FIGS. 12 and 13, the brush motor 214 may at least partially overlap the cyclone bin assembly 160 in the forward/backward direction. This may help reduce the overall size of the surface cleaning head. In this configuration, the laterally inner end 218 of the brush motor 214 may face, and at least partially overlap the laterally inner end of the cyclone bin assembly 160. Optionally, the inner end of the brush motor may face and overlap at least a portion of an end face of the cyclone chamber and/or at least a portion of the dirt collection chamber. Referring to FIG. 12, in the illustrated example, the laterally inner, first end 218 of the brush motor 214 opposes and faces towards the laterally inner, end of the cyclone bin assembly 160. Specifically, the first end of the brush motor opposes and faces towards the second end wall 242 of the dirt collection chamber 166 and the end wall 290 of the pre-motor filter chamber 280. It will be appreciated that if the pre-motor filter chamber did not overlap the dirt collection chamber, then the brush motor 214 may directly face the dirt collection chamber and may extend closer thereto.

In accordance with this configuration, the brush motor may overlap all or a significant portion of the dirt collection chamber (e.g., 50% or more, 75% or more, 80% or more or 90% or more). Further, the brush motor may not overlap any or only a small portion of the cyclone chamber (e.g., it may overlap 25% or less, 15% or less, 10% or less). As exemplified in FIG. 12, the brush motor 214 is offset forwardly from the cyclone chamber 164 in the direction of travel of the surface cleaning head 102 (downward as illustrated in FIG. 12) such that the brush motor 214 does not impinge on the projection of the cross-sectional area of the cyclone chamber 164 in the transverse direction. The brush motor 214 does however, in the example illustrated, overlap with a portion of the dirt collection chamber 166 and the pre-motor filter chamber 280. An advantage of this design, as is discussed subsequently, is that the suction motor and the cyclone chamber may have comparable diameters and the cyclone air outlet and the suction motor inlet may have comparable diameters. Accordingly, each of the suction motor and the cyclone chamber may be sized for a similar air flow therethrough and, accordingly, flow of air through the suction motor and the cyclone chamber may produce less back pressure. Further, the brush motor is oriented and sized to fit in a space opposed to the dirt collection chamber and between the suction motor and the brush chamber.

In accordance with another configuration, the suction motor may at least partially overlap or overlie the cyclone bin assembly in the forward/backward direction. In this configuration, the laterally inner end of the suction motor may face, and at least partially overlap the laterally inner end of the cyclone bin assembly. Optionally, the inner end of the suction motor may face and overlap at least a portion of an end face of the cyclone chamber and/or at least a portion of the dirt collection chamber. This may help reduce the overall size of the surface cleaning head. For example, the suction motor may overlap all or a significant portion of the cyclone chamber (e.g., 50% or more, 75% or more, 80% or more or 90% or more) and it may not overlap any or only a small portion of the dirt collection chamber (e.g., it may overlap 25% or less, 15% or less, 10% or less). Referring to FIG. 12, in the illustrated example, the laterally inner, first end 176 of the suction motor 162 opposes and faces the laterally inner, end of the cyclone bin assembly. Specifically, the first end 176 of the suction motor 162 opposes and directly faces the end wall 290 of the pre-motor filter chamber 280, overlies the second end wall 171 of the cyclone chamber 164, and is spaced rearwardly from the second end wall 242 of the dirt collection chamber 166. In this configuration, the inner end of the cyclone bin assembly (provided by the end wall 290) faces/overlies both the first end 176 of the suction motor 162 and the first end 218 of the brush motor 214.

In accordance with another configuration, the suction motor and the brush motor may both be provided in the same lateral side, and preferably in the same lateral half (in a lateral direction) of the surface cleaning head. This may help provide space in the other lateral side of the surface cleaning to accommodate the cyclone chamber, dirt collection chamber and/or pre-motor filter chamber. In the illustrated example, the suction motor 162 and brush motor 214 are both entirely provided on the same lateral side of transverse centerline 314 of the surface cleaning head 102, and are therefore in the same half of the surface cleaning head 102 (the right half as shown in FIG. 12). The cyclone chamber 164 and dirt collection chamber 166 are each located on the opposite side of the lateral centerline 314. The pre-motor filter chamber 280, and the pre-motor filter itself 282, are, in the example illustrated, intersected by the lateral centerline 314.

In accordance with another configuration, both the brush axis 134 and brush motor axis 224 are parallel to, and offset from, the cyclone axis 174 and the suction motor axis 182. In the illustrated configuration, the brush motor axis 224 intersects the pre-motor filter chamber 280, the pre-motor filter 282 and the dirt collection chamber end wall 242. Aligning the cyclone chamber 164, suction motor 162 and brush motor 214 in this manner may help reduce the overall size of the surface cleaning head 102.

In accordance with another configuration, as exemplified in FIGS. 12-14, the cyclone axis 174 may be located forward and at a higher elevation than the motor axis 182, and behind and at a higher elevation than the brush motor axis 224. The suction motor axis 182 may also be located behind and at a higher elevation than the brush motor axis 224. Offsetting the axes of the cyclone, suction motor and brush motor may help nest the components together, which may help reduce the overall size of the surface cleaning apparatus.

It will be appreciated that some of the embodiments disclosed herein may not use any of the features of the suction motor and brush motor disclosed herein and that, in those embodiments, the suction motor and brush motor may be of various constructions and arranged in any configuration.

Mounting Hub

The following is a description of a mounting hub having various features, any or all of which may be used (individually or in any combination or sub-combination), by itself in any surface cleaning apparatus or in any combination or sub-combination with any other feature or features disclosed herein. Rear wheels and/or the drive handle may be connected to the mounting hub. The mounting hub is positioned at the rear end of the surface cleaning head and exterior to the interior space of the surface cleaning head. Accordingly the pivot mount and/or the rear wheel mount need not be within the enclosed volume of the surface cleaning head and may thereby reduce the foot print and/or height of the surface cleaning head.

Figure 1:
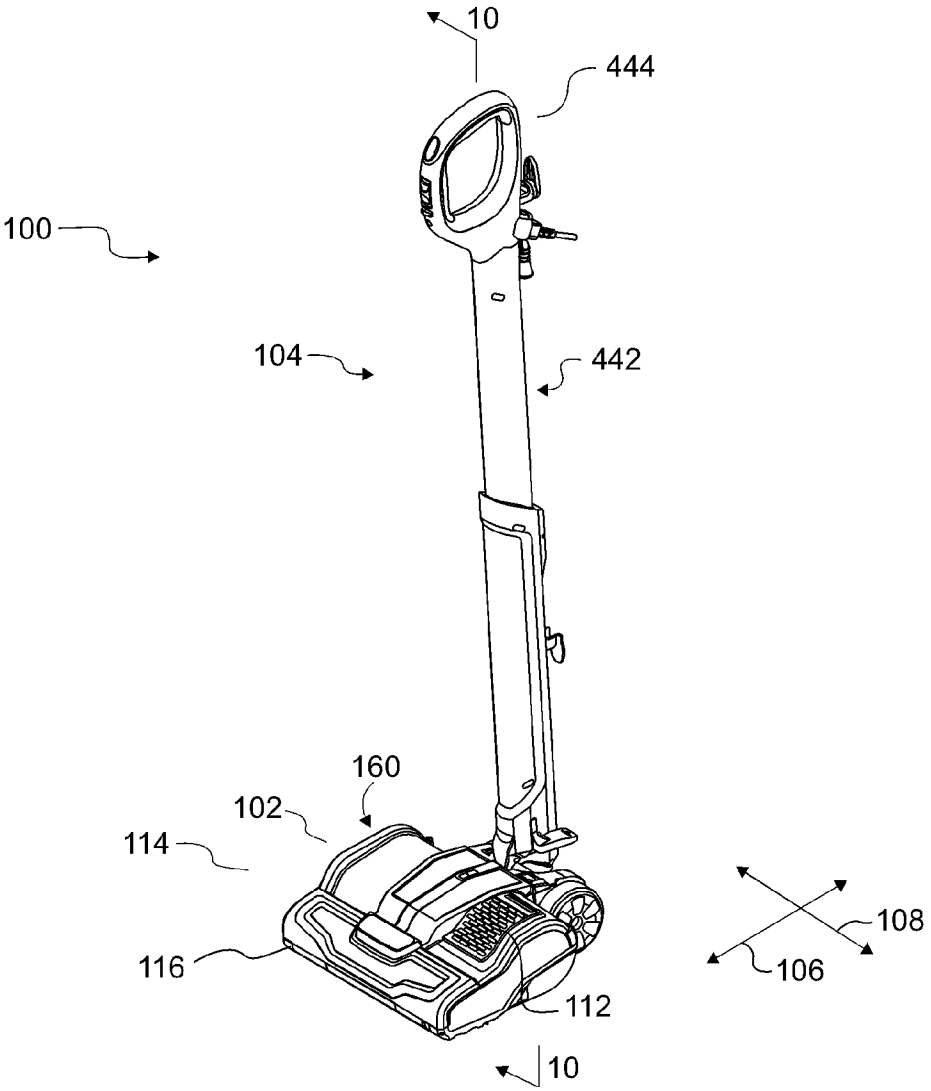
FIG. 1 is a front perspective view of an example of an all in the head type surface cleaning apparatus.
Figure 2:
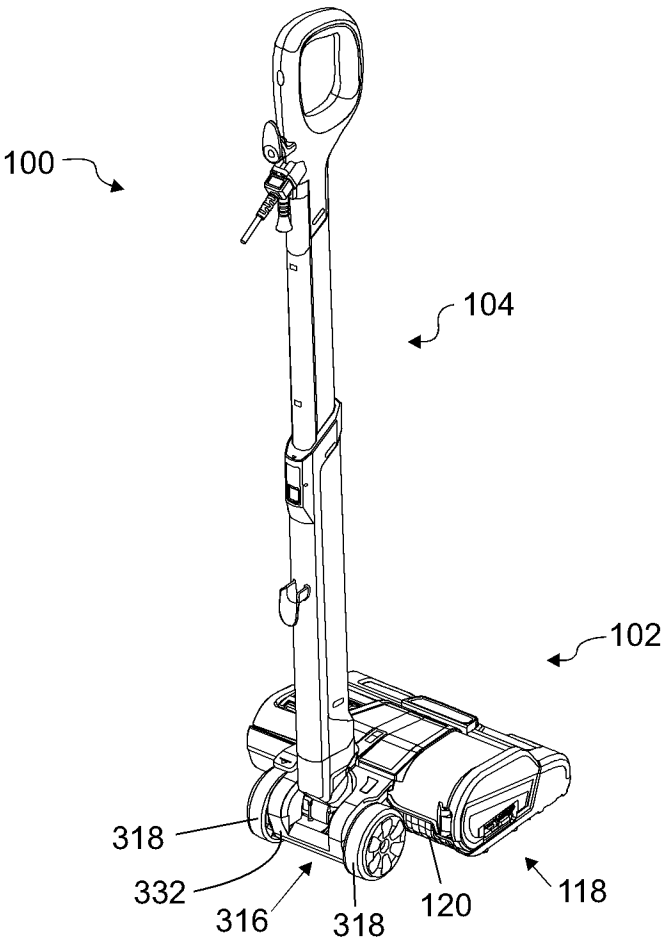
FIG. 2 is a rear perspective view of the surface cleaning apparatus of FIG. 1.

As exemplified in FIG. 2, the surface cleaning apparatus 100 may include a mounting hub 316 positioned at the rear end 118 of the surface cleaning head 102, rearward of the rear face 120 (rear face 120 defining the rear end of the interior volume provided by the surface cleaning head). Mounting hub 316 may be provided as part of the surface cleaning head and may be a one piece assembly and may be integrally molded with one of the components of the surface cleaning head.

Figure 15:
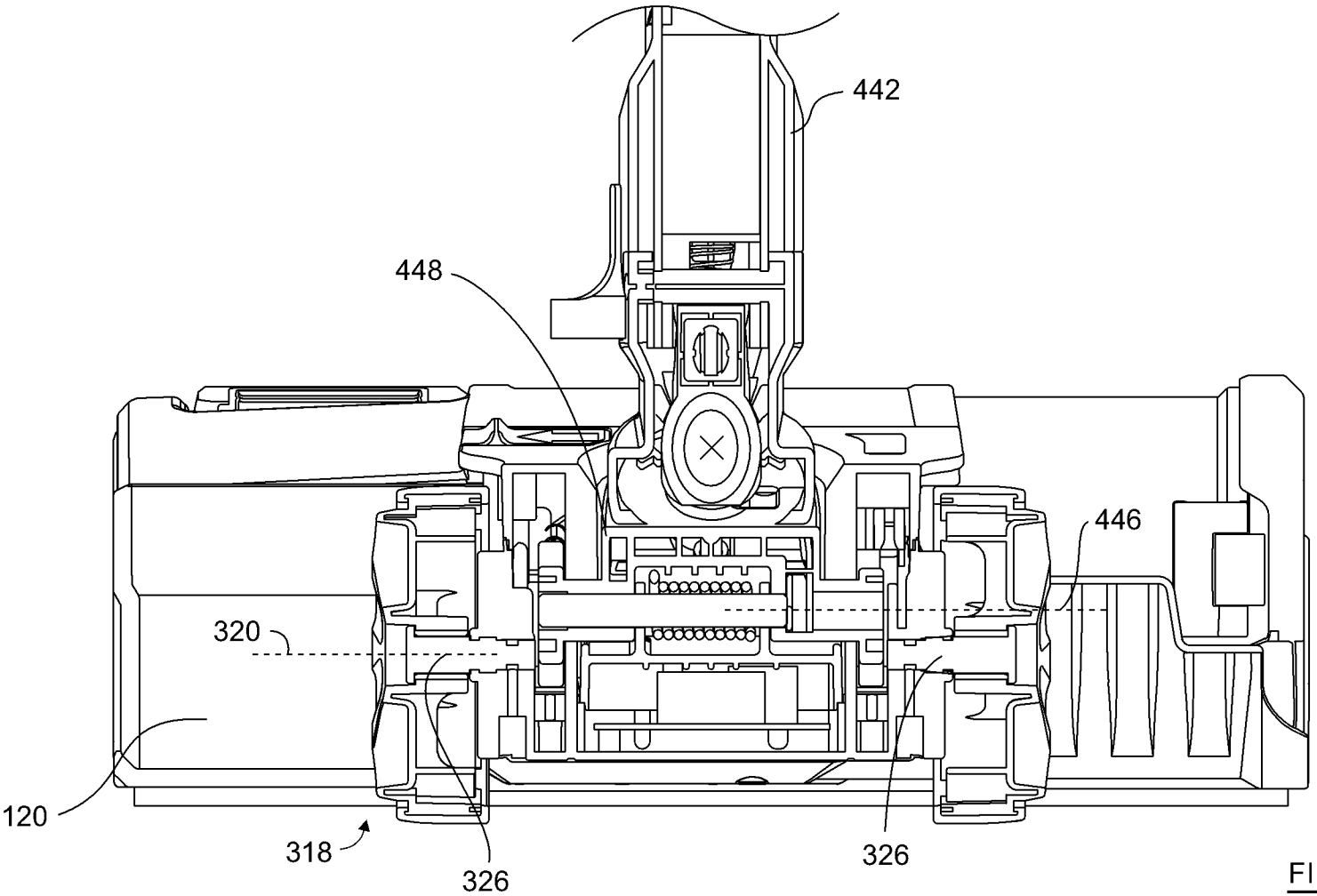
FIG. 15 is cross-sectional view of the surface cleaning apparatus of FIG. 1, taken along line 15-15, which is shown in FIG. 4.

As exemplified in FIGS. 8 and 15, the surface cleaning head 102 is supported by a pair of rear wheels 318, which are rotatable about a rear wheel axis 320, and a pair of smaller front wheels 322 rotatable about a front wheel axis 324. Rear wheels 318 are rotatably mounted to the mounting hub 316 using axles 326 (See FIG. 15). In this example, the rear wheels 318 are positioned rearward of the suction motor 162 and cyclone bin assembly 160.

In the illustrated example, the mounting hub 316 includes a top wall 328 (FIG. 3), a bottom wall 330 (Figured 8), a rear wall 332 and two sidewalls 334 (FIG. 8). The sidewalls 334 are spaced apart by a mounting hub width 336 in the transverse direction. In the illustrated example, the mounting hub width 336 is less than the width 338 of the surface cleaning head 102, and is selected so that the rear wheels 318 are recessed laterally inwardly from the side walls 124 of the surface cleaning head 102 by respective recessed distances 340. The width 338 of the surface cleaning head 102 may be any suitable width to accommodate the components within the cleaning head, and optionally may be less than about 20 inches, less than about 15 inches, less than about 13 inches, less than about 12.5 inches, and optionally less than about 12 inches. The recessed distances can be any suitable distance, and optionally can be between about 5% and about 80% or more of the distance 344 between the central axis and the respective sidewall 124 of the surface cleaning head 102. Preferably, the recessed distances 340 are at least about 10%, and more preferably may be at least about 20% of the distance 344. While illustrated as generally symmetrical, in other embodiments the recessed distances 340 may be different from each other. An advantage of this feature is that the rear wheels are spaced apart sufficiently to provide stability to the surface cleaning head but are spaced transversely inwardly so as to places the wheels away from objects (e.g., furniture) which they might otherwise contact as the surface cleaning head is used.

Referring also to FIG. 12, in this configuration, a laterally outer surface 342 of the rear wheel 318 illustrated on the right side of FIG. 12 is disposed laterally between the first and second ends 176 and 178 of the suction motor 162, and a laterally outer surface 342 of the rear wheel 318 illustrated on the left side of FIG. 12 is disposed laterally between the first and second ends 168 and 170 of the cyclone chamber 164. The lateral spacing between the rear wheels (which is generally equal to the mounting hub width 336) can be selected so that the pre-motor filter chamber 280 may be located laterally between one of the rear wheels 318 and a side wall 124 of the surface cleaning head 102 (e.g., on the rear face of the surface cleaning head).

Referring also to FIG. 8, in this configuration, the rear wheels 318 are generally, laterally aligned with the front wheels 322 so that a plane containing the laterally outer face of each rear wheel 318 intersects a respective front wheel 322.

Providing a mounting hub to support the rear wheels, and optionally other components (such as the upper portion and release actuators described herein) may help preserve the space within the interior of the surface cleaning head to accommodate air flow components. This configuration may also help facilitate a desired arrangement for the rear wheels as the axles and other connectors within the mounting hub do not interact with or interfere with the air flow components provided within the interior of the surface cleaning head.

In this illustrated example, the rear wheels 318 have a rear diameter 346 (Figured 8) that is larger than the diameter of the front wheels 322, and the rear wheel axis 320 is located rearward of the front wheel axis 324 in the direction of travel, and at a higher elevation than the front wheel axis 324. In the illustrated example, the rear wheel axis 320 extends in the transverse direction and, in the example illustrated, is parallel to the cyclone axis 174, the suction motor axis 182, the brush motor axis 224 and the brush axis 134.

Referring to FIG. 8, in the illustrated example the front wheels 322 are positioned along the back edge 146 of the dirty air inlet 110 and extend at least partially into the brush chamber 130.

Optionally, in addition to the front wheels 322, the surface cleaning apparatus may include one or more rolling support members. In the illustrated example the surface cleaning apparatus includes rolling support members in the form of rollers 348 that are positioned adjacent the front wheels 322. The rollers 348 may be co-axial with the wheels 322 so that they rotate about the front wheel axis 324. The rollers have a roller diameter 350 that is slightly less than the front wheel diameter 352, and a roller width 354 that is greater than the front wheel width 356. In the example illustrated, the roller width 354 is also greater than the rear wheel width 358. Providing relatively wide rollers 348 may help distribute the weight of the surface cleaning apparatus 100 over a larger surface area of the surface being cleaned. Distributing the weight of the apparatus over a larger area may help support the apparatus when it is being rolled across relatively soft surfaces, such as carpets and other floor coverings. Distributing the weight may help prevent the surface cleaning apparatus 100 from sinking into soft floor coverings, which may help reduce the amount of force required from a user to move the surface cleaning apparatus across the floor coverings. When the surface cleaning apparatus 100 is moved across relatively hard surfaces (such as wood and/or tile flooring) it may be desirable to support the surface cleaning head 102 using the front wheels 322 and rear wheels 318, without engaging the rollers 348. Sizing the rollers 348 to have a smaller diameter than the front wheels 322 may allow the rollers 348 to remain spaced apart from hard surfaces that are engaged by the front wheels 322.

Providing the front wheels 322 and/or optional rollers 348 adjacent the rear edge 146 of the dirty air inlet 110 may help keep the rear edge 146 spaced apart from surface being cleaned. It may also help lift the rear edge 146 of the dirty air inlet 110 over obstacles and/or transitions between flooring types and reduce the likelihood of the dirty air inlet 110 becoming hung-up or otherwise inhibiting forward movement of the surface cleaning head 102.

It will be appreciated that some of the embodiments disclosed herein may not use any of the features of the mounting hub disclosed herein and that, in those embodiments, the mounting hub may be of various constructions or a mounting hub may not be used. For example, the mounting hub may be configured so that the rear wheels are positioned laterally outboard of the surface cleaning head, or the rear wheels may be mounted to the sidewalls of the surface cleaning head and the surface cleaning apparatus need not include a mounting hub.

Cyclone Bin Assembly Removal and Latching/Release Mechanism

The following is a description of a cyclone bin assembly latching and release mechanism having various features, any or all of which may be used (individually or in any combination or sub-combination), by itself in any surface cleaning apparatus or in any combination or sub-combination with any other feature or features disclosed herein.

As mentioned herein, preferably the cyclone bin assembly 160 is removable from the cavity 161 on the surface cleaning head. Preferably, to help facilitate removal of the cyclone bin assembly 160, the cyclone bin assembly 160 can be movable from a use or cleaning position (for example FIGS. 1-10 and 46) to a removal position (for example FIGS. 28-32 and 47). In the cleaning position, the cyclone bin assembly 160 may provide the air flow connection between the dirty air inlet 110 and the suction motor 162, and ultimately the clean air outlet 112. In the removal position, the cyclone bin assembly 160 is positioned so that air flow communication between the dirty air inlet 110 and the suction motor 162 is interrupted and the cyclone bin assembly is positioned to enable a user to remove the cyclone bin assembly from the surface cleaning head.

For example, when the in the cleaning position, the upstream end 190 of the cyclone air inlet 184 may be in air flow communication with the air outlet 192 of the brush chamber 130, and the air outlet of the cyclone bin assembly 160 (i.e. the pre-motor filter chamber air outlet 308 in the example illustrated) may be in air flow communication with the air flow path leading to the suction motor (e.g. suction motor air inlet 246). In this configuration, the surface cleaning apparatus 100 is useable to clean the floor.

In contrast, when the cyclone bin assembly 160 is moved to the removal position, air flow communication between the cyclone bin assembly 160 and the rest of the air flow path is interrupted. However, when in the removal position, the cyclone bin assembly may continue to be at least partially, and preferably entirely, supported by the surface cleaning apparatus (e.g., the surface cleaning head). This may allow a user to move the cyclone bin assembly into the removal position without having to lift or remove the cyclone bin assembly or support its weight.

In accordance with one feature, the cyclone bin assembly 160 may be moved relative to the surface cleaning apparatus when transitioning from the cleaning position to the removal position. For example, the cyclone bin assembly 160 may translate, pivot, rotate or otherwise move relative to other portions of the surface cleaning apparatus (such as the surface cleaning head 102) when transitioning from the cleaning position to the removal position. Moving the cyclone bin assembly 160 and/or changing its orientation when transitioning from the cleaning position to the removal position may help position the cyclone bin assembly in a position that is relatively easier to access for a user. For example, when the cyclone bin assembly 160 is in the cleaning position it may be substantially or fully nested within the cavity 161 on the surface cleaning head 102 and may be disposed relatively close to the ground.

In accordance with another feature, the surface cleaning apparatus 100 may be configured so that when the cyclone bin assembly 160 is transitioned to the removal position it is arranged in a position that is more convenient for a user to reach it, including, for example, by moving portions of the cyclone bin assembly 160 to higher elevations and/or by exposing features (such as handles) that are exposed for access by a user in the removal position and are less exposed, or inaccessible, when in the cleaning position.

In accordance with another feature, the cyclone bin assembly 160 may be biased toward or into one, or both of the cleaning position and the removal position. Preferably, the cyclone bin is at least biased toward the removal position. Accordingly, when a lock that secures the cyclone bin assembly 160 in the use position is released, the cyclone bin assembly 160 may be moved sufficiently out of the cavity 161 (e.g., by moving a handle away from the surface cleaning head) to assist a user to pick up and remove the cyclone bin assembly 160 from the surface cleaning head. Alternately, or in addition, the lock release actuator (e.g., foot pedal 388) may drive a mechanical member that moves the cyclone bin assembly to the removal position.

In accordance with another feature, the cyclone bin assembly 160 may be securable in one or both of the cleaning and removal positions using a lock. The lock may be any suitable apparatus, and optionally can be configured to lock the cyclone bin assembly in the cleaning position until the lock is released. Preferably, the lock may be automatically re-engaged when the cyclone bin assembly is moved into the cleaning position so that the cyclone bin assembly will be held in place without requiring a user to manually re-latch or reengage the lock. The lock may be configured to engage one or both of the cradle and the cyclone bin assembly, or any other suitable component of the surface cleaning apparatus.

Figure 28:
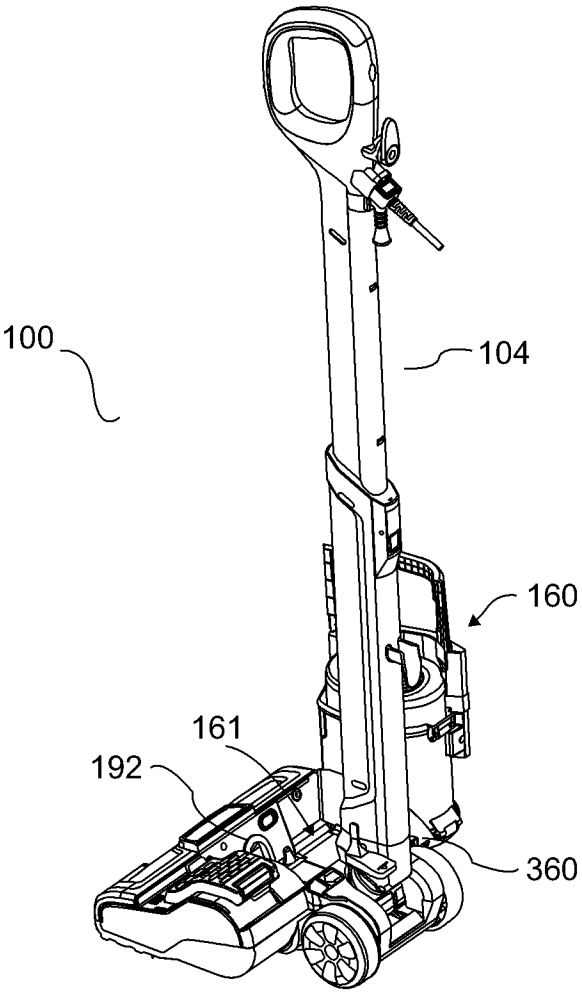
FIG. 28 is a rear perspective view of the surface cleaning apparatus of FIG. 1 with the cyclone bin assembly in a removal position.

As exemplified, cyclone bin assembly 160 is positionable between a cleaning position (FIG. 1) and a removal position (FIG. 28). To help facilitate access and removal of the cyclone bin assembly 160, the cyclone bin assembly 160 is pivotal, relative to the surface cleaning head 102, into in a removal position (FIG. 28), in which the cyclone bin assembly 160 is supported on the surface cleaning head 102, but the air flow communication between the cyclone air inlet 184 and the brush chamber air outlet 192, and between the pre-motor filter chamber air outlet 308 and the suction motor air inlet 246 is interrupted. As exemplified, the laterally inward end of the cyclone bin assembly, comprising the pre-motor filter chamber 280, moves upwardly and pivots toward the lateral side wall 124 of the surface cleaning head 102.

In accordance with another feature, the surface cleaning apparatus may include a moveable support or platform member that at least partially supports, and may fully support, the cyclone bin assembly in the removal position. Preferably, the cyclone bin assembly may be mounted to and supported by (e.g., locked to) the movable platform member, such that movement of the moveable platform results in a corresponding movement of the cyclone bin assembly.

Figure 37:
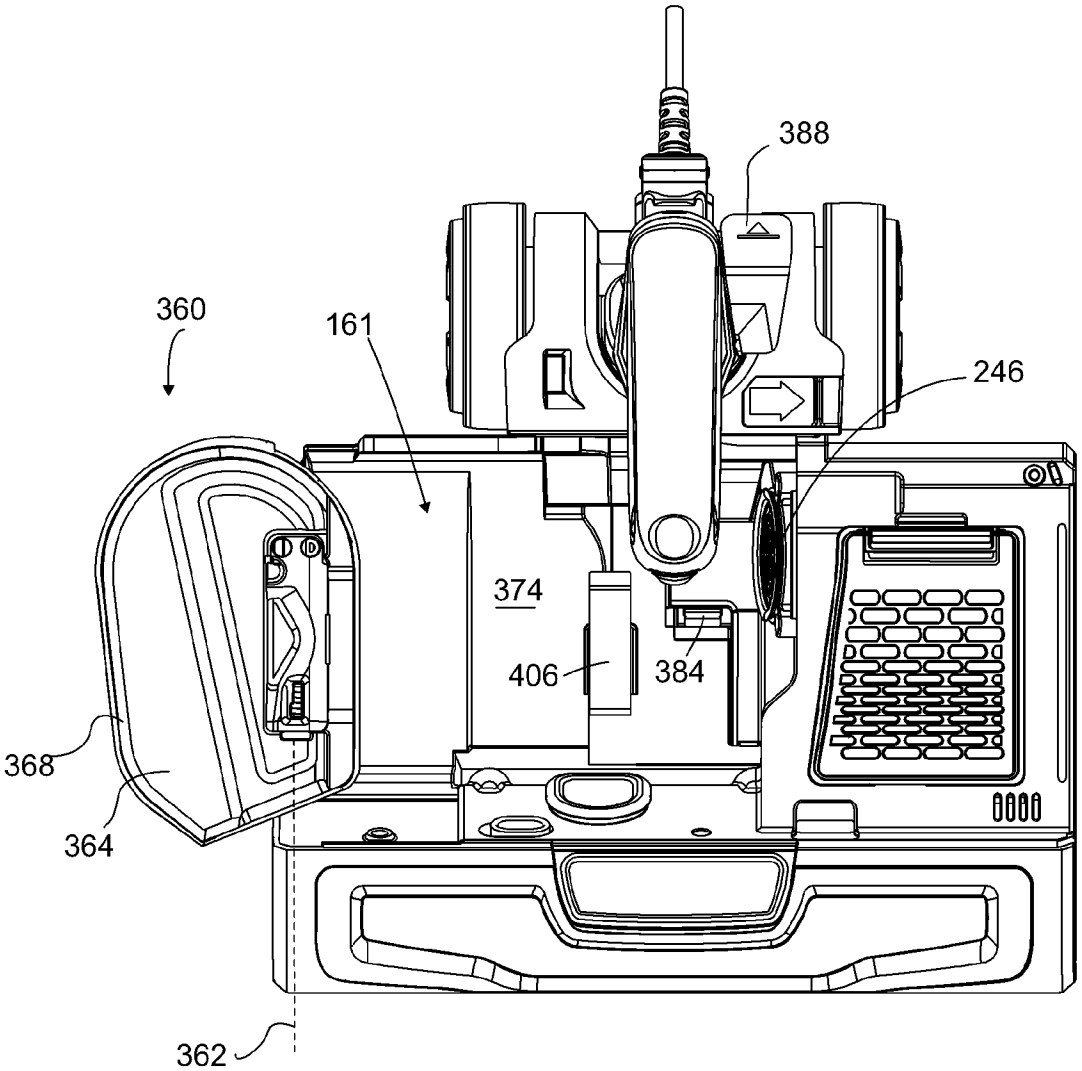
FIG. 37 is a top view of the portion of the surface cleaning apparatus of FIG. 36.
Figure 38:
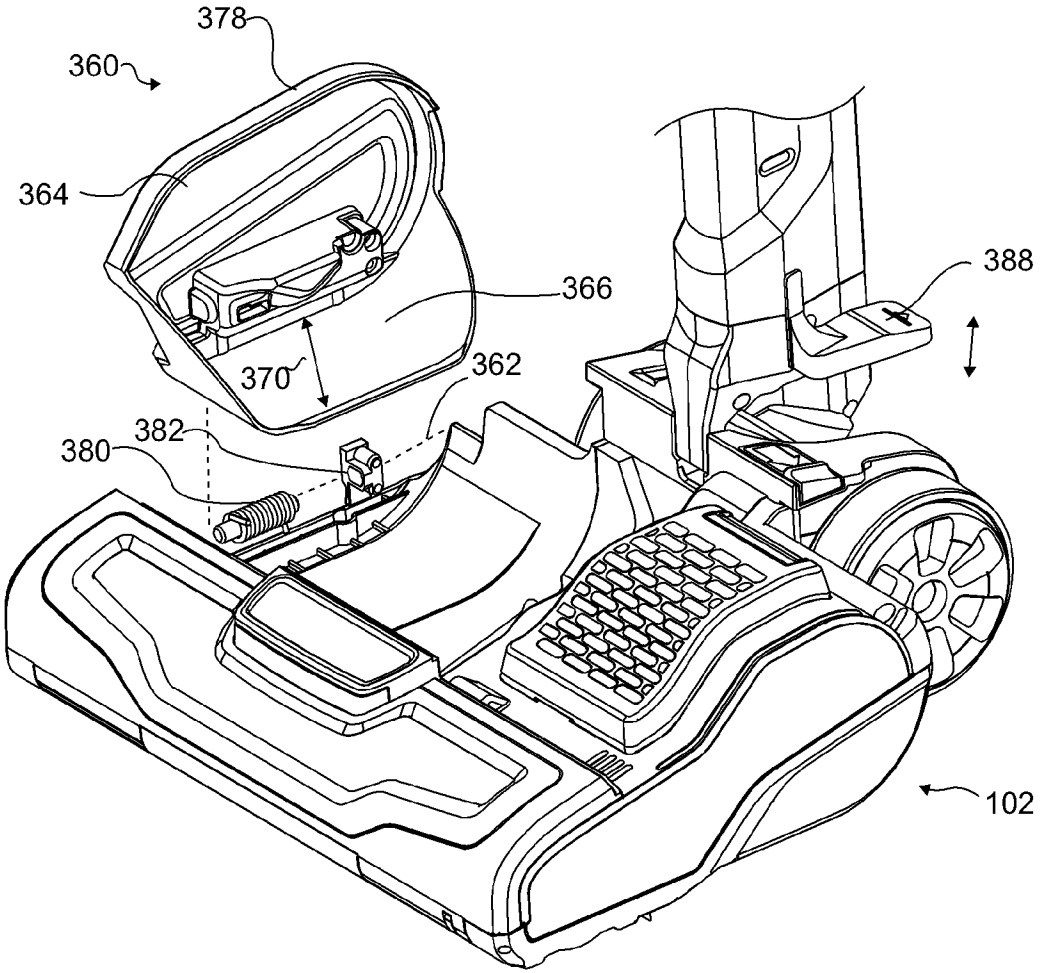
FIG. 38 is a partially exploded a front perspective view of the surface cleaning head of FIG. 1 with the cyclone bin assembly removed.

Referring to FIGS. 27 and 28, in the illustrated example the surface cleaning head includes a movable platform in the form of a cradle 360 that is configured to receive and support the laterally outer end of the cyclone bin assembly 160, and is rotatable relative to the surface cleaning head about a cradle axis 362 (FIGS. 37 and 38). In the illustrated example, the cradle axis 362 is parallel to the forward direction of travel of the surface cleaning apparatus 100, and is generally orthogonal to the cyclone axis 174, suction motor axis 182 and brush motor axis 224.

Figure 32:
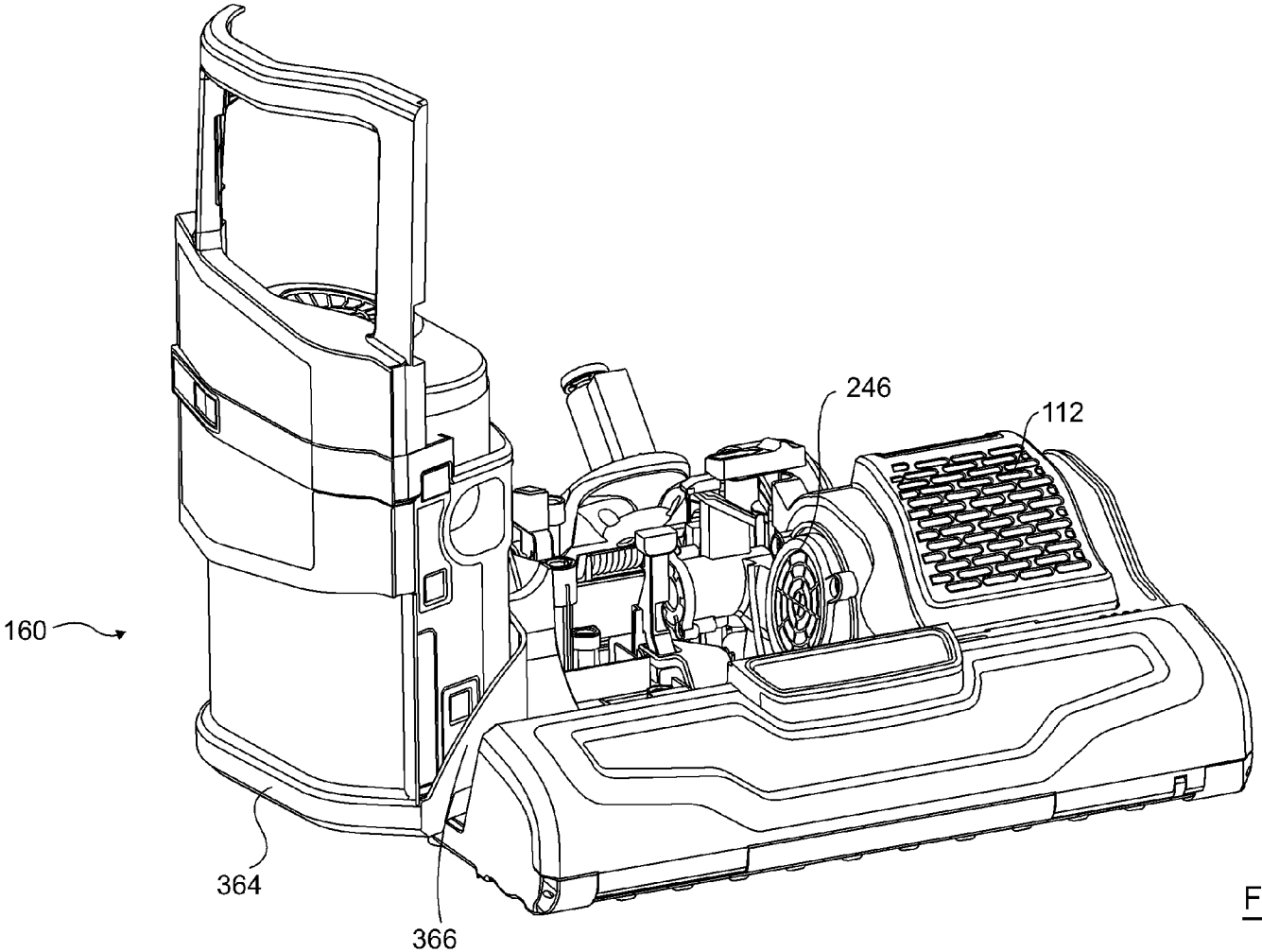
FIG. 32 is a front perspective view of the surface cleaning head of FIG. 1 with the cyclone bin assembly in a removal position.
Figure 36:
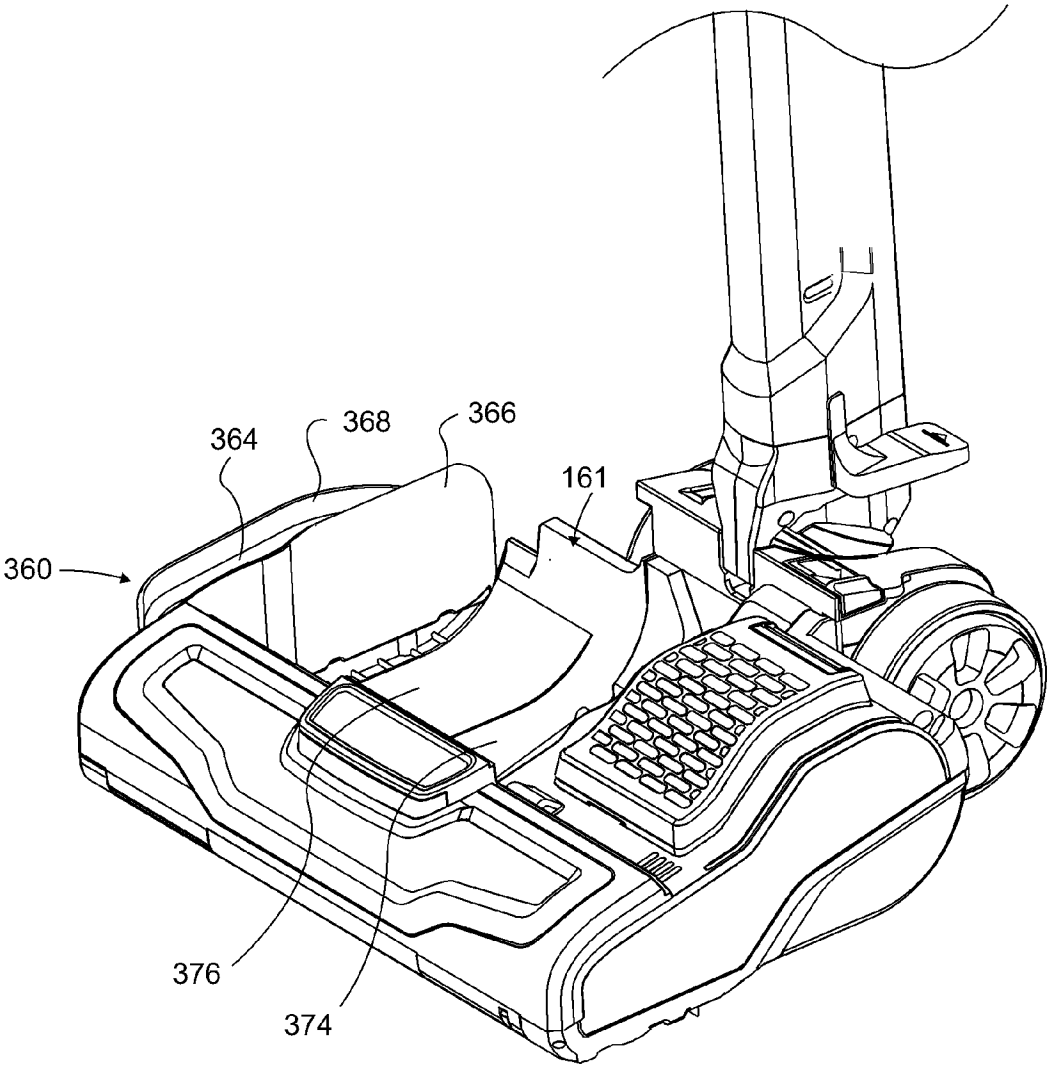
FIG. 36 is a front perspective view of the surface cleaning apparatus of FIG. 1 with the cyclone bin assembly removed.

Referring to FIGS. 32 and 36, in the illustrated example, the cradle 360 is generally L-shaped and includes an end wall 364 and a sidewall 366 extending from the end wall 364. The end wall 364 is configured to receive the laterally outer end of the cyclone bin assembly 160 in a relatively snug engagement. In the example illustrated, the end of the cyclone bin assembly 160 engaged by the cradle 360 includes the openable door 266. The end wall 364 includes an upstanding rim 368 that surrounds the openable door 266 of the cyclone bin assembly 160 and helps retain the cyclone bin assembly 160 on the cradle when in the removal position.

The cradle end wall 364 is configured to abut a portion of the sidewall of the cyclone bin assembly 160 (and may form a portion of the sidewall of the surface cleaning head), and has a length 370 (FIG. 38) that is optionally less than or equal to the length 372 (FIG. 21) between the openable door 266 and the end wall 290 of the pre-motor filter chamber 280, and preferably is less than the length 372. When the cyclone bin assembly 160 is in the cleaning position, the cradle 360 is rotated so that the end wall 364 is generally horizontal and is disposed vertically between the cyclone bin assembly 160 and the bottom surface 374 of the cavity 161. In the illustrated example, the bottom surface 374 of the cavity 161 includes a recessed region 376 sized to receive the end wall 364. In this configuration the end wall 364 of the cradle 360 is generally vertical, such that the cyclone bin assembly 160 is positioned laterally between the cradle end wall 364 and the suction motor 162. When the cyclone bin assembly 160 is in the cleaning position, an upper portion 378 (FIG. 38) of the rim 368 helps inhibit vertical movement of the cyclone bin assembly 160 relative to the cradle 360, and the rest of the surface cleaning head 102.

In the illustrated example, rotation of the cradle 360 about its axis causes a corresponding rotation of the cyclone bin assembly 160 from the generally horizontal cleaning position to a generally vertical removal position. When the cyclone bin assembly arrives in the removal position the cyclone axis 174 may be generally perpendicular to the previous orientation of the cyclone axis 174 when the cyclone bin assembly 160 is in the cleaning position. Referring to FIG. 27, from the removal position, the cyclone bin assembly 160 can be lifted vertically out of the cradle 360 (i.e. the openable door 266 end can be lifted vertically out of the rim 368) and carried to the garbage for emptying, etc.

Optionally, the cradle may be freely moveable between the cleaning and removal positions, or alternatively it may be biased. Referring to FIG. 38, in the illustrated example, a torsion spring 380 and an optional dampener assembly 382 is connected to the cradle 360 to bias the cradle 360 toward the removal position. The torsion spring resistance is selected so that it is sufficient to pivot the cradle 360 and a cyclone bin assembly 160, including the weight of the debris within the dirt collection chamber 166, to the vertical removal position. The damper assembly 382 can be provided to help slow the rotation of the cradle 360 as the cyclone bin assembly approaches the removal position.

In the illustrated example, the cradle 360 is only biased toward the removal position. To return the cyclone bin assembly 160 to the cleaning position a user may reseat the laterally outer end of the cyclone bin assembly 160 onto the end wall of the cradle, and then pivot the cyclone bin assembly 160 into the cavity 161, toward the cleaning position.

As exemplified in FIGS. 33-36, the surface cleaning apparatus may include a lock that is configured to secure the cyclone bin assembly 160 in the cleaning position. The lock includes a latch member 384 that is configured to releasably engage a corresponding locking portion, in the form of a shoulder 386 (see also FIGS. 29 and 30) that is provided on an outer surface of the cyclone bin assembly 160. In the illustrated example, the latch member 384 protrudes through an opening in the bottom surface 374 of the cavity 161, and the shoulder 386 is provided on the sidewall of the cyclone bin assembly 160 that is downward facing and opposes the bottom 374 of the cavity 161 when the cyclone bin assembly 160 is positioned within the cavity. Specifically, in the example illustrated the shoulder 386 is provided on an outer surface of the pre-motor filter chamber sidewall 292. In the illustrated example, when the cyclone bin assembly 160 is in the cleaning position, the latch member 384 is located beneath the pre-motor filter chamber 280, and the pre-motor filter therein 382.

Alternatively, the latch member and shoulder may be provided at a different location. For example, the latch member may be provided adjacent the suction motor and the shoulder may be provided on an end wall of the cyclone bin assembly.

In the illustrated example, the lock also includes an actuator, in the form of a foot pedal 388 that is provided on upper portion 104, and a linkage that connects the foot pedal 388 to the latch member 384. In the illustrated example, the foot pedal 388 translates vertically when stepped on by a user. It will be appreciated that other actuators may be used, such as a button. Further, the actuator may engage a drive motor that moves the cyclone bin assembly to the removal and/or use positions.

Figure 33:
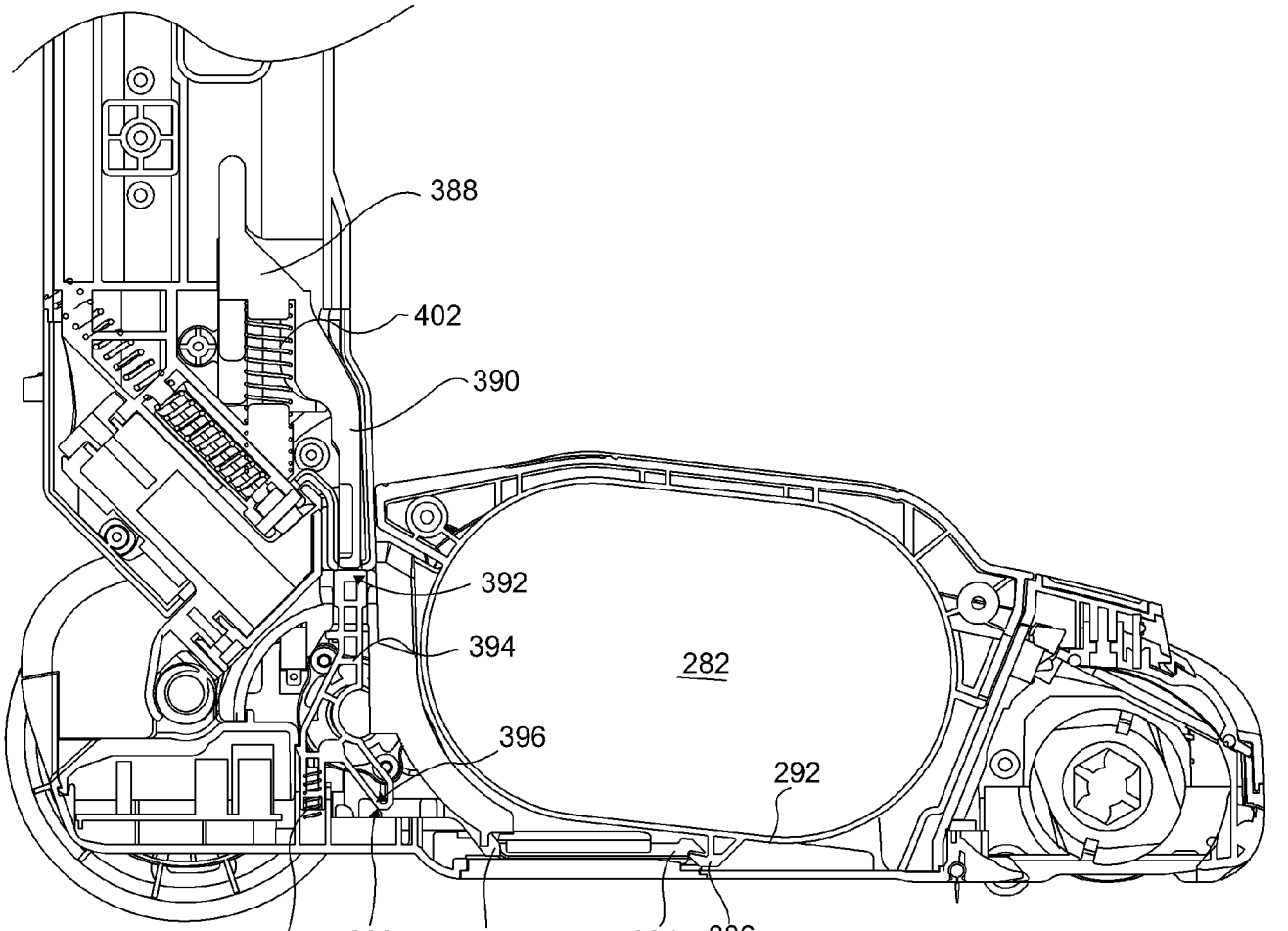
FIG. 33 is a cross-sectional view of a portion of the surface cleaning apparatus of FIG. 1 with a lock in locked configuration, taken along line 33-33, which is shown in FIG. 7.
Figure 34:
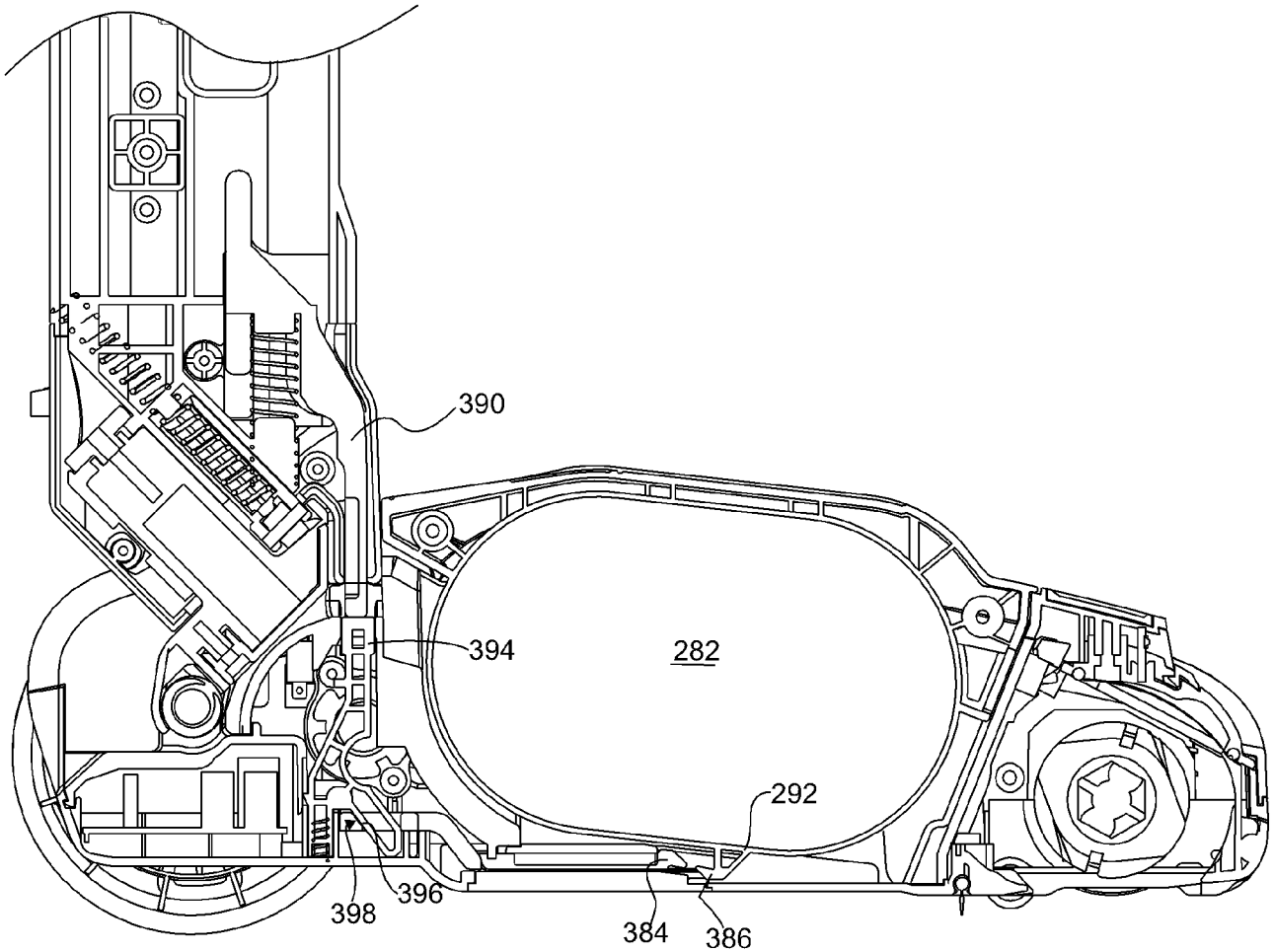
FIG. 34 is the cross-sectional view of FIG. 33 with the lock in an unlocked configuration.
Figure 35:
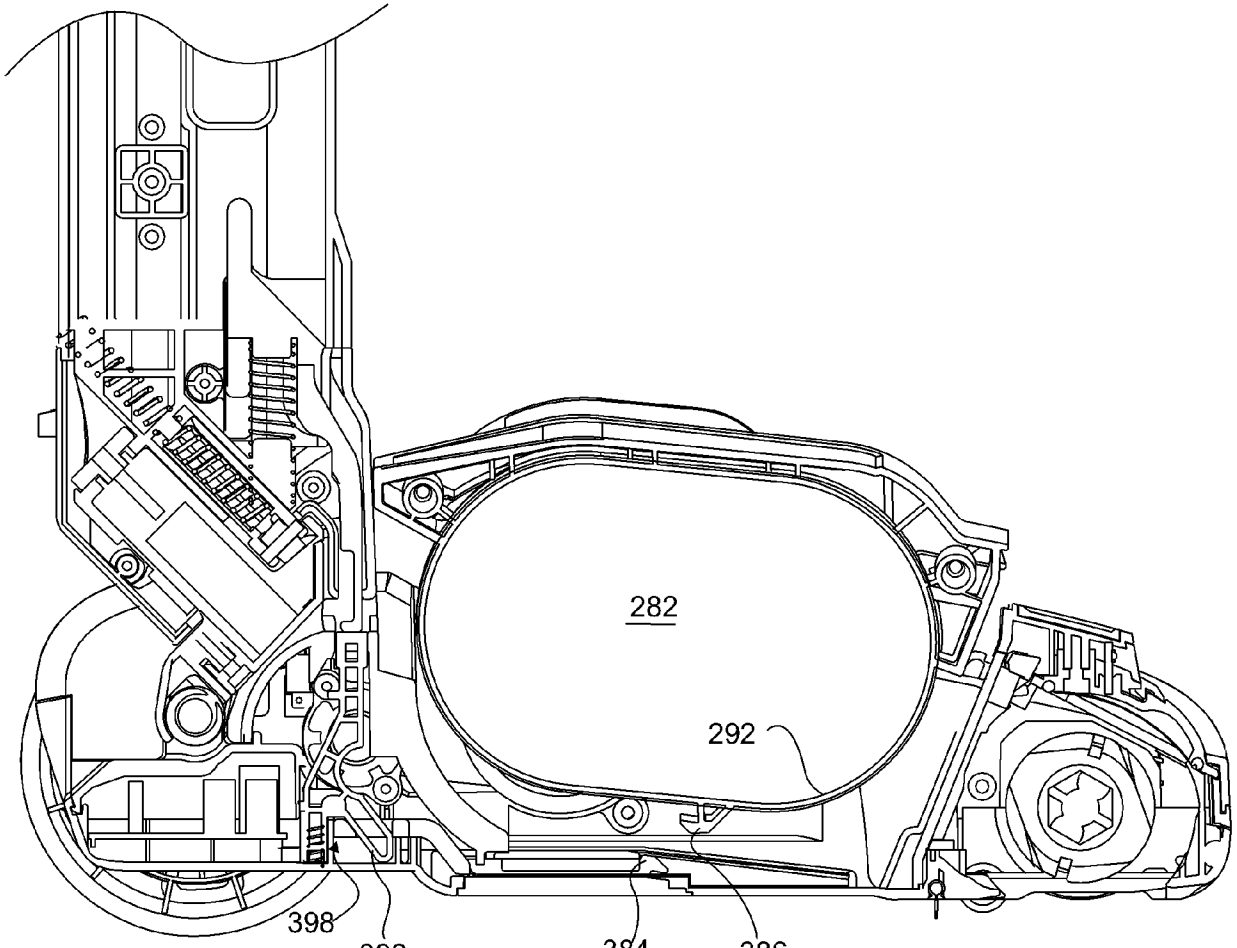
FIG. 35 is the cross-sectional view of FIG. 34, with the cyclone bin assembly pivoted to a different position.

The following is a description of the exemplified foot pedal 388. Referring to FIG. 33, movement of the foot pedal 388 causes a corresponding vertical translation of a first linkage member 390 extending within the upper portion 104. The first linkage 390 abuts an upper end 392 of a vertically translatable second linkage 394 disposed within the mounting hub 316. A lower end 396 of the second linkage 394 is configured to engage a camming surface 398 of a movable locking arm in the form of a third linkage member 400. The lock is configured so that downward vertical movement of the first linkage member 390 causes downward movement of the second linkage 394 and a generally horizontal, rearward translation of the third linkage member 400 (from right to left as illustrated in FIGS. 33-35). The rearward, horizontal movement of the third linkage member 400 is sufficient to move the latch member 384 from a position in which it engages the shoulder 386 (FIG. 33) to a position where the latch member 384 is disengaged from the shoulder 386 (FIG. 34), thereby unlocking the cyclone bin assembly 160 and allowing it to be pivoted out of the cavity 161 (shown partially pivoted in FIG. 35).

Figure 3:
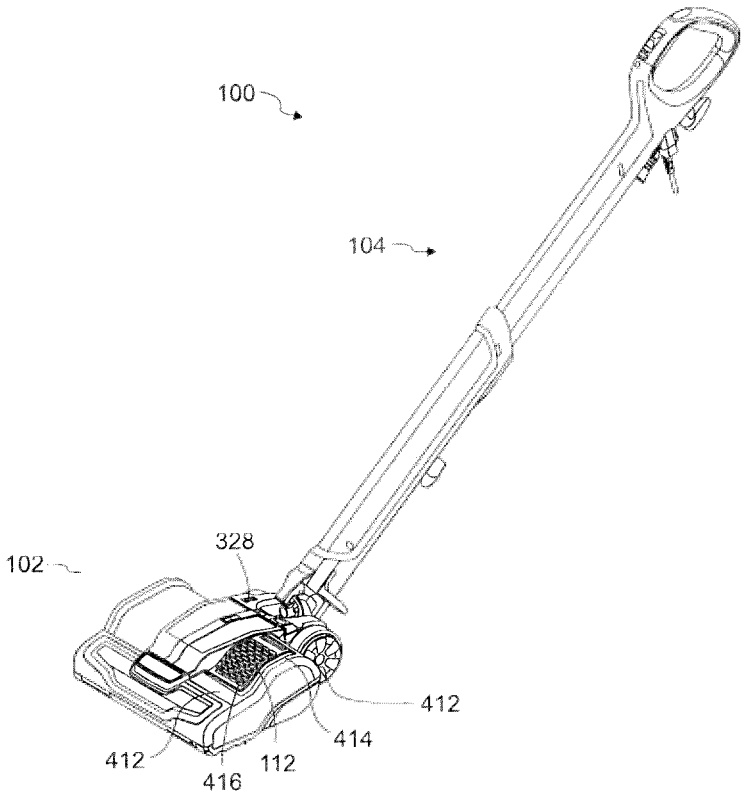
FIG. 3 is a front perspective view of the surface cleaning apparatus of FIG. 1 with an upper portion in a use position.
Figure 4:
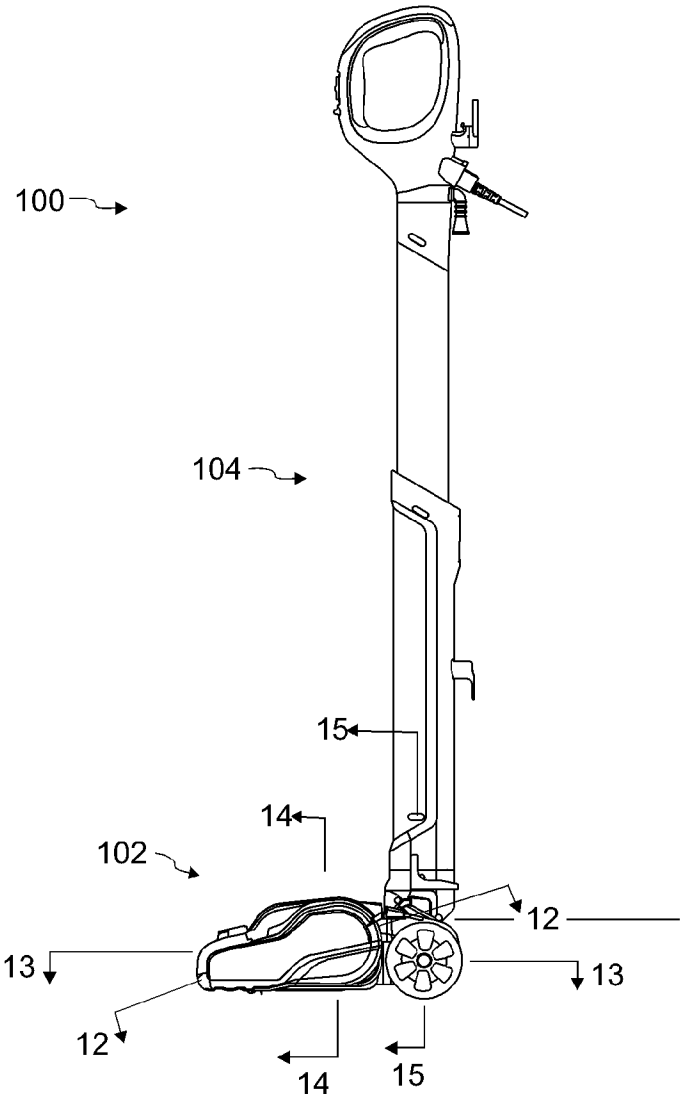
FIG. 4 is left side view of the surface cleaning apparatus of FIG. 1.

In the illustrated example, the first linkage member 390 is movable with the upper portion 104 relative to the second linkage portion 394, and pivots away from the second linkage portion 394 when the upper portion of the surface cleaning apparatus is pivoted into the floor cleaning position (FIG. 3). In this configuration, the presence of the lock does not interfere with the pivoting and/or rotating of the upper portion 104 when the surface cleaning apparatus is in use. This configuration also effectively deactivates the actuator so that the cyclone bin assembly 160 is unlocked while the surface cleaning apparatus 100 is in use. Specifically, when the upper portion 104 is pivoted into the cleaning position (FIG. 3), the first linkage 390 is spaced apart from the upper end 392 of the second linkage 394, such that movement of the foot pedal 388 is not translated to the second linkage 394. When the upper portion 104 is returned to the storage position (FIGS. 1 and 33), the first linkage 390 is automatically repositioned adjacent the upper end 392 of the second linkage 394, thereby reconnecting the lock and allowing vertical movement of the first linkage 390 to cause vertical movement of the second linkage 394 (and the resulting movement of the third linkage 400).

Both the foot pedal 388 and third linkage 400 are biased, using springs 402 and 404 respectively, such that the latch member 384 is biased toward its engaged position, in the absence of a user stepping on the foot pedal 388. In the illustrated example, the third linkage 400 is biased forwardly.

In accordance with another feature, a supplemental biasing member may be provided to help initially move the cyclone bin assembly out of the cleaning position when the lock is released. A supplemental biasing member may be used to help reduce the load on the torsion spring, or alternatively may be used to replace the torsion spring entirely. Using the supplemental biasing member to help lift the cyclone bin assembly out of its horizontal position may help reduce the magnitude of the moment force that needs to be overcome by the biasing spring (i.e. by pivoting the cyclone bin assembly slightly such that the centre of gravity of the cyclone bin assembly is moved somewhat closed to the cradle axis about which the moment forces act).

Figure 31:
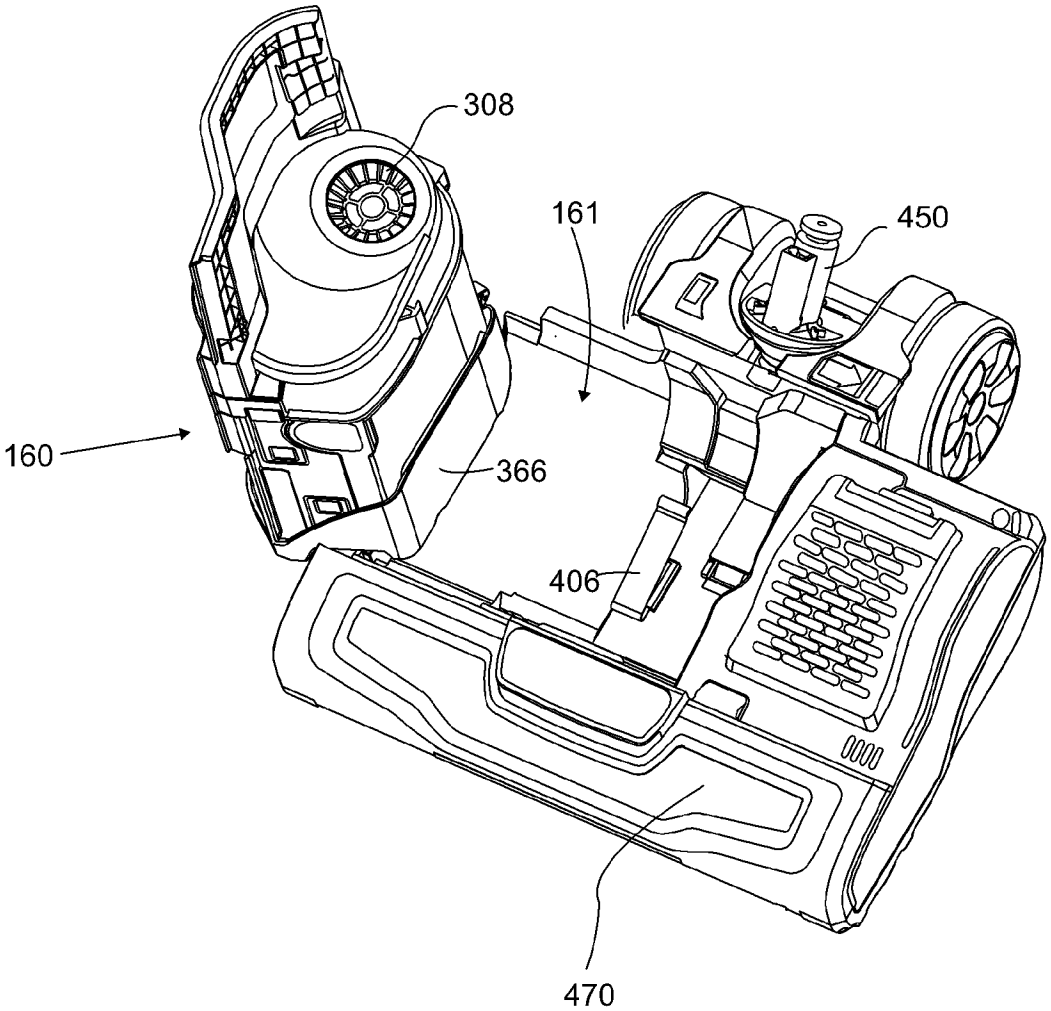
FIG. 31 is a front perspective view of the surface cleaning head of FIG. 1 with the cyclone bin assembly in a removal position.

Referring to FIGS. 31 and 37, in the illustrated example, the surface cleaning apparatus 100 includes a supplemental biasing member in the form of a leaf spring 406. The leaf spring 406 is disposed within the cavity 161 (mounted to the bottom surface 374 in the illustrated example) at a location where it engages, and is compressed by the outer surface of the cyclone bin assembly 160 when the cyclone bin assembly 160 is in the cleaning position. While the latch member 384 is engaged with the shoulder 386, the cyclone bin assembly 160 is retained in the cleaning position, overcoming the combined biasing forces of the leaf spring 406 and torsion spring 380.

When the latch member 384 is disengaged from the shoulder 386 (FIG. 34), the leaf spring 406 urges the cyclone bin assembly 160 upwards, away from the bottom surface 374 of the cavity 161. Because movement of the cyclone bin assembly 160 is restrained by its engagement with the cradle 360, this upward motion imparted by the leaf spring 406 is converted into rotation of the cyclone bin assembly 160, and cradle 360 coupled thereto, about the cradle axis 362. The movement imparted by the leaf spring 406 may be a relatively small amount, and may result in rotation of the cyclone bin assembly 160 about the cradle axis 362 of between about 0.5 degrees and about 20 degrees, and preferably between about 2 degrees and 10 degrees, and more preferably of about 5 degrees.

Alternatively, instead of the latch member 384 engaging the cyclone bin assembly 160 directly, the lock may be configured such that the latch member 384 engages a portion of the cradle 360, such as, for example, the sidewall 366.

It will be appreciated that the surface cleaning apparatus may utilize only the supplemental biasing member so that the a cyclone bin assembly handle or the like is revealed to enable a user to grasp and remove the cyclone bin assembly from the surface cleaning head or to move the cyclone bin assembly to a removal position. For example, the supplemental biasing member may lift the cyclone bin assembly sufficiently to enable a user to then manually rotate the support platform to the removal position of FIG. 29.

In the alternate embodiment of FIGS. 46-49, instead of pivoting with a cradle, when the cyclone bin assembly 1160 is unlocked it translates laterally upwardly out of the cavity 1161 under the upward biasing force of the leaf spring 1406 (FIG. 49) to a removal position in which the cyclone bin assembly 1160 is slightly higher in the vertical direction, but remains partially nested within the cavity 1161.

Figure 49:
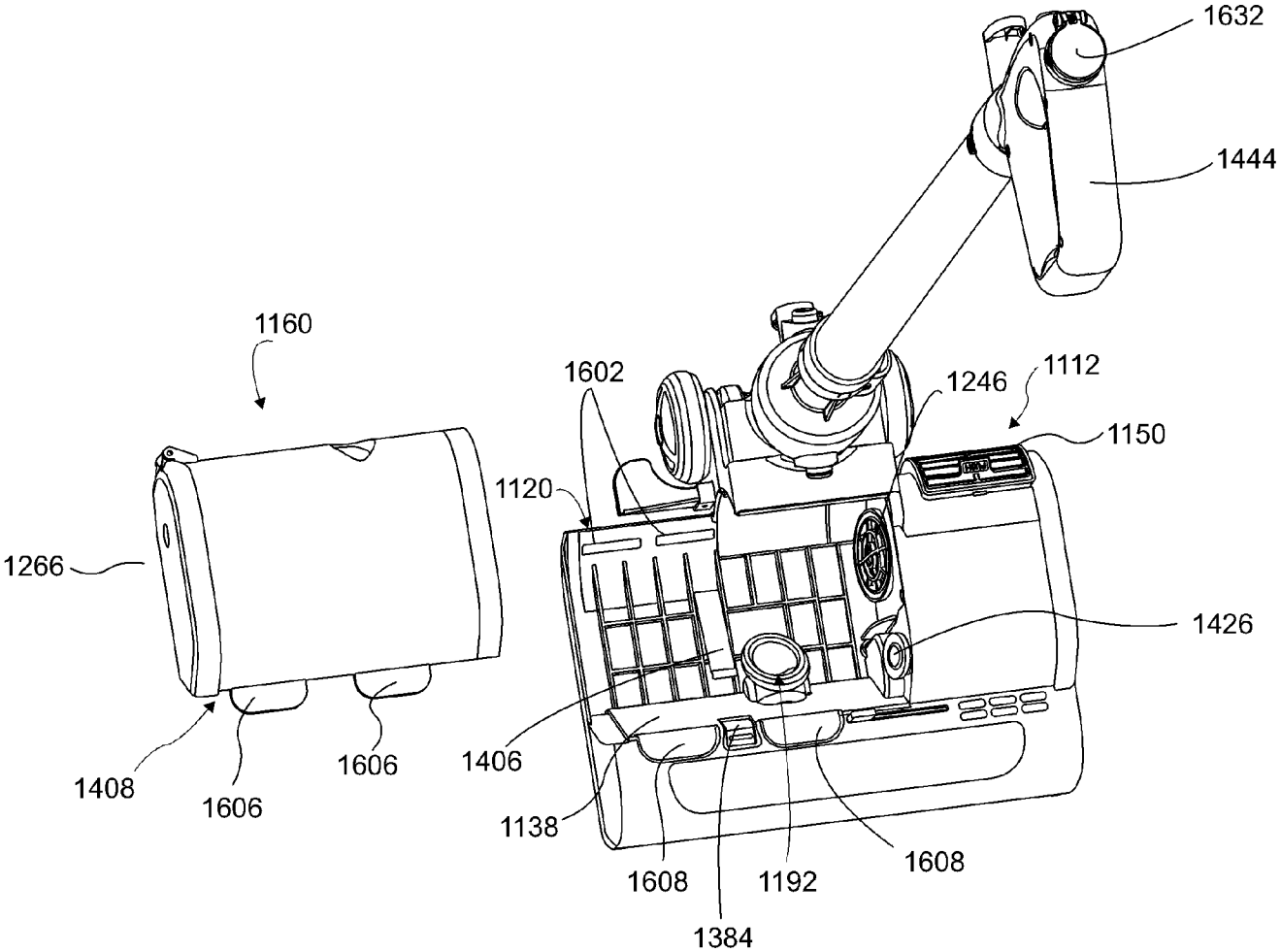
FIG. 49 is a top perspective view of the surface cleaning apparatus of FIG. 46, with the cyclone bin assembly removed.
Figure 50:
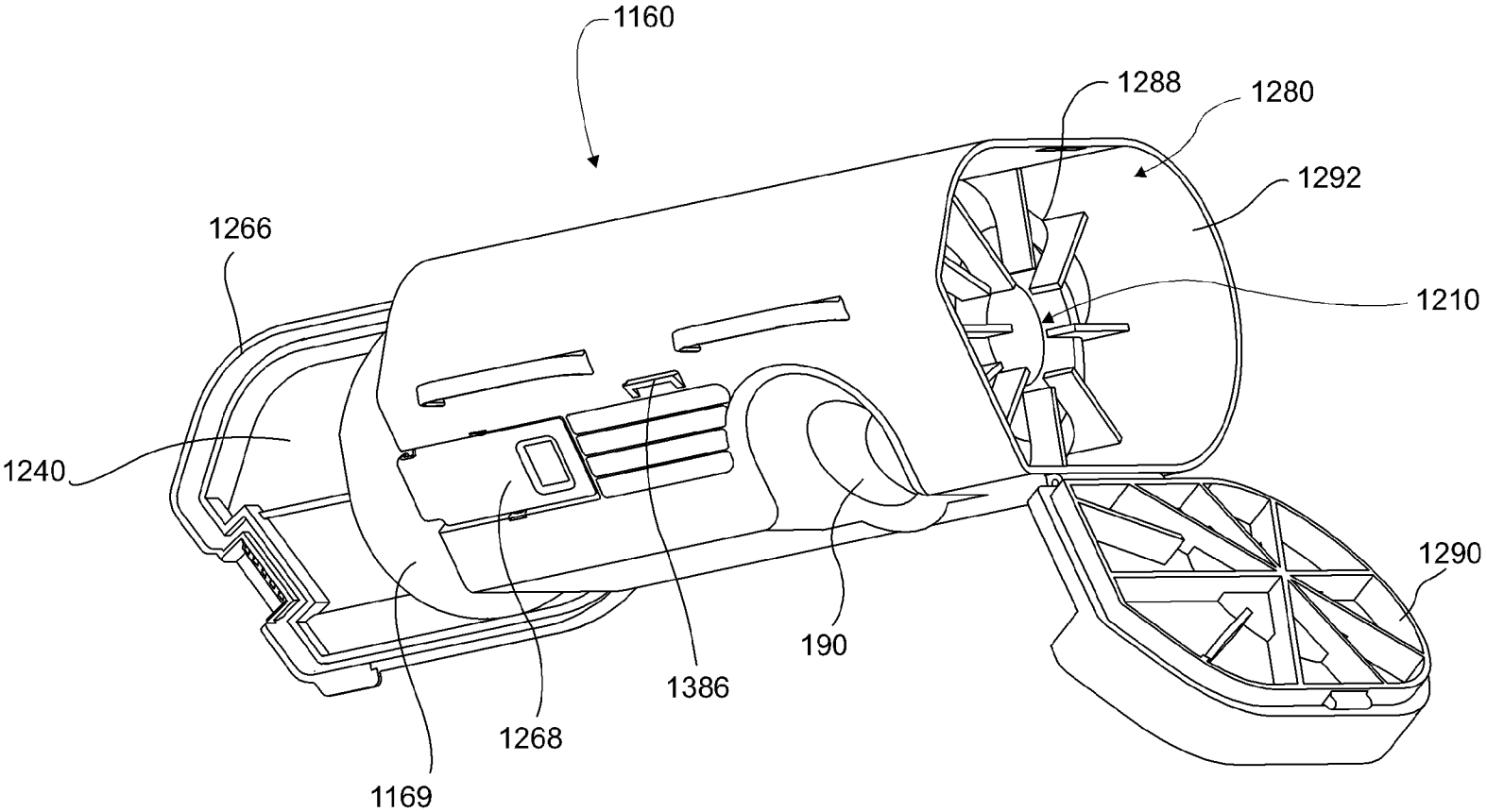
FIG. 50 is a front perspective view of an example of a cyclone bin assembly with a filter chamber opened.
Figure 51:
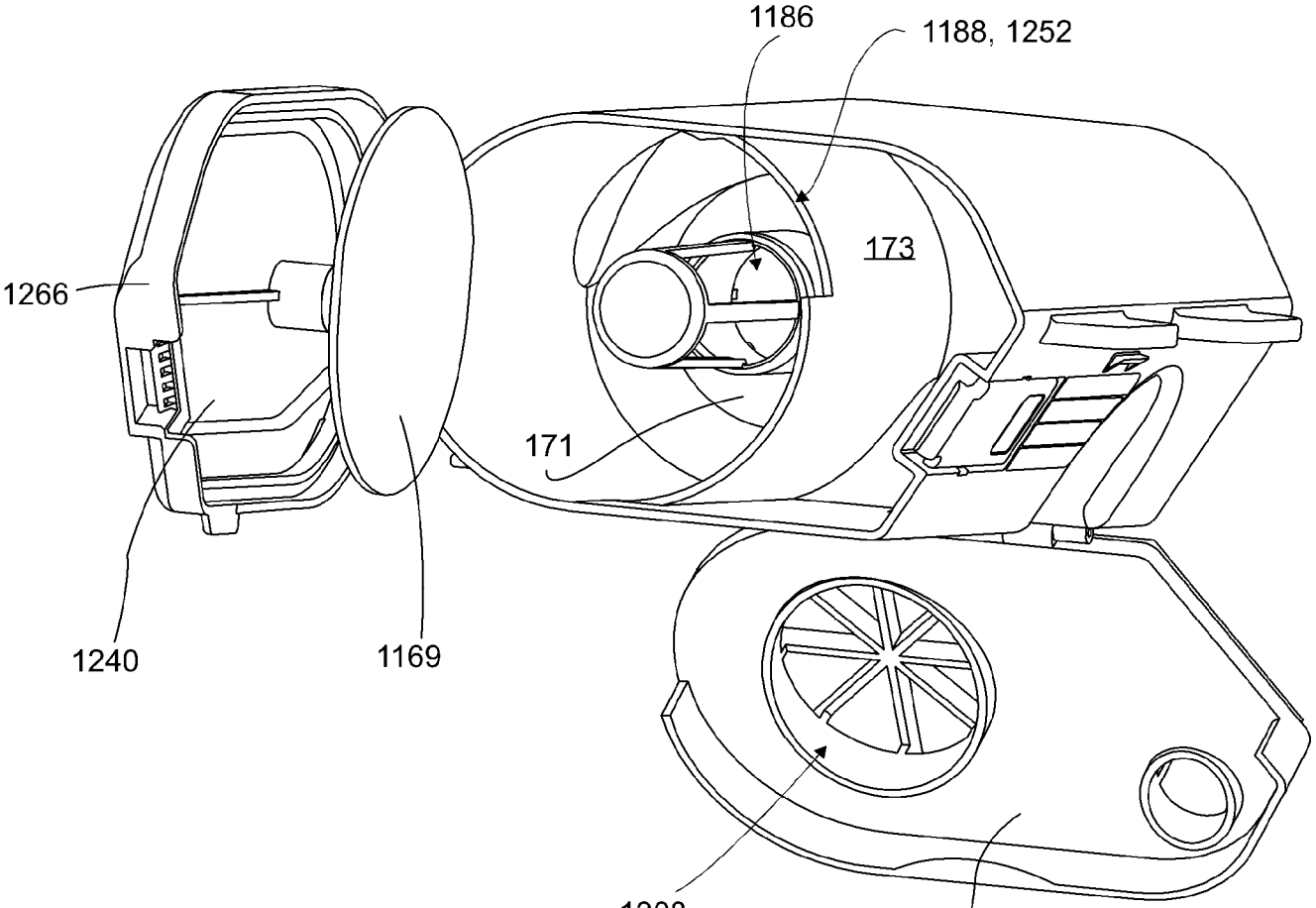
FIG. 51 is a side perspective view of the cyclone bin assembly of FIG. 50 showing the cyclone chamber in an open position.
Figure 52:
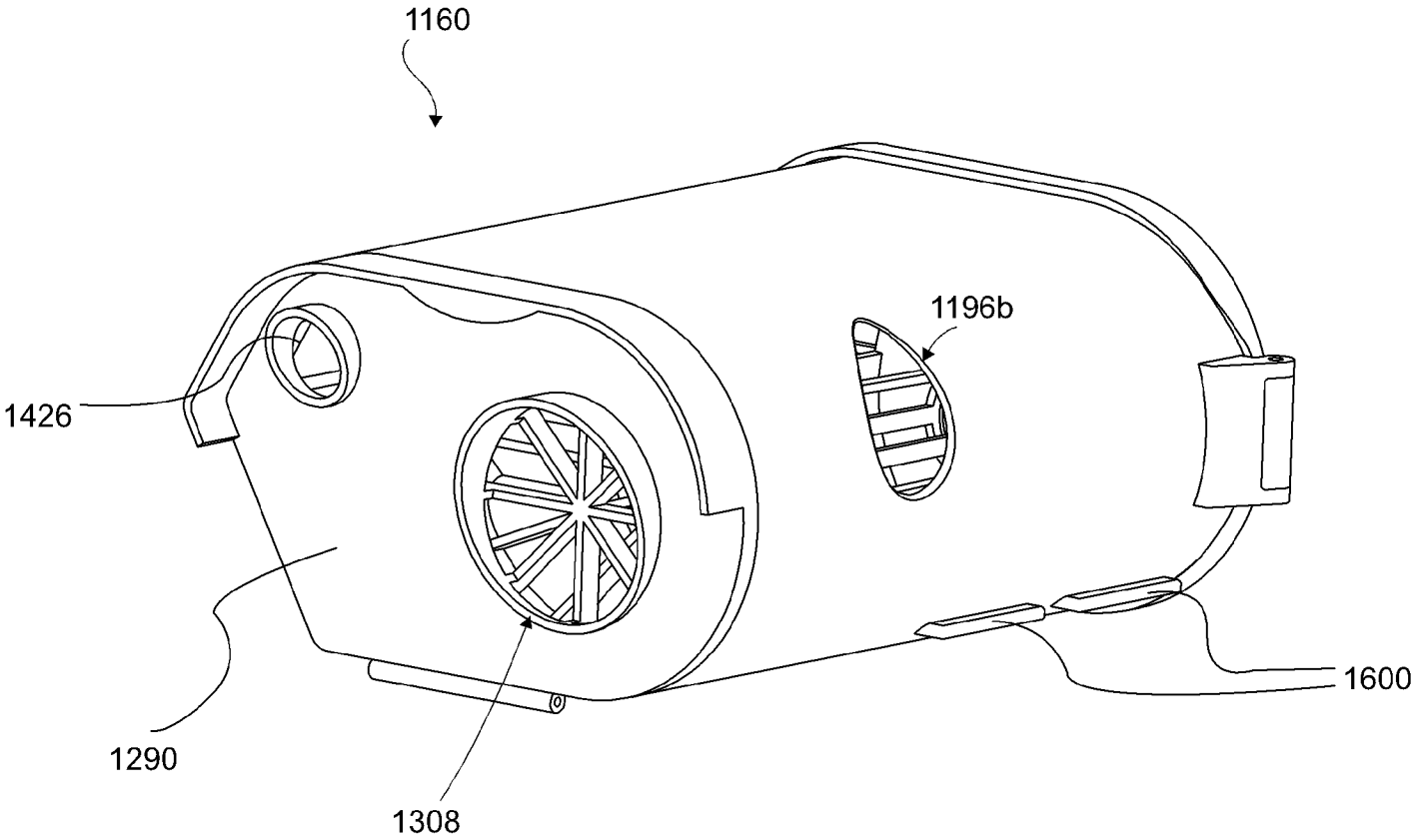
FIG. 52 is a perspective view of the filter chamber end of the cyclone bin assembly of FIG. 50.

Referring to FIG. 49, in this example the cyclone bin assembly 1160 is inserted into the cavity by inserting rear tabs 1600 (FIG. 52) into the corresponding rear slots 1602 that are provided in the rear wall 1120 of the cavity 1161. With the rear tabs 1600 inserted, the cyclone bin assembly 1160 can be pivoted forwardly until the pair of front tabs 1604 are received in corresponding recesses 1608. When the front tabs 1604 are inserted into the recesses 1608, the latch member 1384 may engage the corresponding shoulder 1386 (FIG. 50) on the sidewall of the cyclone bin assembly 1160.

To unlock the cyclone bin assembly 1160, a user may depress the latch 1384, thereby disengaging it from the shoulder 1386 and allowing the leaf spring to urge the cyclone bin assembly 1160 upward into the removal position (Figured 47). In the removal position, the front tabs 1604 can function as the cyclone bin assembly handle 1408, as the tabs 1606 are positioned proud of the recesses 1608 and serve as finger grips allowing a user to grasp the cyclone bin assembly 1160.

In the illustrated example, when moving from the cleaning position to the removal position the cyclone bin assembly 1160 rotates about a generally transverse axis, that is parallel to the cyclone axis 1174, the suction motor axis 1186, brush motor axis 1224 and the brush axis 1134.

Optionally, the cyclone bin assembly can moved from the cleaning position to the removal position by pivoting laterally (as shown herein), by pivoting forwardly, or by pivoting rearwardly. Alternatively, or in addition to pivoting, the cyclone bin assembly may also be moved in the removal position by sliding or translating laterally, sliding forwardly, and/or by sliding upwardly. In some embodiments, the cyclone bin assembly may be moved to the removal position using a combination of different movements. For example, the cyclone bin assembly may translate laterally and then pivot upwardly, or the cyclone bin assembly may pivot to a vertical orientation, and then slide upwardly, laterally, forwardly and/or rearwardly.

It will be appreciated that some of the embodiments disclosed herein may not use any of the features of the cyclone bin assembly removal and latch mechanism disclosed herein and that, in those embodiments, the removal and latch mechanism may be of various constructions or a removal and latch mechanism may not be used.

Cyclone Bin Assembly Handle

The following is a description of a cyclone bin assembly handle having various features, any or all of which may be used (individually or in any combination or sub-combination), by itself in any surface cleaning apparatus or in any combination or sub-combination with any other feature or features disclosed herein.

In accordance with one feature, the cyclone bin assembly may include a carry handle portion that is exposed and/or made more readily available when the cyclone bin assembly is in the removal position. The handle portion may help increase the overall height of the cyclone bin assembly in the removal position, and preferably may form an uppermost portion of the cyclone bin assembly while it is in the removal position. Providing a handle at a relatively high, and optionally uppermost position on the cyclone bin assembly may help position the handle at an elevation that is relatively comfortable, or is more comfortable, for a user to reach (e.g. to help minimize the amount of bending required by the user).

In accordance with another feature, as exemplified in FIGS. 20 and 21, the cyclone bin assembly 160 may include a handle 408 that extends transversely (e.g., longitudinally from the laterally inward end of the cyclone bin assembly 160). In this configuration, the handle 408 extends longitudinally away from the end wall 290 of the pre-motor filter chamber 280.

In the illustrated example, the handle 408 extends beyond the end wall 290 of the pre-motor filter chamber 280 by a handle length 410, measured in the direction of the cyclone axis 174. The handle length 410 may be any suitable length, and may be between about 25% and about 200%, and optionally between about 50% and about 150%, and optionally between about 55% and about 75% of the length 372 between the end wall 290 and the openable door 266.

Optionally, the cyclone bin assembly 160 can be configured so that the cyclone bin assembly 160, including the handle 408, extends across almost the most or all of the entire width 338 of the surface cleaning apparatus. Configuring the cyclone bin assembly to extend the width 338 of the surface cleaning apparatus may help increase the height of the cyclone bin assembly 160, in particular the handle portion 408, when the cyclone bin assembly 160 is in the removal position, while remaining within the width 338 of the surface cleaning head 102 when in the cleaning position. Optionally, the width of the cyclone bin assembly, including the handle portion (i.e. the sum of lengths 372 and 410), can be between about 25% and about 100% of the width 338 of the surface cleaning head 102, and preferably can be between about 50% and about 100% and more preferably can be between about 80% and about 100% of the width 338. In the illustrated example, the combined width of the dirt collection chamber, pre-motor filter chamber and handle length (the sum of lengths 372 and 410) is generally equal to the width 338 of the surface cleaning head 102.

In accordance with another feature, the handle may be configured to be positioned at an upper portion of the cyclone bin assembly when the cyclone bin assembly is in the removal position and (as exemplified in FIG. 28) may extend upwardly when the cyclone bin assembly is in the removal position.

Referring to FIGS. 20 and 21, in the illustrated example the handle 408 includes an open frame include a pair of generally longitudinally extending struts 412 extending parallel to the cyclone axis 174, and a generally perpendicular cross-member 414 which, in the example illustrated forms a hand grip portion of the handle 408. In the illustrated example, the handle includes two struts 412 that are joined by the cross-member 414 such that the handle 408 defines an internal opening 416.

In accordance with another feature, the handle opening 416 may be configured to at least partially receive another portion of the surface cleaning apparatus when the cyclone bin assembly is in the cleaning position. For example, the opening 416 may be configured to seat around a portion of the surface cleaning head 102 when the cyclone bin assembly 160 is in the cleaning position. This may help facilitate the positioning of the handle so that it is flush with, or recessed into, the top surface of the surface cleaning head when the cyclone bin assembly is in the cleaning position.

As exemplified in FIGS. 3 and 7, the handle opening 416 may surround the clean air outlet 112, and specifically optional removable grill 150 and post-motor filter 152, when the cyclone bin assembly 160 is in the cleaning position. In this configuration, an upper surface of the handle 408 is generally flush with the upper surface of the grill 150, and both the grill 150 and the upper surface of the handle 408 are recessed into, and form part of, the exposed top face 128 of the surface cleaning head 102. Alternatively, instead of being an enclosed opening, the handle 408 may include only a single strut and the opening may have one or more open sides.

In accordance with another feature, the handle 408 may be moveable relative to the cyclone chamber 164, dirt collection chamber 166 and/or pre-motor filter chamber 280. For example, the handle 408 may be provided on a movable and/or openable portion of the cyclone bin assembly, such as an openable door or chamber wall. This may help facilitate positioning the handle in a desired location on the cyclone bin assembly while still providing the desired access to the openable portions of the cyclone bin assembly.

In accordance with another feature, as exemplified in FIG. 23, the handle 408 may be integrally formed with the end wall 290 of the pre-motor filter chamber 280 or formed as a one piece assembly therewith (e.g. separately formed and then secured together such as by an adhesive, welding, a mechanical fastener or the like). As the end wall 290 is pivotal relative to the cyclone chamber 164 and dirt collection chamber 166 to provide access to the pre-motor filter 282, the handle 408 is also pivotal with the pre-motor filter end wall 290.

It will be appreciated that some of the embodiments disclosed herein may not use any of the features of the cyclone bin assembly handle disclosed herein and that, in those embodiments, the cyclone bin assembly handle may be of various constructions or a cyclone bin assembly handle may not be used.

Bleed Valve

The following is a description of a bleed air valve that may be used by itself in any surface cleaning apparatus or in any combination or sub-combination with any other feature or features disclosed herein.

Figure 39:
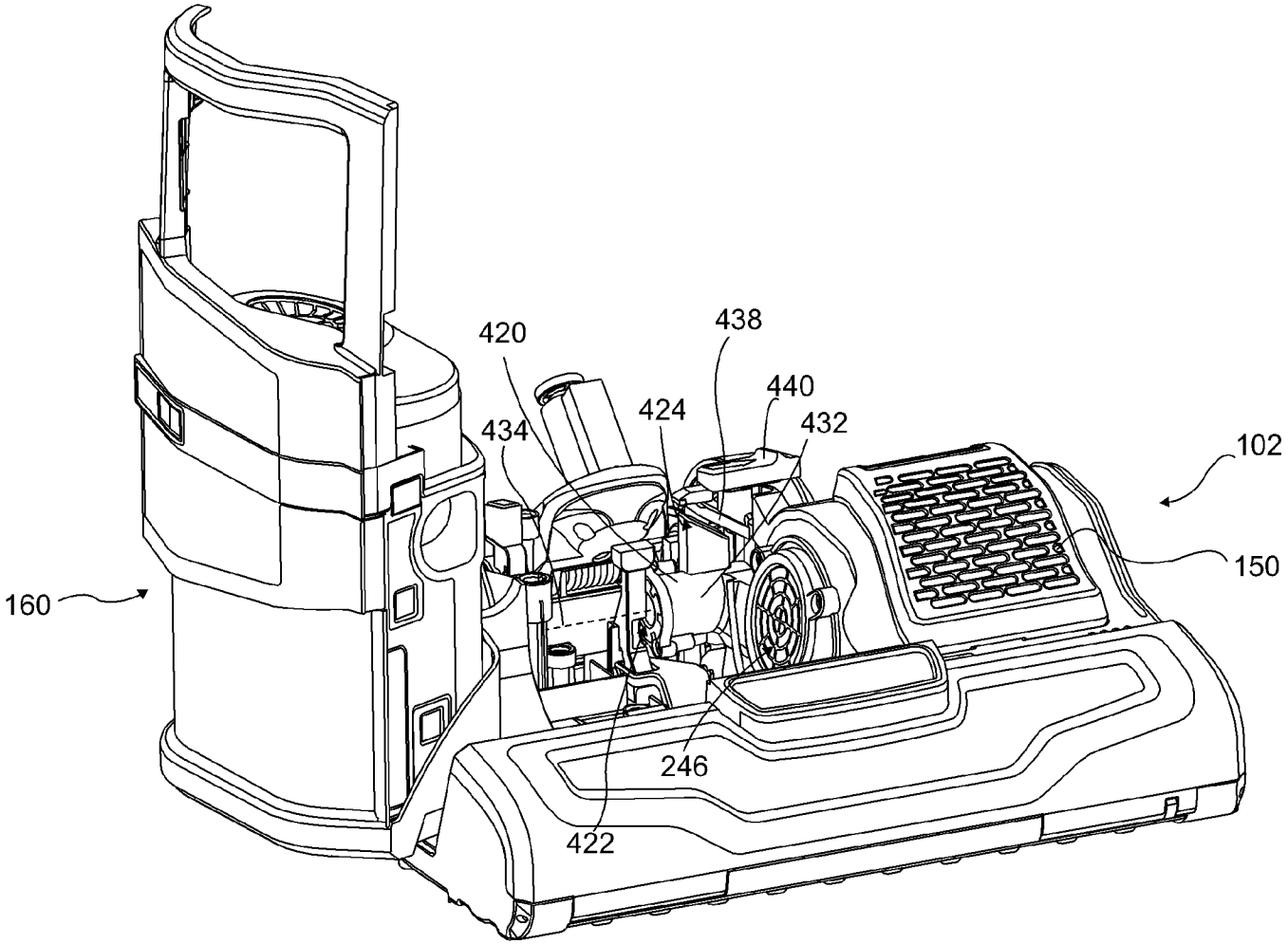
FIG. 39 is a front perspective view of the surface cleaning head of FIG. 1 with the cyclone bin assembly in a removal position and a cover removed to reveal a bleed valve.
Figure 40:
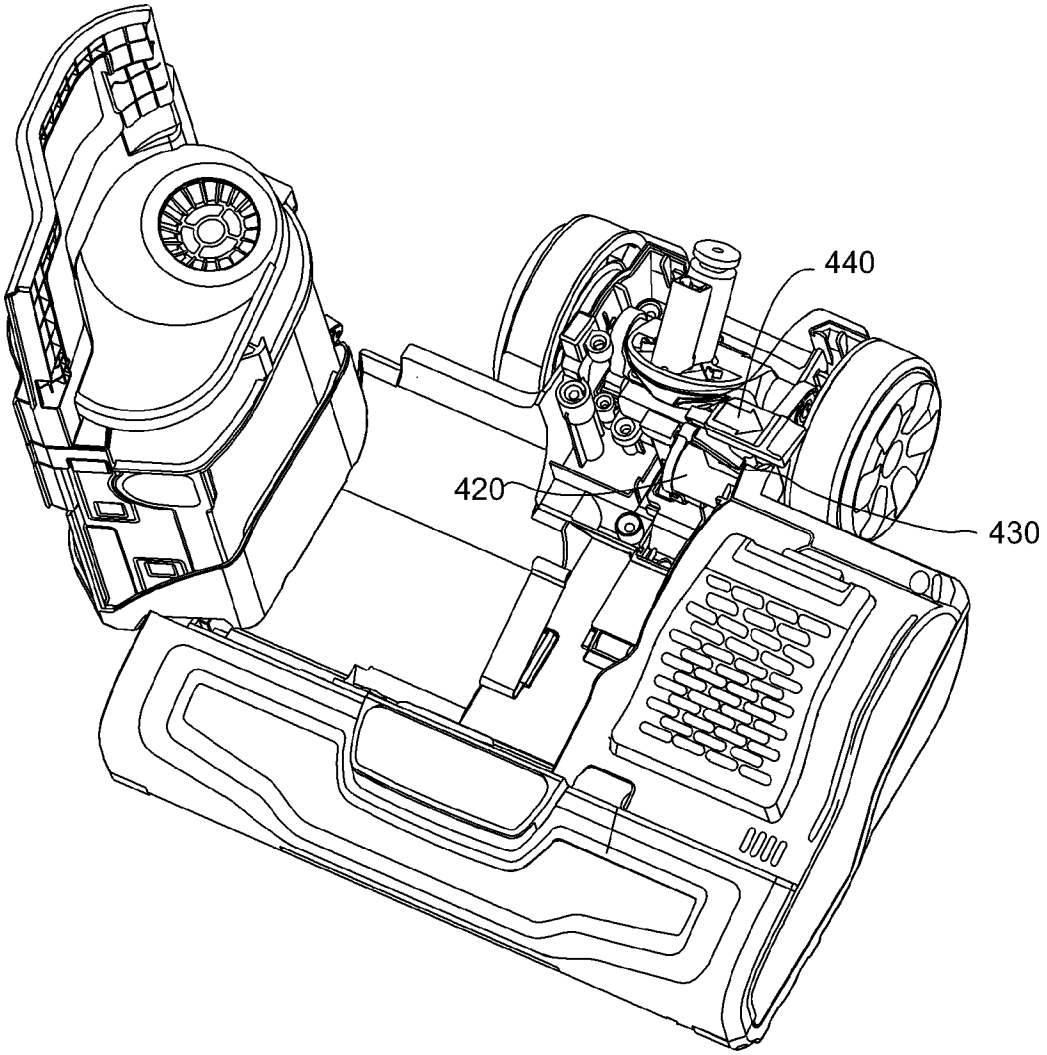
FIG. 40 is a top perspective view of the surface cleaning head as shown in FIG. 39.

It is possible that in some instances, the airflow path may become fully or partially clogged. For example, a large object, such as a ball of hair or popcorn, may become lodged anywhere in the airflow path in the surface cleaning head. For further example, the pre-motor filter may become clogged with particulate matter. If this occurs, airflow to the suction motor may be restricted and the suction motor may overheat and burn out. Referring to FIGS. 39 and 40, in the illustrated example the surface cleaning apparatus includes a bleed valve 420 that is provided in the surface cleaning head 102. If a clog occurs in the airflow path, the pressure in the suction motor housing will decrease. The bleed valve is preferably configured to open when the pressure decreases, and allow bleed air to flow through to the suction motor so that it does.

The bleed air valve has an outlet that provides bleed air as required to the suction motor, and optionally between the suction motor and the downstream side of a pre-motor filter. An advantage of this configuration is that the bleed air is delivered directly to the suction motor. If the pre-motor filter is dirty or clogged, which may be the reason the bleed valve opens, then the flow of bleed air to the suction motor will not be impeded by the pre-motor filter.

In accordance with one feature, the bleed air preferably travels through the bleed valve mechanism in a direction that is generally parallel to and optionally parallel to and in the same direction, as the direction of air flow exiting a cyclone. Alternately, or in addition, the bleed air preferably travels through the bleed valve mechanism in a direction that is generally parallel to and optionally parallel to and in the same direction, as the direction of air entering the suction motor.

Alternatively, the bleed valve may extend in a transverse direction with respect to as the direction of air flow exiting a cyclone and/or the direction of air entering the suction motor and the bleed air can exit the bleed valve in a direction that is generally orthogonal to either the direction of air flow exiting the cyclone, the direction of air flow entering the suction motor, or both.

Introducing bleed air into the air flow path upstream from the suction motor may also affect the air flow in the air flow path through the surface cleaning head upstream from the bleed air valve, which may in turn affect the suction available at the dirty air inlet. Optionally, the bleed air valve may be manually and/or selectively openable so that a user can purposefully introduce a desired quantity of bleed air into the air flow path. For example, a user may choose to open the bleed air valve, thereby reducing the suction at the dirty air inlet, when the surface cleaning apparatus is used to clean hard flooring surfaces, and may wish to close the bleed air valve, thereby increasing suction at the dirty air inlet, when cleaning carpets or other rough surfaces.

As exemplified in FIG. 13, the bleed valve 420 may include a primary air inlet 422, a secondary air inlet 424 and an air outlet 426. A longitudinally extending primary airflow passageway 428 extends between the primary air inlet 422 and the air outlet 426, and a secondary airflow passageway 430 extends between the secondary air inlet 424 and the primary airflow passageway 428. The air outlet 426 is in air flow communication with the downstream header 304 and the downstream face 296 of the pre-motor filter 282.

In the illustrated example, the primary airflow passageway 428 is defined by a sidewall 432 extending along a bleed valve axis 434 (FIG. 39). The sidewall 432 is disposed in the mounting hub 316 and, in the example illustrated, is oriented so that the bleed valve axis 434 is generally transverse to the forward direction of travel, and is parallel to the cyclone axis 174, suction motor axis 182, brush motor axis 224 and brush axis 134. Orienting the bleed valve 420 in this manner may help nest the bleed valve 420 between the wheel axis 320 and the cyclone bin assembly 160. This may help reduce the overall size of the surface cleaning apparatus. In this configuration, the direction of the flowing through the primary airflow passageway 428 is generally parallel to the direction of the air flow entering the suction motor air inlet 246, and is generally parallel to the direction of air flowing out of the cyclone air outlet 186 and the direction of air flowing through the pre-motor filter 282.

The air outlet 426 is provided as an opening in the sidewall 432, which is in communication with the downstream header 304. In this configuration, the direction of air exiting the bleed valve 420 via the air outlet 426 is generally orthogonal to the direction of the air flow entering the suction motor 162. Preferably, gaps are provided in the ribs supporting the downstream side 296 of the pre-motor filter 282 to receive air exiting the bleed valve 420 and to distribute the incoming air within the downstream header 304.

The primary air inlet 422 is covered by a pressure-actuated valve member that is configured to automatically open (thereby supplying bleed air) when the pressure in the downstream header falls below a pre-set threshold. When the valve member opens, air from open spaces within the surface cleaning head 102 is drawn into the bleed valve 420.

Referring to FIGS. 39 and 40, the secondary air inlet 424 is covered using a manually movable cover member 436. The cover member 436 includes a sealing portion 438 to selectively cover, and seal, the secondary air inlet 424, an engagement portion, in the form a slider 440, that can be actuated by a user.

In accordance with another feature, a user may move the slider between one or more open positions, in which second air inlet 424 is uncovered by different amounts to allow varying air flow rates into the bleed valve 420 (to the right as illustrated in FIGS. 39 and 40), and a closed position in which the secondary air inlet 424 is sealed to block air flow into the bleed valve 420. This may allow a user to manually choose to introduce bleed air into the system by opening the secondary air inlet, even if pressure in the downstream header 304 has not fallen below the pre-set threshold.

In the alternate embodiment of FIG. 56, the bleed valve 1420 includes a primary air inlet 1422 and an air outlet 1426, which in the example illustrated includes an aperture that is formed on the end wall 1290 of the pre-motor filter chamber 1280. A longitudinally extending primary airflow passageway 1428 extends between the primary air inlet 1422 and the air outlet 1426. The air outlet 1426 is in air flow communication with the downstream header 1304 and the downstream face 1296 of the pre-motor filter 1282.

In the illustrated example, the primary airflow passageway 1428 is defined by a sidewall 1432 extending along a bleed valve axis 1434. In the example illustrated, the bleed valve axis 1434 is generally transverse to the forward direction of travel, and is parallel to the cyclone axis 1174, suction motor axis 1186, brush motor axis 1224 and brush axis 1134. In this configuration, the direction of the flowing through the primary airflow passage 1428 is generally parallel to the direction of the air flow entering the suction motor air inlet 1246, and is generally parallel to the direction of air flowing out of the cyclone air outlet 1186 and the direction of air flowing through the pre-motor filter 1282.

Referring also to FIG. 57, in the illustrated example, the bleed valve 1420 is disposed directly above the brush motor 1214, and the axes 1422 and 1224 are co-planar.

It will be appreciated that some of the embodiments disclosed herein may not use any of the features of the bleed valve disclosed herein and that, in those embodiments, the bleed valve may be of various constructions or a bleed valve may not be used.

Handle Swivel Steer Connection

Optionally, the upper portion 104 may be steeringly connected to the surface cleaning head 102. For example, the upper portion 104 may be movably connected to the surface cleaning head in a manner so as allow the surface cleaning head 102 to be steered by rotating or twisting the upper portion 104.

Figure 11:
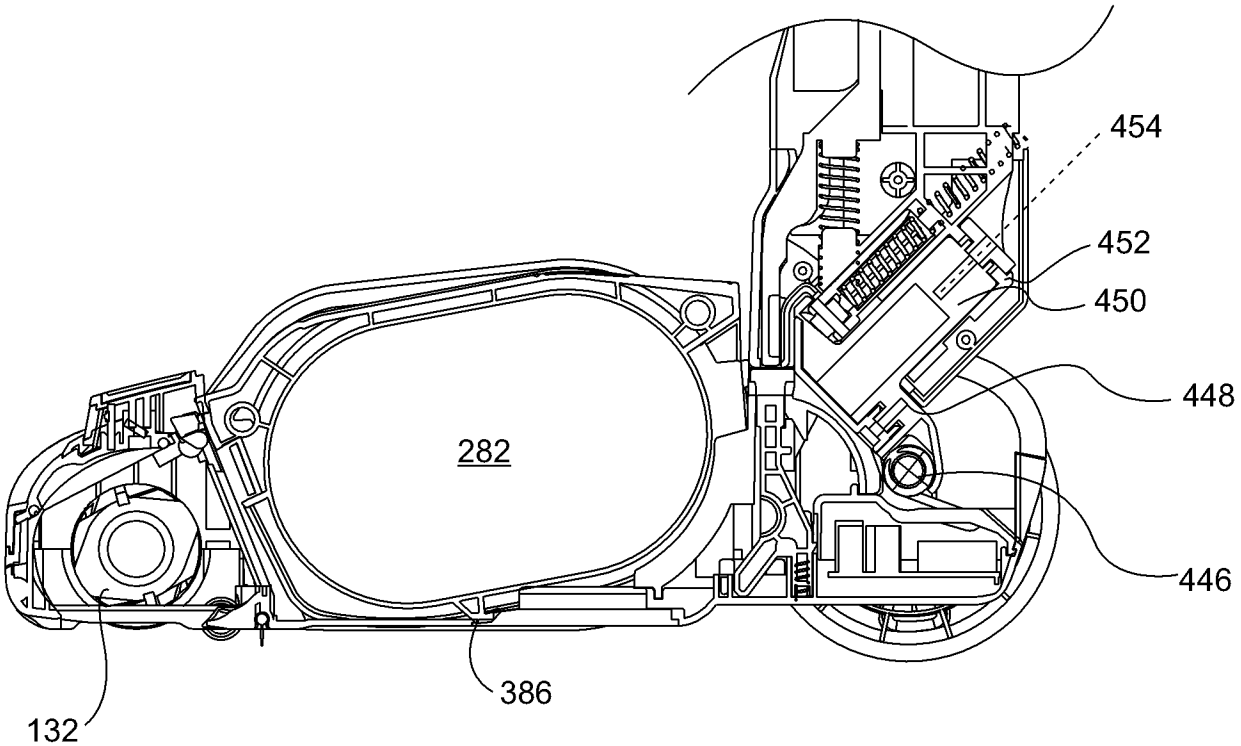
FIG. 11 is an enlarged view of a portion of FIG. 10.

In one embodiment, the pivot may be provided on the mounting hub 316. For example, as exemplified, the upper portion 104 may include a drive handle 442, having a hand grip portion 444, which extends upwardly from the cleaning head. The drive handle 442 is pivotally connected to the surface cleaning head 102 using a yolk member 448 (FIGS. 11 and 15) and may be pivoted between a storage position (FIG. 1) and an inclined floor cleaning position (FIG. 3). The yolk 448 may be pivotally coupled to the mounting hub 316 and is pivotal about a pivot axis 446 (FIG. 15) that is generally orthogonal to the direction of travel of the surface cleaning apparatus 100. Preferably, the driving handle 442, yolk 448, mounting hub 316 and other related components are configured so that the driving handle 442 is generally stable in the storage position, and will remain self-standing when in the storage position. For example, the upper portion 104 may be configured so that when in the storage position, the centre of gravity of the upper portion 104 is disposed generally above, or forward of the rear wheel pivot axis 320 and/or the yolk pivot axis 446. Alternatively, an external stand or storage device may be used in combination with the surface cleaning apparatus. Alternately, or in addition, a lock may be provided to secure the handle in the storage position. The lock may be a friction lock, a moveable locking member or the like.

In the illustrated example, the pivot axis 446 is parallel to the cyclone axis 174, suction motor axis 182, brush motor axis 224 and brush axis 134, and is offset rearwardly from each of these axes. The pivot axis 446 is at a higher elevation than the rear wheel axis 320, and in the example lies in the same vertical plane as the rear wheel axis 320.

Figure 41:
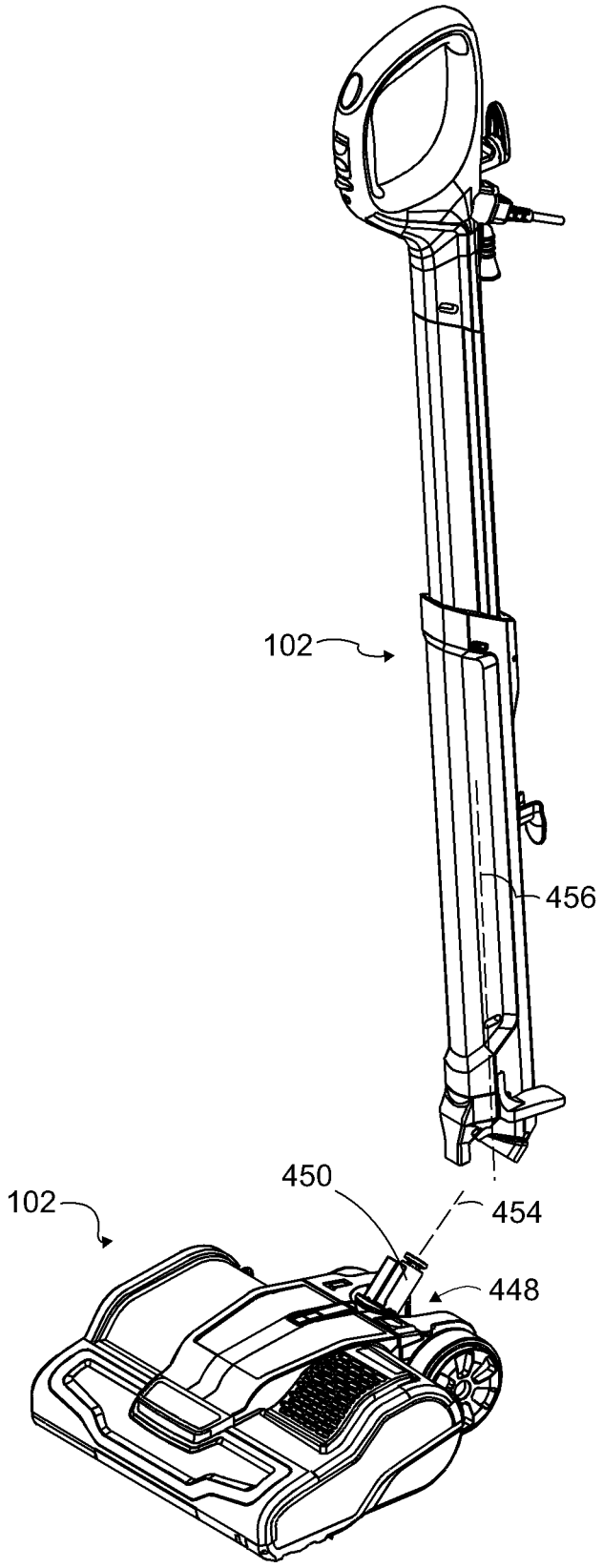
FIG. 41 is a partially exploded front perspective view of the surface cleaning apparatus of FIG. 1.
Figure 42A:
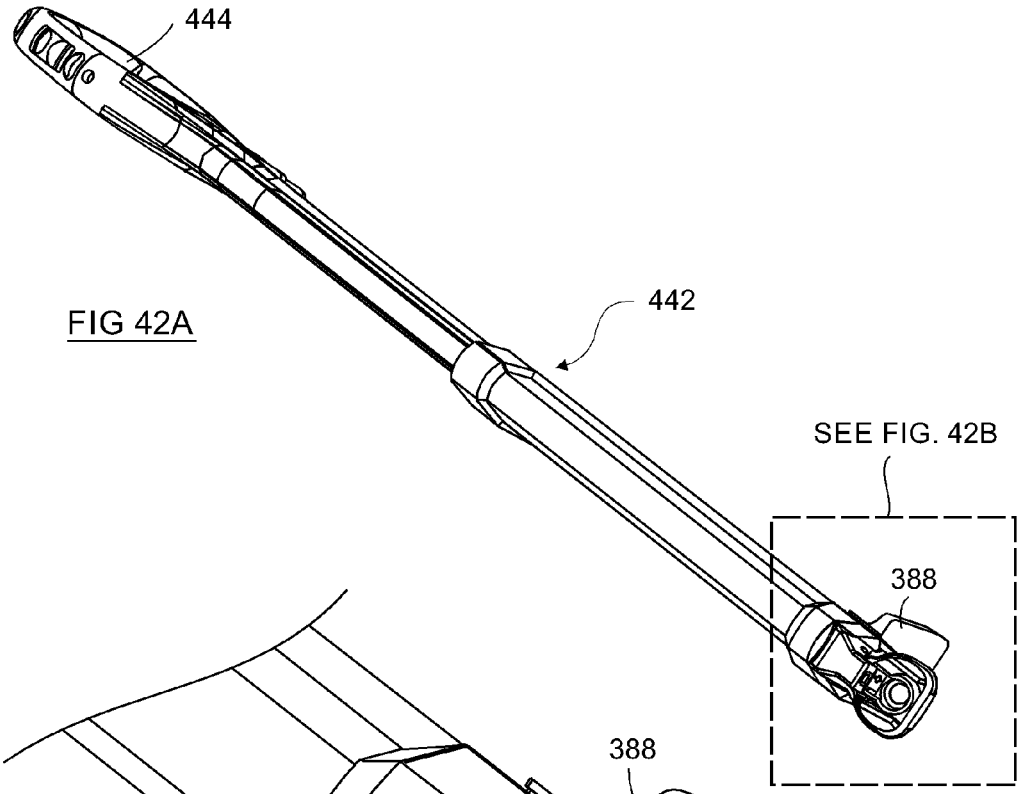
FIG. 42A is perspective view of the drive handle of FIG. 1.
Figure 42B:
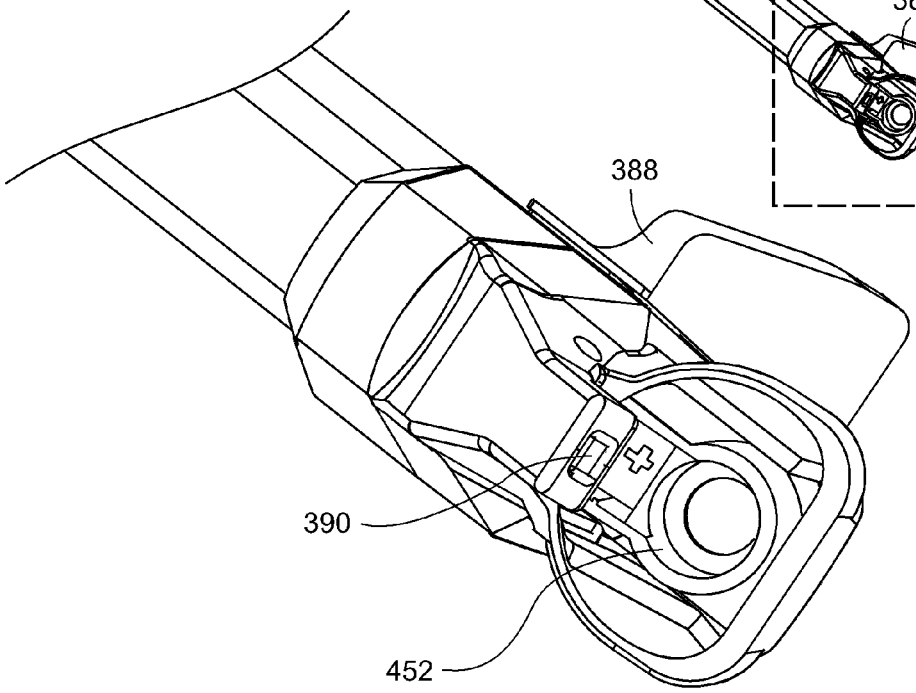
FIG. 42B is an enlarged view of a portion of the drive handle shown in FIG. 42A.

Optionally, the drive handle 442 can also be rotatably coupled to the yolk 448. This may help facilitate steering of the surface cleaning head. In the illustrated example, the yolk 448 includes generally cylindrical journal member 450 (FIG. 41) that is rotatably received within a corresponding housing 452 in the drive handle 442 (see FIGS. 42A, 42B and FIG. 11). In this configuration, the drive handle 442 is rotatable relative to the yolk 448 about a rotation axis 454. In the illustrated example, the rotation axis 454 is not parallel to the longitudinal axis 456 of the drive handle 442. Instead, the rotation axis 454 is at an angle 458 (FIG. 17) to the longitudinal axis 456. The angle 458 may be any suitable angle, and may be between about 0 degrees and about 90 degrees, and preferably between about 10 degrees and about 60 degrees, and more preferably between about 20 degrees about 50 degrees, and in the illustrated example is between about 40 degrees and about 45 degrees. Arranging the rotation axis 454 at an angle 458 relative to the handle axis 456 may help facilitate steering of the surface cleaning head 102 when the drive handle 442 is pivoted rearwardly.

It will be appreciated that some of the embodiments disclosed herein may not use any of the features of the swivel steering mechanism disclosed herein and that, in those embodiments, the swivel steering mechanism may be of various constructions or a swivel steering mechanism may not be used.

Brush Motor Air Inlet

The following is a description of a brush motor air inlet that may be used by itself in any surface cleaning apparatus or in any combination or sub-combination with any other feature or features disclosed herein. An advantage of this feature is that cooling air is provided to help cool the brush motor while the surface cleaning apparatus is in use. The cooling air inlet may be configured to draw air from the air flow path upstream or downstream from the air treatment member, or optionally to draw air in from the surrounding environment.

In accordance with one feature, one or more cooling air inlets may be provided in a wall of the brush chamber 130. In accordance with another feature, a plurality of ling air inlets may be provided. The advantages of each of these features is discussed with reference to FIG. 9.

As exemplified in FIG. 9, the surface cleaning head 102 includes a cooling air inlet 460 that is positioned to draw air from within the brush chamber 130. In this example, the cooling air inlet 460 includes four apertures 462 provided in the rear wall 138 of the brush chamber 130. The apertures 462 are in air flow communication with the brush motor 214 via an internal conduit provided in the surface cleaning head 102 (see also FIG. 13). The apertures 462 may be sized so that the area of each individual is relatively small and the combined area of all the apertures 462 is sufficient to provide a desired flow of air to the brush motor 214. Providing multiple relatively small apertures may help provide sufficient air flow while each individual aperture is small enough prevent relatively large debris particles from being drawn into the brush motor. Providing multiple apertures in parallel with each other can provide redundant air flow options, which may also allow some cooling air to reach the brush motor 214 even if one or more of the apertures become blocked with debris. Positioning the cooling air inlet within the brush chamber 130, and in proximity to the rotating brush 130, may also allow the brush 132 to dislodge debris from the cooling air inlet 460 while the surface cleaning apparatus is in use.

It will be appreciated that some of the embodiments disclosed herein may not use any of the features of the brush motor air inlet disclosed herein and that, in those embodiments, the brush motor air inlet may be of various constructions or a brush motor air inlet may not be used.

Cutting Groove

The following is a description of a cutting groove that may be used by itself in any surface cleaning apparatus or in any combination or sub-combination with any other feature or features disclosed herein.

Brush Chamber Window

The following is a description of a brush chamber window that may be used by itself in any surface cleaning apparatus or in any combination or sub-combination with any other feature or features disclosed herein.

Referring to FIG. 16, in the illustrated example the brush 132 includes cutting groove 468 that extends axially along the length of the brush 132. The cutting groove 468 is recessed below the surface of the brush 132 and is sized to accommodate a pair of scissors or other cutting tool. This can allow a portion of the scissors to be inserted beneath strands of hair, string or other types of debris that can get wound around the brush 132 during use. The scissors can then be translated along the length of the cutting groove 468 to cut the hair and strings entangled around the brush. Preferably, the brush 132 can be rotated so that the cutting groove 468 can be positioned toward the bottom of the brush 132 to allow a user to access the cutting groove 468 through the dirty air inlet 110 (for example, if a user turns the surface cleaning head 102 over for service) Optionally, the brush chamber 130 may also include one or more transparent regions to allow a user to visually inspect the interior of the brush chamber, including, for example, the brush. In the illustrated example, the brush chamber 130 includes a transparent region in the form of a window 470 (FIGS. 30 and 31) that is provided in the top wall 142.

Height Adjustable Drive Handle

The following is a description of an adjustable drive handle that may be used by itself in any surface cleaning apparatus or in any combination or sub-combination with any other feature or features disclosed herein.

In accordance with one aspect of the teaching described herein, the upper portion may be adjustable so that its height (i.e. the distance between the surface cleaning head and the hand grip) may be modified by a user. Providing an adjustable upper portion may allow a user to vary the height of the upper portion, such as, for example to accommodate users of different heights. Adjusting the height of the upper portion may also help reduce the overall size of the surface cleaning apparatus. Reducing the overall size of the surface cleaning apparatus may reduce the amount of space required for storage and/or shipping of the surface cleaning apparatus. The upper portion may be configured to be adjustable using any suitable adjustment mechanism.

Figure 5:
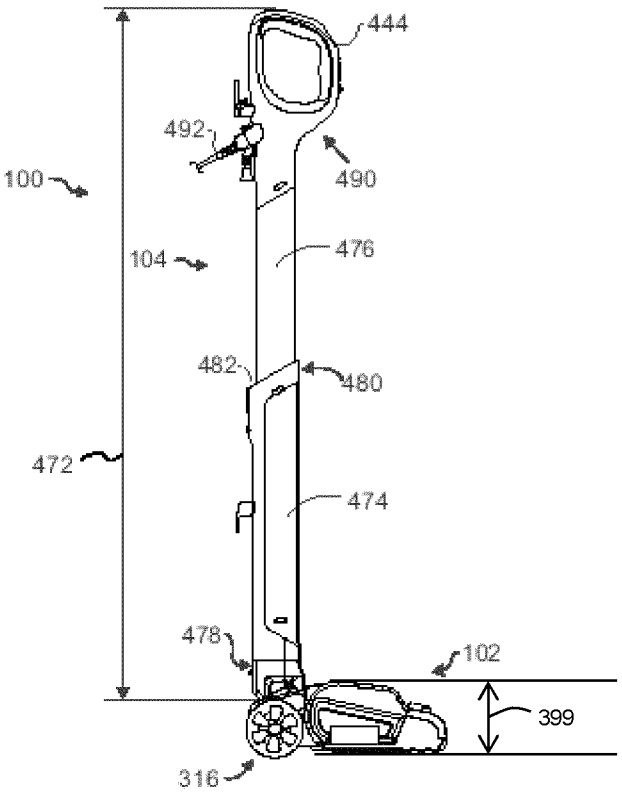
FIG. 5 is right side view of the surface cleaning apparatus of FIG. 1.
Figure 6:
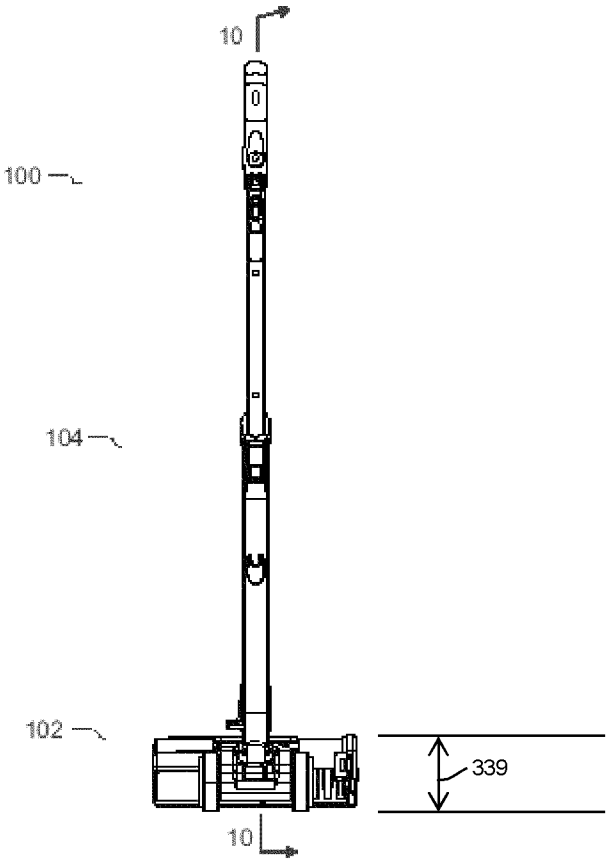
FIG. 6 is a rear view of the surface cleaning apparatus of FIG. 1.
Figure 44:
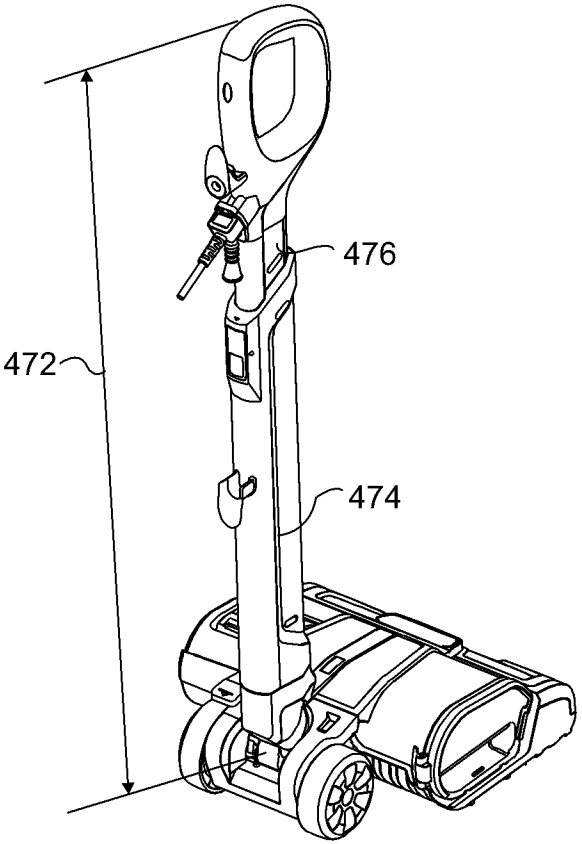
FIG. 44 is a rear perspective view of the surface cleaning apparatus of FIG. 1 with a drive handle in a retracted position.

As exemplified in FIGS. 5 and 44, drive handle 442 includes a lower section 474 and an upper section 476. The lower section 474 has a first end 478 movably coupled to the surface cleaning head (e.g., mounting hub 316), and an upper end 480 spaced apart from the lower end 478. The upper section includes a lower end 488 that is coupled to the lower section 474, and an upper end 490 that includes the hand grip 444 and an optional attachment point 492 for the electrical cord. In the illustrated example, the upper section 476 is sized to fit within the lower section 474, and is slidable relative to the lower section between an extended position (FIG. 5) and one or more retracted positions (FIG. 44).

In the extended position, the upper portion has an extended height 472 that can be any suitable height, and in the example illustrated is between about 50 cm and about 150 cm or more. In extended position the hand grip 444 and optional electrical cord attachment location 492 are spaced apart from the lower section 474. When in the retracted position, the upper section 474 may be at least partially nested within the lower section 474 and the upper portion height 472 is less than when in the extended position. In the illustrated example, the hand grip 444 and electrical cord attachment location 492 are both positioned closer to the surface cleaning head 102, and may be generally adjacent the upper end 480 of the lower section 474, when the upper portion 476 is in the retracted configuration.

Figure 43:
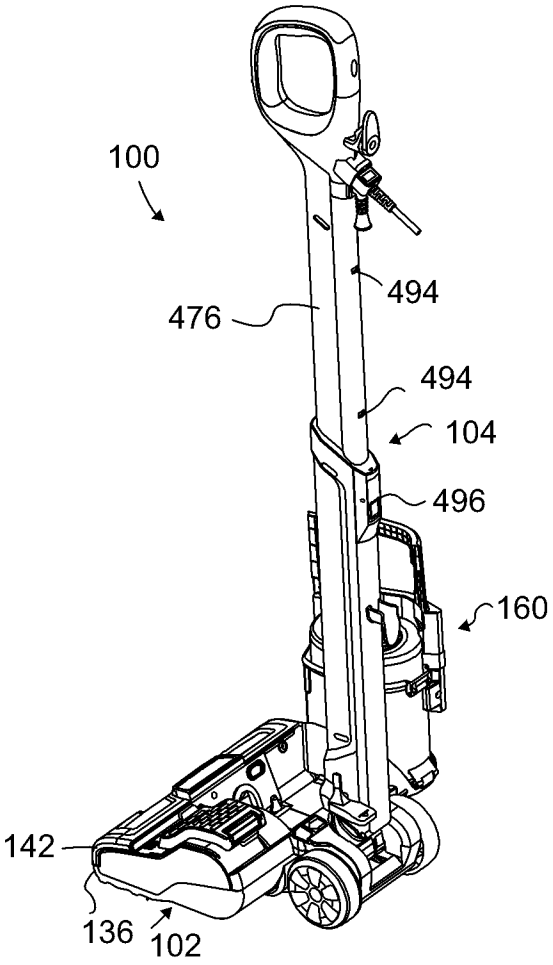
FIG. 43 is a rear perspective view of the surface cleaning apparatus of FIG. 1 with a brush chamber open and the cyclone bin in a removal position.

The upper section 476 may be secured in each of the one or more retracted positions using any suitable mechanism, including, for example, pins, latches, detents, clips, fasteners, friction/interference fit and other mechanisms. Referring to FIG. 43, in the illustrated example the upper section 476 includes a pair of detents 494 and the lower section 474 includes a latch 496 that is configured to selectively engage the detents 494. The latch 496 is releasable so that a user may release the latch 496 and translate the upper section 476 relative to the lower section 474 to alter the height the upper portion 104. When a desired detent 494 is aligned with the latch 496, the latch 496 may be re-engaged (and preferably is biased toward the engaged position) thereby securing the upper section 476 and inhibiting further translation of the upper section 476 relative to the lower section 474.

It will be appreciated that some of the embodiments disclosed herein may not use any of the features of the drive handle disclosed herein and that, in those embodiments, the drive handle may be of various constructions or a height adjustable drive handle may not be used. For example, the drive handle need not be provided with electrical cord attachment location 492. Instead the electrical cord may be connected to the surface cleaning head 102 (e.g., see the alternate embodiment of FIG. 53 wherein the electrical cord attachment point 492 is provided on the mounting hub 1318, and wherein, optionally, the electrical cord 502 is not detachable).

Detachable Electrical Cord

The following is a description of an electrical cord that may be used by itself in any surface cleaning apparatus or in any combination or sub-combination with any other feature or features disclosed herein.

In accordance with one aspect of the teaching described herein, power (preferably AC power) may be supplied to the surface cleaning apparatus using the electrical cord. In the illustrated examples, AC power is supplied to the surface cleaning apparatus using an electrical cord that may be connected to a wall socket. The cord may be connected to the apparatus at any suitable location, including, for example on the surface cleaning head itself, or on the upper section. If connected to the upper section, the cord attachment point may be toward an upper end of the upper section (e.g., generally adjacent the hand grip portion), and one or more electrical conductors may extend from the cord attachment point to the surface cleaning head. The electrical conductors may be internal the upper section, or external. Optionally, the electrical conductors may be adjustable, and preferably may be extensible and/or resilient (i.e. such as a coiled electrical cord) so that the electrical conductors can accommodate changes in length of the upper portion without requiring decoupling or reconfiguration, and without interrupting electrical supply to the surface cleaning head.

In accordance with one feature, the electrical cord may be connected to an upper portion of the drive handle, such as the upper end of the upper section, adjacent and slightly beneath the hand grip. Connecting the electrical cord on an upper portion of the drive handle, such as adjacent the hand grip may help reduce the likelihood that the cord will interfere with the movement of the surface cleaning head. This positioning may also help make it convenient for a user to hold a portion of the cord with his/her free hand (i.e. the hand that is not holding the hand grip) and to manipulate the cord to help prevent entanglement or other impedances to the vacuuming process. Spacing the electrical cord attachment point away from the surface cleaning head may also help reduce the need to move the electrical cord in close proximity and/or beneath furniture and other objects when the surface cleaning head is moved proximate or under such objects. This may help reduce the chances of the electrical cord becoming tangled or snagged while the surface cleaning apparatus is in use.

In accordance with another feature, the electrical cord may be detachably connected to the surface cleaning apparatus. This may allow the cord to be detached for storage, or for an alternative or replacement cord to be connected to the apparatus. This may also allow the cord to be detached when not needed, such as if the surface cleaning apparatus is being powered by an alternative power source.

Figure 45:
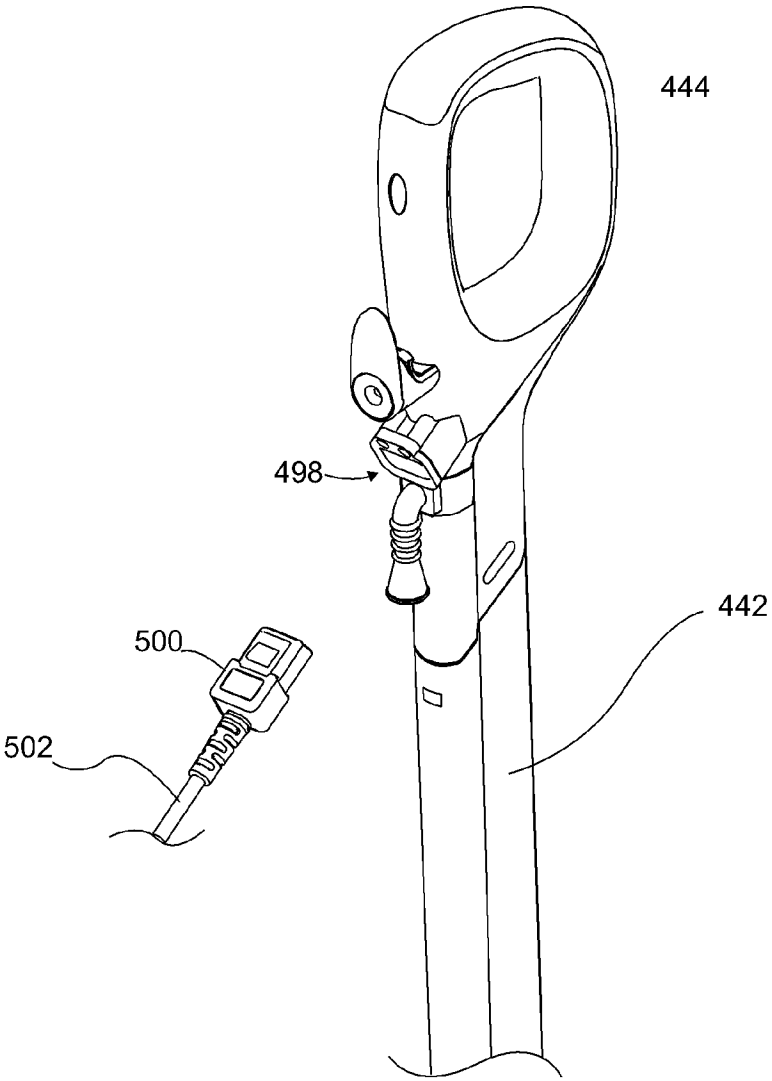
FIG. 45 is an enlarged rear perspective view the upper portion of the drive handle of FIG. 1.

Referring to FIG. 45, in the illustrated example, the electrical cord 502 is connected to the upper portion 442 using a detachable connector that provides mechanical and electrical connection between the electrical cord and the surface cleaning apparatus. The connector may be any suitable type of electrical connector, and in the illustrated example includes a first connector portion in the form of a socket 498 on the upper portion 442 that includes pins, and a second connector portion, in the form of a connector 500 that is configured to fit within the socket 498 and receive the pins.

It will be appreciated that some of the embodiments disclosed herein may not use any of the features of the electrical cord disclosed herein and that, in those embodiments, the electrical cord may be of various constructions or a detachable electrical cord may not be used.

Cordless Mode

The following is a description of a cordless operating mode that may be used by itself in any surface cleaning apparatus or in any combination or sub-combination with any other feature or features disclosed herein.

Optionally, the surface cleaning apparatus may include one or more portable energy storage devices, such as one or more batteries. The onboard battery may be a DC power source. Providing an onboard portable energy storage device may allow the surface cleaning apparatus to be operated in a cordless mode, in which the surface cleaning apparatus can be powered by the onboard energy storage device and need not be plugged into a wall socket. Configuring the surface cleaning apparatus as a cordless apparatus may be used in combination with any one or more of the other features described herein.

Preferably, the on-board energy storage member is one or more batteries that may be sized to fit within the surface cleaning head and is powerful enough to drive the suction motor and optionally the rotating brush motor. Optionally, when operated on DC battery power, as opposed to external AC power, the rotating brush motor and/or the suction motor may operate at a reduced rate or may be otherwise configured to reduce power consumption (e.g., the motor may have dual windings to be operable on both AC and DC power). If required, a converter module can be provided to convert the external power supply into a format (e.g., DC) that is compatible with motor, configured to re-charge the batteries or is otherwise preferred over the native incoming format.

The battery may be any suitable type of battery, including a rechargeable battery. Optionally, when the surface cleaning apparatus is electrically connected to an AC power source (e.g., a wall socket), power from the AC source may be used to re-charge the battery, to directly power/drive the suction motor, and/or rotating brush motor or to simultaneously run the suction motor and brush motor and re-charge the battery. In this configuration, when the vacuum is operated the battery in the cleaning head may be charged and the suction motor and brush motor may be driven by AC power and/or a combination of AC and battery power. Then, when the surface cleaning apparatus is electrically decoupled from the AC power source the surface cleaning apparatus can be operated on battery power alone.

Alternatively, or in addition to positioning a battery in the surface cleaning head, one or more batteries may be provided within the upper portion and electrically connected to the suction motor and/or other components in the surface cleaning head. Providing at least some batteries in the upper portion may provide extra space to accommodate the batteries, as compared to the space limitations within the surface cleaning head. Positioning batteries in the upper portion may also alter the weight distribution of the surface cleaning apparatus, which may alter the "feel" of the apparatus in a user's hand. In embodiments where the electrical cord is connected to the upper portion, providing batteries within the upper portion may help facilitate the use of a convenient electrical connection between the incoming power from the electrical cord and the batteries and/or charging equipment. This may help reduce the need to run multiple electrical conductors between the upper portion and the surface cleaning head.

Providing batteries in the upper portion may help facilitate access to the batteries for maintenance and/or replacement.

It will be appreciated that some of the embodiments disclosed herein may not use any of the features of the cordless mode disclosed herein and that, in those embodiments, the cordless mode may be of other designs or a cordless mode may not be used.

Alternate Embodiment with Above Floor Cleaning

The following is a description of an all in the head type surface cleaning apparatus that is operable in at least one above floor cleaning mode, that may be used by itself in any surface cleaning apparatus or in any combination or sub-combination with any other feature or features disclosed herein.

Optionally, an all in the head type surface cleaning apparatus may be configured to operate in at least one above floor cleaning mode. For example, the surface cleaning apparatus may include an auxiliary dirty air inlet that is provided at the end of a hose, wand, auxiliary cleaning tool or other type of conduit that may be connected in air flow communication with the air treatment member and suction motor for above floor cleaning. The auxiliary dirty air inlet may be used to clean furniture, drapes, walls and other surfaces that are above the floor upon which the surface cleaning head rests.

The auxiliary dirty air inlet may be automatically in air flow communication with the air treatment member and suction motor when the auxiliary dirty air inlet is positioned for use (e.g., a wand having a dirty air inlet is removed from a storage position). A valve or other air flow control member may be provided in the air flow path to interrupt the air flow communication between the auxiliary dirty air inlet and the suction motor. The valve may be manually operable or may operate automatically by insertion and/or removal of an above floor cleaning wand or by placing the apparatus in the upright storage position or releasing the apparatus from the upright storage position or by sensors and electrical-driven movement.

Referring to FIG. 46, another example of an all in the head type surface cleaning apparatus 1100, having an above floor cleaning mode, is illustrated. The surface cleaning apparatus 1100 is generally similar to the surface cleaning apparatus 100, and analogous features are identified using like reference characters indexed by 1000. Some or all of the features described in association with the surface cleaning apparatus 100 can be used alone, or in combination with each other in the surface cleaning apparatus 1100. Similarly, the above floor cleaning aspects of cleaning apparatus 1100 may optionally be incorporated into surface cleaning apparatus 100.

In accordance with one feature, a cyclone chamber may be provided with dual air inlets, one connectable in air flow communication with the brush chamber and one connectable in air flow communication with an auxiliary dirty air inlet.

As exemplified in FIGS. 55 and 56, the cyclone chamber 1164 may include an air inlet 1184 with an upstream or inlet end 1190 that is connectable to an air outlet 1192 (FIG. 49) in the rear wall 1138 of the brush chamber 1130. The cyclone air inlet 1184 also includes a downstream end 1194 that includes an opening formed in the cyclone sidewall 1173, and a connecting portion 1196 extending through the dirt collection chamber 1166 between the upstream and downstream ends 1190 and 1194. The air flow connection between the brush chamber outlet 1192 and the cyclone chamber 1164 can form a first air flow path, which is a portion of the overall air flow path connecting the dirty air inlet 1110 to the clean air outlet 1112. In addition to the air inlet 1184, the cyclone chamber 1164 may also include an auxiliary air inlet **1184*b* with an upstream or inlet end 1190*b* that is connectable to a downstream end 1628 of a duct 1626 that is provided in the mounting hub 1316. The cyclone air inlet 1184*b* also includes a downstream end 1194*b* that includes an opening formed in the cyclone sidewall 1173*b*, and a connecting portion 1196*b* extending through the mounting hub 1314, between the upstream and downstream ends 1190*b* and 1194*b***.

Referring to FIGS. 46 and 58, in the illustrated embodiment the upper portion 1140 includes a rigid wand 1620 that is slidably received within a flexible hose 1622. The wand 1620 has a lower, downstream end 1624 that can be coupled to the duct 1626 that extends through the mounting hub 1316, whereby the upper portion 1104 and the connection of the upper portion to the surface cleaning head is sufficiently rigid to function as the driving handle 1442, including the hand grip 1444, to maneuver the surface cleaning apparatus (FIG. 58).

Referring also to FIG. 56, the wand 1620 has an upstream end 1630 that is spaced apart from the downstream end 1624. A cap 1632 is provided on the upper portion 1104, e.g., positioned on the hand grip 1444, so that the cap 1632 may be adjacent the upstream end 1630 when the wand 1620 is coupled to the duct 1626. When the cap 1632 is closed (as shown, for example, in FIGS. 49 and 58) it seals the upper end of the wand 1620. When the cap 1632 is open, air flow through the wand 1620 is permitted. In accordance with such an embodiment, wand 1620 may always be in air flow communication with the suction motor and a valve is not required. Instead, cap may seal the upstream end of wand 1620.

As shown in FIG. 59, when the cap 1632 is opened the wand 1620 can be pulled out of the surrounding hose 1622. In this configuration, the lower end 1624 of the wand 1620 is decoupled from the duct 1626, but the surrounding hose 1622 remains connected and provides the air flow connection between the lower end 1624 of the wand 1620 and the duct 1626 (and ultimately to the air inlet **1184*b*). With the wand 1620 detached, the upper portion 1104 can become flexible, and the wand 1620 may be moved away from the surface cleaning head 1102 while air flow communication is preserved by the hose 1622. Optionally, the hose 1622 may be extensible. This may help facilitate moving the hose 1622 and wand 1620** to a variety of above floor cleaning locations.

To operate the surface cleaning apparatus 1100 in a floor cleaning mode, the wand 1620 may be inserted within the hose 1622 so that the lower end 1624 of the wand 1620 engages the duct 1626. The cap 1632 may then be closed to seal the upper end of the wand 1620, thereby eliminating or substantially eliminating air flow through the upper portion and fluidly isolating the auxiliary air inlet **1184*b* from the surrounding environment. Restricting the air flow through the wand 1620 in the floor cleaning mode may help direct all or a majority of the air flow/suction generated by the suction motor 1162 through the primary dirty air inlet 1110**.

To operate the surface cleaning apparatus 1100 in an above floor cleaning mode, the cap 1632 may be opened and the wand 1620 may be at least partially extracted from the hose 1622. In this configuration, the upstream end 1630 of the wand 1620 functions as an auxiliary dirty air inlet 1110*b*, that is in air flow communication with the auxiliary cyclone air inlet 1184*b*.

Optionally, when in the above floor cleaning mode, both dirty air inlets 1110 and 1110*b* may remain in air flow communication with the suction motor 1162. In such an arrangement, the suction generated by the suction motor 1162 may be divided between the dirty air inlets 1110 and 1110*b*. Alternatively, a valve or other blocking member may be used to interrupt the air flow communication between the dirty air inlet 1110 and the suction motor 1162 when operating in the above floor cleaning mode.

As exemplified in FIGS. 54A and 54B, a valve to close the air flow path from the brush chamber may include a flow restricting member that includes a blocker 1634 connected to a slider 1636. The flow restricting member may be configured so that a user may translate the slider 1636, e.g., in the transverse direction, to move the blocker 1634 between a deployed position (FIG. 54A) and a retracted position (FIG. 54B). In the deployed position the blocker 1634 seals the opening 1192 in the back wall 1138 of the brush chamber 1130, thereby interrupting the air flow communication between the upstream end 1190 of the cyclone air inlet 1184 and the dirty air inlet 1110. In the retracted position, the blocker 1634 is retracted within the back wall 1138 of the brush chamber 1130 and the upstream end 1190 of the cyclone air inlet 1184 is in air flow communication with the dirty air inlet 1110.

It will be appreciated that any valve member know in the art may be used to close the air flow path instead of or in addition to blocker 1634. The valve may be operated manually or automatically upon reconfiguration of the surface cleaning apparatus to an above floor cleaning mode.

In another embodiment, the cyclone chamber, e.g., the cyclone bin assembly may have a single air inlet. In such a case, the cyclone bin assembly may be moveable or repositionable (e.g., translatable sideways) to selectively align the cyclone bin assembly air inlet with an outlet of the air flow path from the brush motor or the air flow path from the above floor cleaning wand 1620.

It will be appreciated that some of the embodiments disclosed herein may not use any of the features of the above floor cleaning mode disclosed herein and that, in those embodiments, the above floor cleaning mode may be of other designs or an above floor cleaning mode may not be used.

What has been described above has been intended to be illustrative of the invention and non-limiting and it will be understood by persons skilled in the art that other variants and modifications may be made without departing from the scope of the invention as defined in the claims appended hereto. The scope of the claims should not be limited by the preferred embodiments and examples, but should be given the broadest interpretation consistent with the description as a whole.

The invention claimed is:

1. An all in the head surface cleaning apparatus comprising:

(a) a surface cleaning head comprising:

(i) a front end, a rear end, first and second laterally opposed sidewalls and an air flow path extending from a dirty air inlet to a surface cleaning head air outlet;

(ii) a cyclone assembly comprising a cyclone chamber and a dirt collection chamber, the cyclone chamber having a longitudinal cyclone axis, a cyclone air inlet and a cyclone air outlet, the dirt collection chamber is moveable between an in use position and an emptying position;

(iii) a pre-motor filter chamber; and, (iv) a suction motor, wherein at least one of the pre-motor filter and a pre-motor filter chamber is revealed when the dirt collection chamber is in the emptying position; and (b) an upper portion moveably mounted to the surface cleaning head between a storage position and a floor cleaning position, the upper portion comprising a drive handle.

2. The apparatus of claim 1 wherein the pre-motor filter is positioned in the pre-motor filter chamber and the pre-motor filter chamber is moveable with the dirt collection chamber.

3. The apparatus of claim 2 wherein the pre-motor filter is moveable as a closed chamber.

4. The apparatus of claim 2 wherein the cyclone assembly is removable as a closed unit other than air inlet and air outlet ports and the dirt collection chamber is removed with the cyclone assembly.

5. The apparatus of claim 2 wherein the pre-motor filter chamber is integrally formed as part of the cyclone assembly.

6. The apparatus of claim 2 wherein the pre-motor filter chamber is located at an air outlet end of the cyclone assembly.

7. The apparatus of claim 2 wherein the pre-motor filter chamber has an air inlet and an air outlet, and the pre-motor filter has an upstream face, a downstream face and a pre-motor filter axis that is generally parallel to the upstream and/or downstream face and is generally transverse to the cyclone axis.

8. The apparatus of claim 2 wherein the pre-motor filter chamber has an air inlet and an air outlet, the suction motor has an air inlet end wherein a direction of flow through the pre-motor filter chamber air outlet is generally parallel with the suction motor housing air inlet when the dirt collection chamber is in the in use position.

9. The apparatus of claim 2 wherein the pre-motor filter chamber has an air inlet and an air outlet, the suction motor is provided in a suction motor housing having an air inlet and the pre-motor filter chamber air outlet abuts the suction motor housing air inlet when the dirt collection chamber is in the in use position and is spaced therefrom when the dirt collection chamber is in the emptying position.

10. The apparatus of claim 1 further comprising a brush motor drivingly connected to a moveable brushing member.

11. The apparatus of claim 1 wherein the dirt collection chamber comprises a portion of the cyclone chamber.

12. The apparatus of claim 1 wherein the dirt collection chamber is exterior to the cyclone chamber.

13. The apparatus of claim 1 wherein the pre-motor filter is positioned in the pre-motor filter chamber, the pre-motor filter chamber has an air inlet and an air outlet and the pre-motor chamber air outlet faces an air inlet of the suction motor.

14. The apparatus of claim 11 wherein the suction motor has a suction motor axis that is generally parallel to the cyclone axis and an upstream face of the pre-motor filter is generally transverse to the cyclone axis.

15. The apparatus of claim 1 wherein the pre-motor filter is positioned in the pre-motor filter chamber and the pre-motor filter chamber has an air inlet and an air outlet and the pre-motor chamber air inlet faces an air outlet of the cyclone chamber and the pre-motor filter chamber air inlet abuts the cyclone chamber air outlet when the dirt collection chamber is in the in use position and is spaced therefrom when the dirt collection chamber is in the emptying position.

16. The apparatus of claim 1 wherein the upper portion comprises a first end coupled to the surface cleaning head and a second end spaced apart from the first end and wherein the drive handle is disposed toward the second end.

17. The apparatus of claim 1 further comprising a mounting hub extending from the rear side of the surface cleaning head, the upper portion being moveably mounted to the mounting hub and being rotatably connected to the mounting hub whereby the upper portion is rotatable about a rotation axis relative to the surface cleaning head.

* * * * *